US009048022B2

(12) United States Patent
Shim

(10) Patent No.: US 9,048,022 B2
(45) Date of Patent: Jun. 2, 2015

(54) ELECTROMAGNETICALLY-COUNTERED TRANSFORMER SYSTEMS AND METHODS

(75) Inventor: Youngtack Shim, Port Moody (CA)

(73) Assignee: Youngtack Shim, Port Moody, CA (US)

( * ) Notice: Subject to any disclaimer, the term of this patent is extended or adjusted under 35 U.S.C. 154(b) by 148 days.

(21) Appl. No.: 12/318,543

(22) Filed: Dec. 31, 2008

(65) Prior Publication Data

US 2010/0164673 A1 Jul. 1, 2010

Related U.S. Application Data

(63) Continuation of application No. 11/510,667, filed on Aug. 28, 2006, now Pat. No. 7,876,917.

(51) Int. Cl.

| | |
|---|---|
| ***H01F 27/36*** | (2006.01) |
| ***H01F 27/28*** | (2006.01) |
| ***H01F 27/24*** | (2006.01) |
| ***H01F 27/34*** | (2006.01) |

(52) U.S. Cl.

CPC ..... *H01F 27/365* (2013.01); *H01F 27/346* (2013.01)

USPC ..... 336/84 M; 336/84 C; 336/170; 336/184; 336/212

(58) Field of Classification Search

CPC ..... H01F 30/16; H01F 17/045; H01F 27/362; H01F 27/365; H01F 27/367; H01F 27/36

USPC ..... 336/170, 180, 182, 184, 212, 221, 213, 336/84 R, 84 C, 84 M

See application file for complete search history.

(56) References Cited

U.S. PATENT DOCUMENTS

| | | | | |
|---|---|---|---|---|
| 3,361,956 | A * | 1/1968 | Sola | 323/262 |
| 3,534,247 | A * | 10/1970 | Miljanic | 323/357 |
| 4,910,482 | A * | 3/1990 | Takagai et al. | 333/181 |
| 6,657,529 | B1 * | 12/2003 | Albach | 336/182 |
| 2006/0158303 | A1 * | 7/2006 | Diekmann et al. | 336/234 |

* cited by examiner

*Primary Examiner* — Mangtin Lian
(74) *Attorney, Agent, or Firm* — Stein IP, LLC

(57) ABSTRACT

The present invention relates to an electromagnetically-countered system including at least one wave source irradiating harmful electromagnetic waves and at least one counter unit emitting counter electromagnetic waves which are capable of countering the harmful waves by such counter waves. More particularly, the present invention relates to generic counter units of various electromagnetically-countered transformer systems and to various mechanisms for countering the harmful waves by the counter units by, e.g., matching configurations of such counter units with those of the wave sources, matching shapes of the counter waves with shapes of the harmful waves, and the like. The present invention also relates to various methods of countering the harmful waves with the counter waves by such source matching or wave matching and various methods of providing such counter units as well as emitting the counter waves. The present invention also relates to various processes for providing such systems and their counter units. The present invention further relates to various electric and/or magnetic shields which may be used alone and/or in combination with such counter units to minimize irradiation of the harmful waves from the system.

20 Claims, 7 Drawing Sheets

ELECTROMAGNETICALLY-COUNTERED TRANSFORMER SYSTEMS AND METHODS

CROSS-REFERENCES TO RELATED APPLICATIONS

The present application is a continuation of the U.S. Utility patent application which is entitled "Generic electromagnetically-countered systems and methods," which was filed on Aug. 28, 2006, and which bears the Ser. No. 11/510,667, and which is not patented as U.S. Pat. No. 7,876,917, issued on Jan. 25, 2012, the disclosure of which is incorporated herein by reference. The present application also claims an earlier invention date of the Disclosure Document which is entitled the same, which was deposited in the U.S. Patent and Trademark Office (the "Office") on Jan. 3, 2007 under the Disclosure Document Deposit Program (the "DDDP") of the Office, and which bears the U.S. Pat. No. 610,804, the disclosure of which is incorporated herein by reference.

FIELD OF THE INVENTION

The present invention relates to an electromagnetically-countered system including at least one wave source irradiating harmful electromagnetic waves and at least one counter unit emitting counter electromagnetic waves which are capable of countering the harmful waves by such counter waves. More particularly, the present invention relates to generic counter units of various electromagnetically-countered transformer systems and to various mechanisms for countering the harmful waves by the counter units by, e.g., matching configurations of such counter units with those of the wave sources, matching shapes of the counter waves with shapes of the harmful waves, and the like. The present invention also relates to various methods of countering the harmful waves with the counter waves by such source matching or wave matching and various methods of providing such counter units as well as emitting the counter waves. The present invention also relates to various processes for providing such systems and their counter units. The present invention further relates to various electric and/or magnetic shields which may be used alone and/or in combination with such counter units to minimize irradiation of the harmful waves from the system.

BACKGROUND OF THE INVENTION

It is now well established in the scientific community that electromagnetic waves with varying frequencies irradiated by various devices may be hazardous to human health. In some cases, such electromagnetic waves in mega- and giag-hertz range may be the main culprit, whereas the 60-hertz electromagnetic waves may be the main health concern in other cases. It cannot be too emphasized that it is very difficult to shield against magnetic waves of the 60-hertz electromagnetic waves which have wavelengths amounting to thousands of kilometers and that such 60-hertz magnetic waves are omnipresent in any corner of the current civilization.

However, intensity of such electromagnetic waves typically decreases inversely proportional to a square of a distance from a source of such waves to a target. Accordingly, potentially adverse effects from such electromagnetic waves may be minimized by maintaining a safe distance from such a source. Some electrical devices, however, require transformers to reduce line voltage of 110 volts (or 220 volts) down to a suitable level, with or without rectifying the reduced AC line voltage into a DC voltage. The transformer generally employs multiple coils of wire (or solenoids) and reduces the line voltage by magnetically coupling a primary coil with a secondary coil. Such coils are wound around a core of the transformer while facing each other from opposite legs of the core, and tend to generate and accumulate strong dynamic magnetic fields therearound. It is, accordingly, reasonable to expect that the coils irradiate strong harmful electromagnetic waves and that the transformers (or adaptors) of various electric devices also irradiate such harmful waves to unwary users.

Therefore, there is an urgent need for a generic counter unit capable of being incorporated to various conventional transformers (or adaptors) and converting such transformers (or adaptors) into electromagnetically-countered transformer (or adaptor) systems to minimize irradiation of the harmful waves therefrom. There also is a need to provide feasible solutions to counter such harmful waves irradiated by various base units of waves sources of the transformers (or adaptors). There further is a need to provide another feasible solution for countering such harmful waves defining wavefronts of various propagating characteristics.

SUMMARY OF THE INVENTION

The present invention relates to an electromagnetically-countered system including at least one wave source irradiating harmful electromagnetic waves and at least one counter unit emitting counter electromagnetic waves for countering the harmful waves by the counter waves, e.g., by canceling at least a portion of the harmful waves by the counter waves, by suppressing the harmful waves from propagating to a target space, and the like. More particularly, the present invention relates to generic counter units for electromagnetically-countered transformer systems and to various mechanisms for countering the harmful waves which are irradiated from various base units of the wave sources with the counter waves emitted from the counter units. To this end, the counter unit may be shaped, sized, and/or arranged to match its configuration with a configuration of at least one of the base units of the wave source, thereby emitting the counter waves which automatically match characteristics of such harmful waves. In the alternative, the counter unit may instead be shaped, sized, and/or disposed in an arrangement defined along one or multiple wavefronts of such harmful waves, thereby emitting the counter waves automatically matching characteristics of such harmful waves. The present invention also relates to the counter unit which is provided as an analog of at least one of the base units of the wave source, where the analog may approximate or simplify at least one of such base units which is more complex than the counter unit, where the two- or one-dimensional analog may also approximate at least one of the three- or two-dimensional base units, and the like. The present invention relates to multiple counter units which are simpler than the base units but rather disposed in an arrangement for approximating the shape and/or arrangement of at least one of the base units. The present invention also relates to the counter unit which may be shaped and/or sized according to the configuration of at least one of the base units and disposition thereof. In addition, the present invention relates to various countering modes in which a single counter unit may counter a single base unit, may counter at least two but not all of multiple base units or may counter all of multiple base units, in which multiple counter units may counter a single base unit, may counter more base units or may counter less multiple units. The present invention relates to various electric and/or magnetic shields which may be used alone or in conjunction with the counter units to minimize irradiation of the harmful waves from the system.

The present invention also relates to various methods of countering the harmful waves by the counter waves by such source matching or wave matching, where the harmful waves are irradiated from various base units of at least one wave source of an electromagnetically-countered transformer system which also includes at least one counter unit emitting such counter waves. More particularly, the present invention relates to various methods of providing the counter unit as an analog of at least one of the base units and emitting the counter waves matching the harmful waves for the countering, various methods of approximating or simplifying at least one of such base units by the simpler counter unit for the countering, and various methods of approximating at least one of the base units by multiple simpler counter units. The present invention also relates to various methods of disposing the counter unit along at least one of the wavefronts of the harmful waves and emitting such counter waves for automatically matching such harmful wavefronts, various methods of disposing multiple counter units along at least one of the harmful wavefronts and emitting the counter waves by the counter units for automatically matching the harmful wavefronts, and the like. The present invention relates to various methods of manipulating the wavefronts of the counter waves by disposing the counter unit closer to or farther away from the target space with respect to at least one of the base units, various methods of controlling radii of curvature of such wavefronts of the counter waves by including one or multiple counter units emitting such counter waves of the same or opposite phase angles, various methods of adjusting the wavefronts of the counter waves by disposing one or multiple counter units defining the shapes similar to or different from the shapes of such base units, and the like. The present invention also relates to various methods of countering the harmful waves from one or multiple base units with the counter waves emitted by the single or multiple counter units. Accordingly, the present invention relates to various methods of emitting such counter waves from a single counter unit for the harmful waves irradiated by one or more base units, various methods of emitting such counter waves by two or more counter units for the harmful waves irradiated by a single or multiple base units, and the like. In addition, the present invention relates to various methods of minimizing irradiation of such harmful waves by incorporating such electric shields, by incorporating the magnetic shields, by incorporating one or both of such shields in conjunction with the above counter units, and the like.

The present invention further relates to various processes for providing electromagnetically-countered transformer systems each of which includes at least one wave source with various base units irradiating the harmful waves and includes at least one counter unit emitting the counter waves capable of countering such harmful waves. More particularly, the present invention relates to various processes for providing the counter units to emit the counter waves defining the wavefronts similar to (or different from) the configurations of the counter units, various processes for providing the counter units as such analogs for at least one of the base units, various processes for providing the counter units emitting the counter waves defining the similar or opposite phase angles, various processes for providing the counter units emitting the counter waves defining the wavefronts shaped similar to the harmful waves, various processes for disposing the counter units based upon a preset arrangement and emitting therefrom the counter waves defining the wavefronts similar to the arrangement, and the like. The present invention relates to various processes for assigning a single counter unit to counter the harmful waves from a single base unit for local countering or to counter such waves by multiple base units for global countering, various processes for assigning multiple counter units to counter the harmful waves from a single base unit for the global countering, and to counter such harmful waves from multiple base units for the local or global countering depending upon numbers of the counter and base units, and the like. The present invention further relates to various processes for incorporating the electric and/or magnetic shields for minimizing the irradiation of such harmful waves, and various processes for minimizing the irradiation of such harmful waves by employing such shields as well as the above counter units.

Accordingly, a primary objective of the present invention is to provide an electromagnetically-countered transformer system (to be abbreviated as an "EMC transformer system," an "EMC system" or simply a "system" hereinafter) which is capable of minimizing the irradiation of the harmful waves from various base units of at least one wave source through countering the harmful waves with the counter waves. Therefore, a related objective of this invention is to provide an EMC system capable of countering the harmful waves by canceling at least a portion of the harmful waves by the counter waves and/or by suppressing the harmful waves from propagating toward a preset direction by the counter waves. Another related objective of this invention is to counter the harmful waves by such counter waves not all around the base unit of the EMC system but only in the target space (or area) defined on only one side of the system. In general, the target space is defined between at least one of the base units and a specific body part of an user of the system. Another related objective of this invention is to arrange the counter units to emit the counter waves defining the phase angles at least partially opposite to those of the harmful waves so that such counter waves cancel and/or suppress the harmful waves when propagated to the target space. Another related objective of this invention is to arrange the counter unit to emit such counter waves defining the phase angles at least partially similar to those of the harmful waves so that the counter waves cancel and/or suppress the harmful waves when propagated to the target space from an opposite side of at least one of such base units. Another related objective of this invention is to emit the counter waves from the same or opposite side of at least one of such base units with respect to the target space while controlling their phase angles so that the counter waves from different counter units counter the harmful waves in the target space.

Another objective of the present invention is to provide such an EMC system with at least one counter unit capable of emitting such counter waves. Therefore, a related objective of this invention is to match at least one feature or configuration (e.g., each meaning a shape, a size, an arrangement, and the like) of the counter unit with the feature or configuration of at least one of the base units such that the counter waves emitted by the counter unit match the harmful waves irradiated by at least one of the base units. Another related objective of this invention is to match the shape of a single counter unit with a shape of a single base unit such that the counter waves emitted by the counter unit match the harmful waves by the base unit. Another related objective of this invention is to match the shape of a single counter unit with an arrangement of multiple base units in such a manner that such counter waves emitted by the counter unit match a sum of the harmful waves irradiated by multiple base units. Another related objective of this invention is to dispose multiple counter units in an arrangement which matches a shape of a single base unit so that a sum of the counter waves emitted by multiple counter units match the harmful waves by the single base unit. Another related objective of this invention is to arrange multiple counter units in an arrangement which matches another arrangement of multiple base units such that a sum of the counter waves emitted by multiple counter units match another sum of the harmful waves which are irradiated by multiple base units. Another related objective of this invention is to provide the counter units using a least amount of electrically conductive, semiconductive, and/or insulative materials, while minimizing a total volume or size of the counter units, while minimizing a total mass of the counter units, and so on. Another related objective of this invention is to emit the counter waves by the counter units while spending a least amount of electrical energy, while drawing a least amount of electric current or voltage from the base unit or other parts of the EMC system, and the like.

Another objective of the present invention is to provide an EMC system which includes therein at least one counter unit matching the shape of at least one of such base units. Accordingly, a related objective of this invention is to provide the counter unit as an one-, two- or three-dimensional analog of at least one three-dimensional base unit and to counter one or more of such base units with one or more of such analogs. Another related objective of this invention is to provide the counter unit as an one- or two-dimensional analog of at least one three-dimensional base unit and to counter one or more base units with one or more of the analogs. Another related objective of this invention is to form such a counter unit as an one- or two-dimensional analog of at least one two-dimensional base unit and to counter one or more base units with one or more analogs. Another related objective of this invention is to form the counter unit as an one-dimensional analog of at least one two-dimensional base unit and to counter one or more base units by one or more analogs. Another related objective of this invention is to form the counter unit as an one-dimensional analog of at least one one-dimensional base unit and to counter one or more base units by one or more analogs. Another related objective of this invention is to form multiple counter units as one-, two-, and/or three-dimensional analogs of at least one one-, two-, and/or three-dimensional base units and then to counter such base units of the same or mixed dimensions by the counter units of the same or mixed dimensions. In all of the above objectives, such counter units emit the counter waves capable of matching the harmful waves from at least one of the base units. Another related objective of this invention is to conform the counter unit to a shape of at least one of the base units for matching the harmful waves with the counter waves. Another related objective of this invention is to form the counter unit which does not conform to the shape of the base unit but which is disposed in an arrangement for matching the harmful waves by such counter waves emitted thereby. Another related objective of this invention is to fabricate the counter unit in a shape of one or multiple wires, strips, sheets, tubes, coils, spirals, meshes, mixtures thereof, combinations thereof, and/or arrays thereof so as to match the shape of at least one of the base units and then to emit the counter waves matching the harmful waves. Another related objective of this invention is to dispose any of the above counter units within a preset distance from the base unit in order to match at least some wavefronts of the counter waves to at least some wavefronts of the harmful waves. Another related objective of this invention is to dispose any of such counter units based on a preset arrangement with respect to at least one of the base units in order to match at least some wavefronts of the counter waves with at least some wavefronts of the harmful waves.

Another objective of the present invention is to provide an EMC system which includes at least one counter unit with a size operatively matching a size of at least one of the base units and matching the harmful waves irradiated by at least one of the base units with the counter waves emitted by the counter unit. Therefore, a related objective of this invention is to form the counter unit which is larger, wider, and/or longer than at least one of the base units, where the counter unit is preferably disposed between at least one of such base units and target space (to be referred to as a "front arrangement") for such matching. Another related objective of this invention is to form the counter unit with a size, a width, and/or a length similar or identical to those of at least one of the base units, where the counter unit is preferably disposed laterally or side by side to at least one of the base units with respect to the target space (to be referred to as a "lateral arrangement") for the matching. Another related objective of this invention is to form the counter unit to be smaller, narrower, and/or shorter than at least one of the base units, where the counter unit is preferably disposed on an opposite side of the target space with respect to at least one of the base units (which will be referred to as a "rear arrangement") for the matching. Another related objective of this invention is to enclose at least a portion of the counter unit by at least one of the base units or, in the alternative, to enclose at least a portion of at least one of the base units by the counter unit (which will be referred to as a "concentric arrangement") for the matching. Another related objective of this invention is to dispose each of multiple counter units in the front, lateral, rear, and/or concentric arrangements with respect to a single base unit for the matching. Another related objective of this invention is to form a single or multiple counter units disposed in such front, lateral, rear, and/or concentric arrangement with respect to each of multiple base units for such matching. Another related objective of this invention is to define multiple counter units all of which are disposed in only one of such front, lateral, rear, and concentric arrangements with respect to at least one of such base units. Another related objective of this invention is to define multiple counter units at least two of which are disposed in different or mixed arrangements with respect to at least one of the base units for such matching.

Another objective of the present invention is to provide an EMC system which incorporates at least one counter unit in a disposition (e.g., an orientation, an alignment, and a distance) matching that of at least one of the base units. Therefore, a related objective of this invention is to orient or align the counter unit in a direction of propagation of the harmful waves, in a direction in which electric current flows in at least one of the base units, in a direction in which electric voltage is applied across at least one of the base units, in a direction of a longitudinal axis of at least one of such base units, and/or in a direction of a short axis thereof for the matching. Another related objective of this invention is to form multiple counter units all of which are oriented in one of such directions or axes, at least two of which are oriented along different directions and/or axes, and all of which are oriented in different directions and/or axes for the matching. Another related objective of this invention is to axially align the counter unit with respect to at least one of the base units (to be referred to as an "axial alignment") so that the counter waves emitted by the counter unit axially align with such harmful waves irradiated by at least one of the base units for the matching. Another related objective of this invention is to axially misalign the counter unit with at least one of the base units (to be referred to as an "off-axis alignment") but to dispose the counter unit in a preset arrangement for such matching. Another related objective of this invention is to provide multiple counter units disposed in the axial or off-axis alignment with respect to a single base unit for such matching. Another related objective of this invention is to provide a single or multiple counter units which are disposed in the axial or off-axis alignment with respect to multiple base units for such matching. Another related objective of this invention is to define multiple counter units all of which are disposed in the axial or off-axis alignment with respect to all of such base units or at least two of which are disposed in different (or mixed) alignments with respect to at least two of such base units for the matching. Another related objective of this invention is to dispose the counter unit at a preset distance from at least one of the base units such that at least some wavefronts of the counter waves match at least some wavefronts of such harmful waves from at least one of the base units for such matching. Another related objective of this invention is to dispose a single counter unit at preset distances from each (or at least two but not all) of the base units for the matching. Another related objective of this invention is to dispose multiple counter units at preset distances from a single base unit or, alternatively, at preset distances from each (or at least two but not all) of the base units for the matching.

Another objective of the present invention is to provide an EMC system which includes therein at least one counter unit for emitting the counter waves which have amplitudes matching those of the harmful waves. Therefore, a related objective of this invention is to provide the counter unit emitting the counter waves with amplitudes greater than those of the harmful waves, where this counter unit is disposed farther away from the target space compared with at least one of the base units or in the rear arrangement for such matching. Another related objective of this invention is to form the counter unit emitting the counter waves having amplitudes similar (or identical) to those of the harmful waves, where the counter unit is disposed side by side with at least one of the base units with respect to the target space or in the lateral arrangement for the matching. Another related objective of this invention is to provide the counter unit emitting the counter waves of amplitudes less than those of the harmful waves, where this counter unit is preferably disposed closer to the target space than at least one of the base units or in the front arrangement for the matching. Another related objective of this invention is to provide multiple counter units emitting the counter waves a sum of which defines the amplitudes greater than, similar to or less than those of the harmful waves irradiated by a single base unit, by all of such base units, by at least two but not all of such base units, and the like.

Another objective of the present invention is to provide such an EMC system including at least one counter unit capable of emitting the counter waves which match at least a portion of the harmful waves and, therefore, counter the harmful waves. Therefore, a related objective of this invention is to provide the counter unit for emitting such counter waves defining multiple wavefronts which match at least one of of the wavefronts of the harmful waves in the target space. Another related objective of this invention is to dispose the counter unit along at least a portion of at least one of the wavefronts of the harmful waves and to emit the counter waves matching such a portion of the wavefront of the harmful waves. Another related objective of this invention is to dispose multiple counter units along at least a portion of at least one of the wavefronts of the harmful waves and to emit the counter waves a sum of which then matches such a portion of the wavefront of the harmful waves. Another related objective of this invention is to dispose the counter unit across at least two of such wavefronts of the harmful waves but to emit the counter waves capable of matching at least a portion of at least one of the wavefronts of the harmful waves. Another related objective of this invention is to provide multiple counter units at least two of which are disposed across at least two of the wavefronts of the harmful waves but to emit the counter waves capable of matching the portion of the wavefront of the harmful waves. Another related objective of this invention is to shape and size such a counter unit in order to emit the counter waves with radii of curvature which match those of at least a portion of the harmful waves. Another related objective of this invention is to dispose the counter unit in a preset position or at a preset distance from at least one of the base units in which the counter waves define the radii of curvature which match those of at least a portion of the harmful waves. Another related objective of this invention is to shape and size multiple counter units emitting such counter waves a sum of which define such radii of curvature matching the harmful waves irradiated by a single base unit or multiple base units. Another related objective of this invention is to provide the counter unit in a shape of one or multiple wires, strips, sheets, tubes, coils, spirals, meshes, mixtures thereof, combinations thereof, and/or arrays thereof and to emit the counter waves capable of matching at least a portion of at least one wavefront of the harmful waves from the base unit. Another related objective of this invention is to fabricate the counter unit into a solid shape without forming any openings or holes thereacross for the matching. Another related objective of this invention is to fabricate the counter units as the arrays defining multiple holes or openings thereacross for such matching.

Another objective of the present invention is to provide an EMC system which includes therein at least one counter unit for emitting the counter waves and for locally countering the harmful waves irradiated from at least one of the base units. Therefore, a related objective of this invention is to form a single counter unit for locally countering the harmful waves from a single base unit by such counter waves emitted thereby. Another related objective of this invention is to provide multiple counter units each of which locally counters the harmful waves irradiated by only one of the same (or less number) of base units by such counter waves emitted by each counter unit. Another related objective of this invention is to provide a single or multiple counter units having the feature (or configuration) similar (or identical) to that of a single or multiple base units for such local countering. Another related objective of this invention is to provide a single or multiple counter units emitting the counter waves defining the wavefronts matching at least one of the wavefronts of the harmful waves irradiated from a single or multiple base units for such local countering. Another related objective of this invention is to provide multiple counter units at least one of which defines the feature (or configuration) similar (or identical) to that of at least one of the base units and at least another of which has the wavefronts matching at least one of the wavefronts of the harmful waves irradiated by at least one of the base units for such local countering.

Another objective of the present invention is to provide an EMC system which includes therein at least one counter unit for emitting the counter waves and for globally countering the harmful waves irradiated from at least one of the base units. Therefore, a related objective of this invention is to form one or multiple counter units each emitting the counter waves for globally matching the harmful waves irradiated from a single or a less number of base units. Another related objective of this invention is to provide a single counter unit to globally counter a sum of such harmful waves from multiple base units by the counter waves emitted thereby. Another related objective of this invention is to provide multiple counter units each of which globally counters the harmful waves irradiated by at least two base units by the counter waves emitted by each of the counter units. Another related objective of this invention is to define a single or multiple counter units defining the feature (or configuration) which is similar (or identical) to those of at least two or a greater number of base units for the global countering. Another related objective of this invention is to provide a single or multiple counter units emitting such counter waves with the wavefronts matching at least one of the wavefronts of the harmful waves irradiated by at least two or a greater number of base units for the global countering. Another related objective of this invention is to provide multiple counter units at least one of which defines the configuration (or feature) similar (or identical) to those of at least two base units and at least another of which defines the wavefronts matching at least one wavefront of such harmful waves irradiated by at least two of other base units for such local countering.

Another objective of the present invention is to provide an EMC system which includes therein at least one counter unit disposed in a preset position or location defined with respect to at least one of the base units and/or target space. Therefore, a related objective of this invention is to dispose the counter unit on (or over) an exterior surface of at least one of such base units, to dispose the counter unit on (or below) an interior surface of at least one of such base units, to embed at least a portion of the counter unit inside at least one of the base units, and to dispose the counter unit between at least two of such base units. Another related objective of this invention is to provide such a system with a case member and to dispose the counter unit on (or over) an exterior surface of the case member, to dispose such a counter unit on (or below) an interior surface of the case member, to embed at least a portion of the counter unit inside the case member, and to dispose the counter unit between the case member and at least one of the base units. Another related objective of this invention is to dispose the counter unit in a preset relation to the case member such as, e.g., exposing at least a portion or entire portion of the counter unit through the case member, enclosing the entire portion of the counter unit in the case member, and the like.

Another objective of the present invention is to provide an EMC system which includes therein at least one counter unit emitting the counter waves propagating along preset directions. Therefore, a related objective of this invention is to arrange the counter unit to emit the counter waves always in a fixed direction with respect to at least one of the base units such that the counter waves propagate in a direction defined in a preset relation to a direction of propagation of the harmful waves, e.g., parallel to the direction of such harmful waves, perpendicular thereto, at a preset angle thereto, and the like. Another related objective of this invention is to arrange the counter unit to emit such counter waves in variable directions with respect to a direction of propagation of the harmful waves, where the counter unit is arranged to change its arrangement or orientation and to receive the electric energy in variable directions for changing the direction of the counter waves. Another related objective of this invention is to arrange the counter unit to emit the counter waves in a direction which is adaptively determined by variable directions of propagation of the harmful waves, where the counter unit may change such a direction of the counter waves as described above. Therefore, such a counter unit may change an extent of the countering based on its arrangement and/or orientation. Another related objective of this invention is to synchronize a direction of propagation of such counter waves with that of the harmful waves in the preset relation disclosed above. Another related objective of this invention is to arrange the counter unit to manipulate amplitudes of the counter waves in various mechanisms similar to those for manipulating the directions thereof.

Another objective of the present invention is to provide an EMC system with at least one of the above counter units and to supply the electric current or voltage thereto for countering such harmful waves by such counter waves emitted thereby. Accordingly, a related objective of this invention is to provide the counter unit with the electric current or voltage which is supplied to the above base unit or at least one of multiple base units. Another related objective of this invention is to provide the counter unit with at least a portion but not an entire portion of the electric current or voltage supplied to such a base unit or at least one of multiple base units. Another related objective of this invention is to provide the counter unit with such a portion of the current or voltage of which the amplitudes and/or direction are modified before being supplied thereto. In all of these examples, the current or voltage supplied to the counter unit is automatically synchronized with such current or voltage supplied to the base unit or at least one of multiple base units. Another related objective of this invention is to supply the counter unit with electric current or voltage which is not the current or voltage supplied to the base unit or at least one of multiple base units but which is at least partially synchronized with the current or voltage supplied to such base units. Another related objective of this invention is to manipulate the amplitudes or directions of the current or voltage depending upon configuration and/or disposition of the counter unit. Another related objective of this invention is to electrically couple the counter unit with the base unit in a parallel, series or hybrid mode. Another related objective of this invention is to supply such electric current or voltage based upon various sequences such as, e.g., first to the base unit and then to the counter unit, first to the counter unit then to the counter unit, first to one of multiple counter units and then to the rest of the counter units or base unit, first to one of multiple base units and then to the rest of the base units or counter unit, simultaneously to the counter and base units, and the like.

It is to be understood in all of such objectives that the counter units are preferably arranged to not adversely affect intended operations of the EMC transformer systems. For example, such counter units of the EMC transformer systems may preferably counter the harmful waves irradiated their base units of primary and secondary windings but may not adversely affect magnetic coupling between the windings. In another example, the counter units of the systems may effectively counter such harmful waves but may not adversely affect amplitude of magnetomotive force generated by the base units of such windings. It is appreciated in all of the objectives that the counter units are preferably arranged to emit the counter waves defining the phase angles at least partially opposite to those of the harmful waves for such countering but that the counter units may emit the counter waves defining the phase angles at least partially similar to those of such harmful waves when disposed on an opposite side of at least one of such base units with respect to the target space or when the system includes multiple counter units and it is also desirable to modify the radii of curvature of the wavefronts of the counter waves. It is appreciated that the electric and/or magnetic shields of the co-pending Applications may be incorporated into any of the EMC transformer systems described hereinabove and to be described hereinafter either alone or in combination with such counter units for maximally countering the harmful waves.

The basic principle of the counter units of the generic electromagnetically-countered systems of this invention is to emit the counter waves which form the wavefronts similar (or identical) to those of the harmful waves but define the phase angles at least partially opposite to those of such harmful waves. Therefore, by propagating such counter waves to the target space, the counter waves can effectively counter the harmful waves in the target space by, e.g., canceling at least a portion of such harmful waves therein and/or suppressing the harmful waves from propagating theretoward. To this end, the counter units are arranged to emit the counter waves which define the wavefronts matching those of the harmful waves by various mechanisms. In one example, such counter units are shaped similar (or identical) to at least one of such base units, or arranged similar (or identical) to at least one of the base units and, therefore, emit the counter waves which are capable of countering the harmful waves in the target space. In another example, such counter units are disposed along one or more of the wavefronts of the harmful waves and emit such counter waves which are similar (or identical) to the harmful waves and, accordingly, counter the harmful waves in such a target space. In these two examples, the counter units are to emit the counter waves with the wavefronts which are similar (or identical) to the shapes of such counter units themselves, and such counter waves are to define the phase angles which are then at least partially opposite to the phase angles of the harmful waves. In another example, the counter units are shaped differently from the base units, but are rather disposed in an arrangement in which the counter waves emitted therefrom may match the harmful waves in the target space. In another example, the counter units are disposed across different wavefronts of the harmful waves but are to emit the counter waves which are similar (or identical) to the harmful waves and, therefore, counter the harmful waves in the target space. In the last two examples, the counter units may be arranged to emit the counter waves of the wavefronts which may or may not be similar (or identical) to the shapes of the counter units themselves, while the counter waves are to define the phase angles which are at least partially opposite to those of the harmful waves.

The basic principle of various counter units of this invention may be incorporated into the prior art devices for minimizing irradiation of the harmful waves therefrom. For example, such counter units may be implemented into any base units of electrically conductive wires, coils, and/or sheets or, in the alternative, into any electrically semiconductive and/or insulative wires, coils, and/or sheets in order to minimize the irradiation of the harmful waves by countering the harmful waves by the counter waves, e.g., by canceling at least a portion of the harmful waves in the target space and/or suppressing such harmful waves from propagating toward the target space, where such counter units may be made of and/or include at least one electrically conductive, insulative or semiconductive material. The counter units may be implemented into any of the base units of the shapes which may be formed by including one or more wires, coils, and/or sheets and/or by modifying the shapes of one or multiple wires, coils, and/or sheets, where a few examples of the modified shapes may include a solenoid and toroid each formed by modifying the shape of such a coil. Therefore and in one example, such counter units may be implemented into various transformers including therein at least two coils, and any prior art devices including any of the counter units may then be converted into the EMC transformers systems such as, e.g., EMC step-up or step-down transformers, EMC isolating transformers, EMC variable transformers, EMC autotransformers, EMC polyphase transformers, EMC resonant transformers, EMC current and/or voltage transformers, EMC pulse transformers, EMC RF transformers, and the like, where any of such transformers may be used a stand-alone transformer unit or as an AC/DC adaptor for various electric or electronic devices.

Various counter units of such EMC transformer systems of this invention may be incorporated into any electrical and electronic devices each of which includes at least one base unit and, therefore, irradiate the harmful waves which include electric waves (to be abbreviated as "EWs") and magnetic waves (to be abbreviated as "MWs") having frequencies of about 50 to 60 Hz and/or other EWs and MWs of higher frequencies. Such counter units of the EMC transformer systems of this invention may further be incorporated into any portable or stationary electric and electronic devices with at least one base unit detailed examples of which have been provided heretofore and will be provided hereinafter. It is also appreciated that such counter units may be provided in a micron-scale and incorporated into semiconductor chips and circuits such as LSI and VLSI devices and that such counter units may also be provided in a nano-scale and incorporated into various nano-scale devices with at least one base unit which in this case may be a single molecule, a single compound or a cluster of multiple molecules or compounds.

Various system, method, and/or process aspects of such counter units and EMC transformer systems and various embodiments thereof are now enumerated. It is to be understood, however, that following system, method, and/or process aspects of the present invention may be embodied in many other different forms and, accordingly, should not be limited to such aspects and/or their embodiments which are to be set forth herein. Rather, various exemplary aspects and their embodiments described hereinafter are provided such that this disclosure will be thorough and complete, and fully convey the scope of the present invention to one of ordinary skill in the relevant art.

In one aspect of the present invention, an EMC transformer system is provided for countering harmful electromagnetic waves irradiated by multiple base units of at least one wave source through suppressing the harmful waves from propagating toward a target space and/or canceling the harmful waves in the target space, where such base units are arranged to include only portions of the wave source which are responsible for irradiating the harmful waves and/or affecting paths of the harmful waves therethrough and where the target space is defined between the system and an user.

In one exemplary embodiment of this aspect of the invention, such an EMC transformer system may include at least one transformer core, a primary coil, at least one secondary coil, and at least one counter unit. Such a core is arranged to have multiple sides (to be referred to hereinafter as the "first core" hereinafter). The primary coil is arranged to be disposed about one of the sides of the core, to be electrically insulated from the core, to receive electrical energy, and then to generate magnetic flux along the core in a preset direction determined by the energy while serving as one of such base units and also irradiating such harmful waves (to be referred to as the "first primary coil" hereinafter). The secondary coil is arranged to be disposed about another of the sides of such a core, to be electrically insulated from the core, and to induce electrical energy due to the magnetic flux from the primary coil while serving as another of the base units and irradiating the harmful waves (to be referred to as the "first secondary coil" hereinafter). Such a counter unit is arranged to define a configuration similar (or identical) to a configuration of at least one of the base units and then to emit counter electromagnetic waves. Therefore, the counter waves are arranged to define phase angles at least partially opposite to those of the harmful waves, to also define wave characteristics at least partially similar to those of the harmful waves due to the configuration and, therefore, to counter the harmful waves in the target space due to the phase angles, where such counter waves are to be referred to as the "first counter waves" hereinafter.

In another exemplary embodiment of this aspect of the invention, an EMC transformer system may include at least one first core, the first primary coil, at least one first secondary coil, and a single counter unit which is arranged to define a configuration of an 1-D (or 2-D, 3-D) analog of at least one of the base units and, therefore, to emit the first counter waves. Alternatively, a single counter unit is arranged to have a configuration of an 1-D (or 2-D, 3-D) analog of at least two of the base units and, therefore, to emit the first counter waves.

In another exemplary embodiment of this aspect of the invention, an EMC transformer system may include at least one first core, the first primary coil, at least one first secondary coil, and multiple counter units at least two of which are arranged to define a configuration of 1-D (or 2-D, 3-D) analog of at least one of the base units and, therefore, to emit the first counter waves. Alternatively, at least two of such multiple counter units are arranged to define configurations of 1-D (or 2-D, 3-D) analogs of at least two of the base units and, therefore, to emit the first counter waves.

In another aspect of the present invention, another EMC transformer system may be provided for countering harmful electromagnetic waves irradiated from multiple base units of at least one wave source by matching an arrangement and/or a shape of at least one of such base units with a shape and/or an arrangement of at least one part of the system and by suppressing the harmful waves from propagating toward a target space and/or canceling such harmful waves in the target space, where the base units are arranged to include only portions of the wave source responsible for irradiating the harmful waves and/or affecting paths of the waves therethrough and where the target space countered is also defined between the system and an user.

In one exemplary embodiment of this aspect of the invention, an EMC transformer system may include at least one first core, the first primary coil, at least one first secondary coil, and at least one counter unit which is arranged to have a shape similar (or identical, conforming) to a shape of at least one of the base units and to emit counter electromagnetic waves. Whereby such counter waves are arranged to define phase angles at least partially opposite to those of the harmful waves, to also have wave characteristics at least partially similar to those of the harmful waves due to such a shape and, therefore, to counter the harmful waves in the target space due to the phase angles. These counter waves are to be referred to as the "second counter waves" hereinafter.

In another exemplary embodiment of this aspect of the invention, an EMC transformer system includes at least one first core, the first primary coil, at least one first secondary coil, and at least one counter unit which is arranged to define a shape different from (or not conforming to) that of at least one of the base units, to be in a preset arrangement with respect to at least one of the base units, and to emit counter electromagnetic waves. Whereby such counter waves are arranged to define phase angles at least partially opposite to those of the harmful waves, to have wave characteristics at least partially similar to those of the harmful waves due to the arrangement and, accordingly, to counter the harmful waves in the target space due to the phase angles. Such counter waves are to be referred to as the "third counter waves" hereinafter.

In another exemplary embodiment of this aspect of the invention, an EMC transformer system includes at least one first core, the first primary coil, at least one first secondary coil, and at least one counter unit which is arranged to define a shape of an 1-D analog of at least one of the 1-D (or 2-D, 3-D) base units and, therefore, to emit the second counter waves. In the alternative, the counter unit is arranged to define a shape of at least one 1-D analog of at least two of such 1-D (or 2-D, 3-D) base units and, therefore, to emit the second counter waves. Alternatively, the counter unit is arranged to define a shape of a 2-D analog of one of the 1-D (or 2-D, 3-D) base units and, accordingly, to emit the second counter waves. Alternatively, the counter unit is arranged to define a shape of at least one 2-D analog of at least two of the 1-D (or 2-D, 3-D) base units and, therefore, to emit the second counter waves. Alternatively, the counter unit is arranged to define a shape of a 3-D analog of one of the 1-D (or 2-D, 3-D) base units and, therefore, to emit the second counter waves. Alternatively, the counter unit is arranged to define a shape of at least one 3-D analog of at least two of such 1-D (or 2-D, 3-D) base units and, therefore, to emit the second counter waves.

In another exemplary embodiment of this aspect of the invention, an EMC transformer system includes at least one first core, the first primary coil, at least one first secondary coil, and at least one counter unit which is arranged to have a shape matching a shape of one of the base units and, thus, to emit the second counter waves. Alternatively, the counter unit is arranged to define a shape which matches shapes of at least two of the base units and, therefore, to emit the second counter waves. Alternatively, the system includes multiple counter units which are arranged to form an overall shape matching a shape of one of the base units and, therefore, to emit such second counter waves. In the alternative, the system includes multiple counter units which are arranged to define an overall shape matching an overall shape of at least two of the base units and, therefore, to emit the second counter waves.

In another exemplary embodiment of this aspect of the invention, an EMC transformer system includes at least one first core, the first primary coil, at least one first secondary coil, and at least one counter unit. In one example, the counter unit is arranged to be disposed between the target space and at least two of the base units, to define a dimension longer than dimensions of the base units (or than a dimension of an arrangement of such base units), and to emit the counter waves. In another example, the counter unit is arranged to be disposed on an opposite side of such a target space with respect to at least one of the base units, to have a dimension shorter than a dimension of at least one of the base units (or than a dimension of an arrangement of such base units), and to emit the counter waves. In another example, such a system includes multiple counter units which are arranged to be disposed between at least two of the base units and target space, to be disposed in an arrangement defining a dimension longer than dimensions of the base units (or than a dimension of an arrangement of the base units), and to emit such counter waves. In another example, the system includes multiple counter units which are arranged to be disposed on an opposite side of the target space with respect to the base units, to be disposed in an arrangement having a dimension shorter than dimensions of the base units (or than a dimension of an arrangement of the base units), and to emit the counter waves. Whereby such counter waves in each example are arranged to define phase angles at least partially opposite to those of the harmful waves, to have wave characteristics at least partially similar to those of such harmful waves due to such a dimension and, therefore, to counter such harmful waves in the target space due to the opposite phase angles.

In another exemplary embodiment of this aspect of the invention, an EMC transformer system includes at least one first core, the first primary coil, at least one first secondary coil, and at least one counter unit which is arranged to define a shape of a wire, a strip, a sheet, a tube, a coil, a spiral, a mesh, a mixture thereof, a combination thereof, and/or an array thereof while conforming the shape to those of the base units and, therefore, to emit such second counter waves. Alternatively, the counter unit is arranged to define a shape of a wire, a strip, a sheet, a tube, a coil, a spiral, a mesh, a mixture thereof, a combination thereof, and/or an array thereof while at least partially conforming the shape to that of an arrangement of the base units and, therefore, to emit the second counter waves.

In another exemplary embodiment of this aspect of the invention, an EMC transformer system includes at least one first core, the first primary coil, at least one first secondary coil, and at least one counter unit which is arranged to be disposed in an arrangement which is similar to (or different from) an arrangement of the base units and, therefore, to emit the third counter waves.

In another exemplary embodiment of this aspect of the invention, an EMC transformer system includes at least one first core, the first primary coil, at least one first secondary coil, and at least one counter unit. In one example, the counter unit is arranged to be disposed between the target space and at least two of the base units, to define a size which is larger than a size of each of at least two of the base units, and to emit the counter waves. In another example, the counter unit is arranged to be disposed on an opposite side of the target space with respect to such base units, to define a size which is smaller than a size of each of at least two of the base units, and to emit the counter waves. Whereby, such counter waves in each example are arranged to define phase angles at least partially opposite to those of the harmful waves, to have wave characteristics at least partially similar to those of the harmful waves due to such a size and, accordingly, to counter the harmful waves in the target space due to the phase angles.

In another aspect of the present invention, another EMC transformer system may be provided for countering harmful electromagnetic waves irradiated from multiple base units of at least one wave source by matching a disposition of at least one of such base units with a disposition of at least one part of the system and by suppressing the harmful waves from propagating toward a target space and/or canceling the harmful waves in the target space, where the base units are arranged to include only portions of the wave source responsible for irradiating the harmful waves and/or affecting paths of such harmful waves therethrough and where the target space is defined between the system and an user.

In one exemplary embodiment of this aspect of the invention, an EMC transformer system may include at least one first core, the first primary coil, at least one first secondary coil, and at least one counter unit which is arranged to be disposed in an alignment matching a direction of propagation of the harmful waves, a direction of electric current flowing in at least one of the base units, a direction of electric voltage applied across at least one of the base units, a direction along a longitudinal axis of at least one of the base units, and/or a direction of a short axis thereof normal to the longitudinal axis, and to emit counter electromagnetic waves. Whereby the counter waves are also arranged to define phase angles at least partially opposite to those of the harmful waves, to have wave characteristics at least partially similar to those of the harmful waves due the alignment and, therefore, to counter the harmful waves in the target space due to the phase angles.

In another exemplary embodiment of this aspect of the invention, an EMC transformer system includes at least one first core, the first primary coil, at least one first secondary coil, and at least one counter unit. In one example, such a counter unit is arranged to be disposed in a position between the target space and at least one of the base units and to emit the counter waves defining amplitudes less than those of the harmful waves. In another example, the counter unit is arranged to be disposed in a position on an opposite side of the target space with respect to at least one of such base units and to emit the counter waves defining amplitudes greater than those of the harmful waves. Whereby, such counter waves in each example are arranged to have phase angles at least partially opposite to those of the harmful waves, to define wave characteristics at least partially similar to those of the harmful waves due to the position and, therefore, to counter the harmful waves in the target space due to the phase angles.

In another exemplary embodiment of this aspect of the invention, an EMC transformer system includes at least one first core, the first primary coil, at least one first secondary coil, and at least one counter unit. In one example, such a counter unit is arranged to be in a disposition enclosing therein at least a portion or an entire portion of at least one of the base units and to emit the counter waves. In another example, the counter unit is arranged to be in a disposition enclosed by at least a portion or an entire portion of at least one of the base units and to emit the counter waves. In another example, the counter unit is arranged to be in a disposition lateral (or side by side) to at least one of the base units and to emit the counter waves. Whereby, the counter waves of each example are arranged to define phase angles at least partially opposite to those of the harmful waves, to have wave characteristics at least partially similar to those of the harmful waves due the disposition and, accordingly, to counter the harmful waves in the target space due to the phase angles.

In another exemplary embodiment of this aspect of the invention, an EMC transformer system includes at least one first core, the first primary coil, at least one first secondary coil, and at least one counter unit which is arranged to be in a disposition symmetric (or asymmetric) to at least a portion of at least one of such base units and to also emit the counter waves. Whereby, the counter waves are arranged to define phase angles which are at least partially opposite to those of such harmful waves, to have wave characteristics which are at least partially similar to those of the harmful waves due the disposition and, thus, to counter the harmful waves in the target space due to the phase angles.

In another exemplary embodiment of this aspect of the invention, an EMC transformer system includes at least one first core, the first primary coil, at least one first secondary coil, and at least one counter unit which is arranged to be in a stationary disposition with respect to at least one of the base units and then to emit the counter waves. Whereby, the counter waves are arranged to define phase angles at least partially opposite to those of the harmful waves, to define wave characteristics which are at least partially similar to those of the harmful waves while keeping the disposition and, therefore, to counter the harmful waves in the target space due to the phase angles.

In another exemplary embodiment of this aspect of the invention, an EMC transformer system includes at least one first core, the first primary coil, at least one first secondary coil, and at least one counter unit which is arranged to be in a mobile disposition with respect to at least one of such base units and then to emit counter electromagnetic waves.

Whereby, the counter waves are arranged to define phase angles at least partially opposite to the harmful waves, to have wave characteristics at least partially similar to those of the harmful waves while moving with respect to at least one of such base unit sand, therefore, to counter the harmful waves in the target space due to the phase angles.

In another aspect of the present invention, another EMC transformer system may be provided for countering harmful electromagnetic waves irradiated from multiple base units of at least one wave source with counter electromagnetic waves by matching the harmful waves with the counter waves along at least one wavefronts thereof and by suppressing the harmful waves by the counter waves from propagating to a target space and/or canceling the harmful waves with the counter waves in the target space, where the base units are arranged to include only portions of the wave source which are responsible for irradiating the harmful waves and/or for affecting propagation paths of the harmful waves therethrough and where the target space is formed between the system and an user.

In one exemplary embodiment of this aspect of the invention, an EMC transformer system may include at least one first core, the first primary coil, at least one first secondary coil, and at least one counter unit which is arranged to be disposed based upon a preset arrangement along at least one of the wavefronts and to emit the counter waves. Whereby, the counter waves are arranged to define phase angles at least partially opposite to those of such harmful waves, to at least partially match the wavefronts of the harmful waves due to such an arrangement, and to counter the harmful waves in the target space due to the phase angles in the target space, where such waves are to be referred to as the "fourth counter waves" hereinafter.

In another exemplary embodiment of this aspect of the invention, an EMC transformer system has at least one first core, the first primary coil, at least one first secondary coil, and a single counter unit which is arranged to be disposed in a front arrangement and along at least one of the wavefronts and, therefore, to emit the fourth counter waves of amplitudes less than those of the harmful waves, where the counter unit is disposed between the target space and at least two of such base units in the front arrangement. In the alternative, the system includes multiple counter units each of which is arranged to be disposed in a front arrangement and along at least one of the wavefronts and to emit the fourth counter waves with amplitudes less than those of the harmful waves, where the counter units are similarly disposed between the target space and at least two of such base units in the front arrangement.

In another exemplary embodiment of this aspect of the invention, an EMC transformer system has at least one first core, the first primary coil, at least one first secondary coil, and a single counter unit which is arranged to be disposed in a rear arrangement and, therefore, to emit the fourth counter waves of amplitudes greater than those of the harmful waves, where the counter unit is disposed on an opposite side of the target space relative to at least one of the base units in the rear arrangement. Alternatively, the system includes multiple counter units each of which is arranged to be disposed in a rear arrangement and to emit the fourth counter waves defining amplitudes greater than those of the harmful waves, where such counter units are disposed on an opposite side of the target space with respect to the base units in the rear arrangement.

In another aspect of the present invention, another EMC transformer system may be provided for countering harmful electromagnetic waves irradiated from multiple base units of at least one wave source with counter electromagnetic waves by matching the harmful waves with the counter waves along at least one wavefronts of the harmful waves and by suppressing the harmful waves with the counter waves from propagating toward a target space and canceling such harmful waves with the counter waves in the target space, where the base units are arranged to include only portions of the wave source which are responsible for irradiating the harmful waves and/or affecting paths of such harmful waves therethrough and where the target space is defined between the system and an user.

In one exemplary embodiment of this aspect of the invention, an EMC transformer system may have at least one first core, the first primary coil, at least one first secondary coil, and a single counter unit which is arranged to be disposed closer to the target space than at least one of the base units, to be aligned along only one (or at least two) of the wavefronts and, therefore, to emit the fourth counter waves. Alternatively, the single counter unit is arranged to be disposed farther away from the target space than at least one of the base units, to be disposed in an arrangement inverse to only one (or at least two) of the wavefronts and, therefore, to emit the fourth counter waves. In the alternative, the system includes multiple counter units at least two of which are arranged to be disposed closer to the target space than the base units, to be arranged along only one (or at least two) of such wavefronts and, therefore, to emit the fourth counter waves. In another example, such a system includes multiple counter units at least two of which are arranged to be disposed farther away from the target space than at least one of such base units, to be disposed in an arrangement inverse to only one (or at least two) of the wavefronts and, therefore, to emit the fourth counter waves.

In another exemplary embodiment of this aspect of the invention, an EMC transformer system has at least one first core, the first primary coil, at least one first secondary coil, and a single counter unit which is arranged to define a dimension larger (or smaller) than that of at least one of such base units, to be disposed between the target space and at least one of the base units in an arrangement which matches only one (or at least two) of the wavefronts and, therefore, to emit the fourth counter waves. In another example, the system may include multiple counter units at least two of which are arranged to define dimensions larger (or smaller) than a dimension of at least one of the base units, to be disposed between at least one of the base units and the target space in an arrangement matching only one (or at least two) of the wavefronts and, therefore, to emit the fourth counter waves.

In another exemplary embodiment of this aspect of the invention, an EMC transformer system has at least one first core, the first primary coil, at least one first secondary coil, and a single counter unit which is arranged to be incorporated between at least two of the base units and target space in an arrangement similar (or identical, conforming) to only one (or at least two) of the wavefronts and, therefore, to emit the fourth counter waves. In the alternative, a single counter unit is arranged to be incorporated on an opposite side of the target space with respect to at least one of the base units in an arrangement similar (or identical, conforming) to only one (or at least two) of the wavefronts and, therefore, to emit the fourth counter waves. Alternatively, the system includes multiple counter units at least two of which are arranged to be disposed between the target space and at least two of the base units in an arrangement which is similar (or identical, conforming) to only one (or at least two) of the wavefronts and, therefore, to emit such fourth counter waves. Alternatively, the system includes multiple counter units at least two of which are arranged to be disposed on an opposite side of such a target space relative to at least one of such base units in an arrangement which is similar (or identical, conforming) to only one (or at least two) of the wavefronts and, therefore, to emit the fourth counter waves.

In another exemplary embodiment of this aspect of the invention, an EMC transformer system includes at least one first core, the first primary coil, at least one first secondary coil, and at least one counter unit. In one example, such a unit is arranged to have a shape similar (or identical, conforming) to that of at least one of the wavefronts, to be disposed between the target space and at least two of the base units in an arrangement which is not similar (or not identical, not conforming) to at least one of the wavefronts and, therefore, emit the fourth counter waves. In another example, the counter unit is arranged to have a shape similar (or identical, conforming) to that of at least one of the wavefronts, to be disposed on an opposite side of the target space with respect to at least two of such base units in an arrangement not similar (or not identical, not conforming) to at least one of the wavefronts and, therefore, to emit the fourth counter waves. In the alternative, the counter unit is arranged to define a shape which is not similar (or not identical, not conforming) to that of at least one of such wavefronts, to be disposed between the target space and at least two of the base units in an arrangement which is not similar (or not identical, not conforming) to at least one of the wavefronts and, therefore, to emit the fourth counter waves. In another example, the counter unit is arranged to have a shape which is not similar (or not identical, not conforming) to that of at least one of such wavefronts, to be disposed on an opposite side of the target space relative to at least two of the base units in an arrangement not similar (or not identical, not conforming) to at least one of the wavefronts and, therefore, to emit such fourth counter waves.

In another exemplary embodiment of this aspect of the invention, an EMC transformer system includes at least one first core, the first primary coil, at least one first secondary coil, and at least one counter unit. In one example, the counter unit is arranged to be disposed in an arrangement enclosing only one (or at least two) of the wavefronts therein and, therefore, to emit the fourth counter waves. In another example, such a counter unit is arranged to be disposed in an arrangement enclosed by at least a portion or an entire portion of only one (or at least two) of the wavefronts and, accordingly, to emit the fourth counter waves. In another example, such a counter unit is arranged to be disposed in a lateral (or side-by-side) arrangement to at least a portion or an entire portion of only one (or at least two) of the wavefronts and, therefore, to emit the fourth counter waves.

In another exemplary embodiment of this aspect of the invention, an EMC transformer system includes at least one first core, the first primary coil, at least one first secondary coil, and at least one counter unit. In one example, such a counter unit is arranged to emit the fourth counter waves while being disposed along only one (at least two) of the wavefronts in one arrangement having a shape of a wire, a strip, a sheet, a tube, a coil, a spiral, a mesh, a mixture thereof, a combination thereof, and/or an array thereof and disposed between at least one of such base units and target space. In another example, the counter unit is arranged to emit such fourth counter waves while being disposed along only one (at least two) of such wavefronts in one arrangement defining a shape of a wire, a strip, a sheet, a tube, a coil, a spiral, a mesh, a mixture thereof, a combination thereof, and/or an array thereof and disposed on an opposite side of the target space with respect to at least one of the base units.

In another exemplary embodiment of this aspect of the invention, an EMC transformer system includes at least one first core, the first primary coil, at least one first secondary coil, and at least two counter units each of which is arranged to disposed in an arrangement defined on a far side of such a target space with respect to at least one of the base units and, therefore, to emit the fourth counter waves such that a sum of the counter waves individually emitted by such counter units forms multiple wavefronts of greater radii of curvature than the wavefronts of the individual counter waves.

In another aspect of the present invention, another EMC transformer system may be provided for countering harmful electromagnetic waves irradiated from multiple base units of at least one wave source with counter electromagnetic waves by matching the harmful waves with the counter waves along at least one wavefronts of the harmful waves and by suppressing the harmful waves with the counter waves from propagating toward a target space and/or canceling the harmful waves with the counter waves in the target space, where the base units are arranged to include only portions of the wave source responsible for irradiating the harmful waves and/or for affecting paths of such harmful waves therethrough and where the target space is defined between the system and an user.

In one exemplary embodiment of this aspect of the invention, an EMC transformer system may include at least one first core, the first primary coil, at least one first secondary coil, and at least one counter unit. In one example, the system includes a single counter unit which is arranged to define a configuration matching that of only one of such base units and to emit the counter waves. In another example, the system instead includes multiple counter units which are arranged to be disposed in an arrangement matching a configuration of only one of such base units and to emit the counter waves. Whereby, the counter waves in each example are arranged to have phase angles which are at least partially opposite to those of such harmful waves, to at least partially match at least a portion of such harmful waves due to the configuration, and to counter the harmful waves in the target space due to the phase angles.

In another exemplary embodiment of this aspect of the invention, an EMC transformer system includes at least one first core, the first primary coil, at least one first secondary coil, and at least one counter unit. In one example, the system includes a single counter unit which is arranged to define a configuration which matches an arrangement of at least two but not all of such base units and to emit the counter waves. In another example, the system includes a single counter unit which is arranged to have a configuration which matches an arrangement of all of the base units and to emit the counter waves. In another example, the system includes multiple counter units at least two (or all) of which are arranged to be in an arrangement matching an arrangement of at least two but not all of the base units and to emit the counter waves. In another example, the system includes multiple counter units at least two (or all) of which are arranged to be in an arrangement which matches an arrangement of all of the base units and to emit the counter waves. Whereby, such counter waves of each example are arranged to define phase angles at least partially opposite to those of such harmful waves, to at least partially match at least a portion of the harmful waves due to such a configuration, and to counter the harmful waves in the target space due to the phase angles.

In another exemplary embodiment of this aspect of the invention, an EMC transformer system includes at least one first core, the first primary coil, at least one first secondary coil, and at least one counter unit. In one example, the system includes a single counter unit which is arranged to define a preset shape, to be disposed in a preset arrangement with respect to at least one of such base units, and to emit the counter waves, where the shape and/or arrangement may be arranged to match only one (or at least two) of the wavefronts. In another example, such a system includes multiple counter units at least two (or all) of which are arranged to have a preset overall shape, to be also disposed in a preset arrangement relative to at least one of the base units, and to emit the counter waves, where the shape and/or arrangement may match only one (or at least two) of the wavefronts. Whereby, the counter waves of each of such examples are arranged to define multiple wavefronts at least one of which is similar (or identical) to at least one of the wavefronts of the harmful waves due to the shape and/or arrangement, to define phase angles at least partially opposite to those of the harmful waves and, accordingly, to counter the harmful waves in the target space due to the opposite phase angles.

In another exemplary embodiment of this aspect of the invention, an EMC transformer system includes at least one first core, the first primary coil, at least one first secondary coil, and at least one counter unit. In one example, the system includes a single counter unit which is shaped, sized, and/or disposed to emit the counter waves which match only one (or at least two) of the wavefronts of the harmful waves irradiated by only one of the base units. In another example, such a system includes multiple counter units which are shaped, sized, and/or disposed to emit such counter waves a sum of which is arranged to match only one (or at least two) of the wavefronts of the harmful waves by only one of the base units. Whereby, the counter waves of each of the examples are arranged to define multiple wavefronts at least one of which is similar (or identical) to at least one of the wavefronts of the harmful waves due to a shape, a size, and/or a disposition of the counter unit(s), to define phase angles at least partially opposite to those of the harmful waves and, therefore, to counter the harmful waves in the target space due to the phase angles.

In another aspect of the present invention, another EMC transformer system may be provided for countering harmful electromagnetic waves irradiated from multiple base units of at least one wave source with counter electromagnetic waves emitted by at least one part of such a system and also by canceling the harmful waves by the counter waves in a target space and/or suppressing the harmful waves by the counter waves from propagating toward the target space, where such base units are arranged to include only portions of the wave source responsible for irradiating such harmful waves and/or affecting paths of the harmful waves therethrough, where the harmful waves are arranged to propagate while defining multiple wavefronts, and where the target space is formed between an user and the system.

In one exemplary embodiment of this aspect of the invention, an EMC transformer system may include at least one first core, the first primary coil, at least one first secondary coil, and at least one counter unit which is arranged to define a preset shape and a preset size, to be disposed in a preset arrangement along at least a portion of only one (or at least two) of such wavefronts, and to emit the counter waves. Whereby, such counter waves are arranged to have phase angles at least partially opposite to those of the harmful waves, to match only one (or at least two) of the wavefronts of the harmful waves and, accordingly, to counter such harmful waves in the target space due to the phase angles.

In another exemplary embodiment of this aspect of the invention, an EMC transformer system has at least one first core, the first primary coil, at least one first secondary coil, and multiple counter units. In one example, such counter units are arranged to be in a disposition defined between at least two of such base units and target space, to be in an arrangement conforming to at least a portion of only one (or at least two) of the wavefronts of the harmful waves, and to emit the counter waves. In another example, such counter units are arranged to be in a disposition defined on an opposite side of such a target space relative to at least one of the base units, to be in an arrangement at least partially inverse to only one (or at least two) of the wavefronts of the harmful waves, and to emit the counter waves. Whereby, a sum of the counter waves which are emitted by at least two of the counter units is arranged to have phase angles at least partially opposite to those of the harmful waves, to match at least one of the wavefronts of the harmful waves due to such an arrangement and/or disposition and, therefore, to counter the harmful waves in the target space due to the phase angles.

In another aspect of the present invention, another EMC transformer system may be provided to include multiple coils of conductive wire which irradiates harmful electromagnetic waves as electric energy flows therein and to counter the harmful waves by canceling such harmful waves in a target space and/or suppressing the harmful waves from propagating toward the target space, where such base units are arranged to include only portions of the system which are responsible for at least one of irradiating the harmful waves and affecting paths of such harmful waves therethrough and where the target space is defined between an user and system.

In one exemplary embodiment of this aspect of the invention, an EMC transformer system may include at least one insert, at least two coils, and at least one counter unit. Such an insert is arranged to include therein ferromagnetic, paramagnetic, diamagnetic, and/or ferrimagnetic materials and to also define thereon at least two sides. One of the coils is arranged to be wound around a first side of the insert in a preset direction in a preset number of turns, whereas another of the coils is arranged to be wound around a second side of the insert along another preset direction in another preset number of turns. Both coils are arranged to be spaced away from each other and to irradiate the harmful waves as the electric energy flows therein while serving as the base units. In one example, the counter unit is arranged to define a configuration identical (or similar) to that of at least one of such coils, to be in a preset disposition determined with respect to at least one of the coils, and to emit the counter waves with phase angles which are at least partially opposite to those of the harmful waves, defining wave characteristics at least partially similar to those of the harmful waves due to the configuration and/or disposition, thereby countering the harmful waves due to the phase angles in the target space, where this counter unit will be to be referred to as the "first counter unit" hereinafter. In another example, the counter unit is arranged to be disposed in a preset arrangement defined along at least one of multiple wavefronts of the harmful waves which are irradiated by at least one of the coils, and to emit counter electromagnetic waves which define phase angles at least partially opposite to those of the harmful waves and also have wave characteristics at least partially similar to those of the harmful waves due to such an arrangement, thereby countering the harmful waves due to the opposite phase angles in the target space, where this counter unit is to be referred to as the "second counter unit" hereinafter.

In one exemplary embodiment of this aspect of the invention, an EMC transformer system may include a body, at least one insert, at least two coils, and one of at least one first counter unit and at least one second counter unit. The body is arranged to terminate in at least two electric couplers one of which couples with a source of the energy and another of which couples with an electric device. The insert is arranged to be disposed inside such a body and to include ferromagnetic, paramagnetic, diamagnetic material, and/or ferromagnetic materials, and to define at least two sides thereon. One of the coils is arranged to be wound around a first side of the insert in a preset direction and in a preset number of turns, and another of the coils is arranged to be wound around a second side of the insert along another preset direction and in another preset number of turns. Both coils are also arranged to be spaced away from each other and to emit the harmful waves as the electric energy flows therein while serving as the base units.

Embodiments of such system aspects of the present invention may include one or more of the following features, and configurational and/or operational variations and/or modifications of the above systems also fall within the scope of the present invention.

At least a (or an entire) portion of at least one of such base units may be exposed through the wave source or may be disposed inside the wave source. Each base unit may include a winding of a wire and/or strip, and may be made of and/or include at least one conductive, semiconductive, and/or insulative material. The core may include therein at least one ferromagnetic material. The transformer system may be a step-up transformer, a step-down transformer, an isolating transformer, a resonant transformer, a current transformer, a voltage transformer, a variable transformer, an autotransformer, a polyphase transformer, a pulse transformers, and an RF transformer. The transformer system may only change electric voltages across the coils or, in the alternative, may not only change the voltages across the coils but also convert an AC voltage into a DC voltage. The transformer system may also reduce an AC line voltage to a DC voltage of less amplitudes.

Such harmful waves may include carrier-frequency waves having frequencies less than from about 50 Hz to 60 Hz, extremely low-frequency waves of frequencies less than 300 Hz, other waves having frequencies less than 1 kHz, 5 kHz, 10 kHz, 20 kHz, 50 kHz, 100 kHz, 500 kHz, 1 MHz, 10 MHz, 50 MHz, 100 MHz, 500 MHz, 1 GHz, 5 GHz, 10 GHz, 50 GHz, 100 GHz, 500 GHz, 1 THz, and the like, where the counter waves may define frequencies similar to (or greater than, less than) those of such harmful waves. The harmful waves may include ultra low-frequency waves of frequencies less than 3 kHz, very low-frequency waves with frequencies less than 30 kHz, low-frequency waves defining frequencies less than 300 kHz, and the like, while the counter waves may have frequencies similar to (or greater than, less than) those of the harmful waves. The target space may be formed on one side of the counter unit and at least one of the base units, around a preset angle around the counter unit or at least one of the base units, between the counter unit and at least one of the base units, and so on.

The countering may include the above canceling and/or the suppressing. The counter unit may receive the electric energy and actively emit the counter waves or, in the alternative, may not receive the electric energy but passively emit the counter waves due to an electromagnetic induction caused by the magnetic flux flowing in the core. The counter unit may counter the harmful waves by a local countering in which the counter unit may counter only one of the base units or, in the alternative, may counter such harmful waves in a global countering in which the counter unit may counter at least two of the base units. The counter unit may counter such harmful waves by a source matching in which the counter unit defines a configuration at least partially similar to that of at least one of the base units or, in the alternative, may counter so in a wave matching in which the counter unit emits the counter waves at least one of their wavefronts matches at least one wavefront of the harmful waves.

The counter unit may include at least one electric conductor in which the current may flow, at least one electric semiconductor and/or insulator across which the voltage may be applied, and so on. The counter unit may be disposed side by side with (or stacked over) at least one of such base units, may wind around at least one of such base units along a preset length, may concentrically enclose at least one of the base units, may be enclosed inside at least one of the base units, may wind around at least a portion of the core, may be axially aligned with at least one of the base units, and the like. The counter unit may be disposed away from at least one of such base units at a preset distance, may be mechanically, electrically, and/or magnetically couple with at least one of the base units, may form an unitary article with at least one of the base units, and the like. The counter unit may be retained by at least one support and maintain its shape while emitting the harmful waves or, alternatively, may vary its shape while emitting the counter waves. The counter unit may include at least one ferromagnetic insert disposed therethrough.

The configuration and/or disposition of the counter unit may be determined based on whether the counter unit is to match a configuration of at least one of such base units (or wave source) or to match at least one of the wavefronts of the harmful waves. The counter unit may define the shape identical to, similar to or different from that of at least one of the base units, that of the wave source, that of the core, and the like. The counter unit may define a shape of the wire, strip, sheet, tube, coil, spiral, mesh, mixture of at least one of such shapes, combination thereof, array thereof, and the like. The array may define a bundle of at least two of such shapes, a braid thereof, a coil thereof, a mesh thereof, and the like. The shape of the counter unit may (or not) conform to that of at least one of the base units, that of the wave source, that of the core, and the like. The counter unit may form the 1-D, 2-D, and/or 3-D analogs of at least one of the base units, of the wave source, of the core, and so on. The counter unit may define only one of the analogs or at least two of the analogs or the counter units may define only one of the analogs or at least two of such analogs, where the analog may maintain a similarity with at least one of the base units, with the core, with the wave source, and so on. At least two of such analogs as a whole may maintain a similarity with at least one of the base units (or wave source, core). At least two portions of the counter unit and/or at least two counter units may instead define the same shape with different sizes, different shapes of similar or different sizes, and the like. The counter unit may have at least substantially uniform shape and/or size along at least a substantial portion thereof along its longitudinal or short axis, may define the shape and/or size varying along the portion and/or axis, and the like. The size of the counter unit may (or not) conform to that of at least one of the base units (or wave source, core). The counter units may be disposed in the arrangement which is identical to, similar to or different from the shape of one of such base units, the shape of the wave source or core, the arrangement of at least two of the base units, the arrangement of the wave sources, and so on. At least two of the counter units may also be disposed in an arrangement which may (or not) conform to the shape of at least one of the base units, to the shape of the wave source, to the shape of the core, to the arrangement of at least two of such base units, to the arrangement of such wave sources, and the like. The counter units may be disposed in a symmetric (or asymmetric) arrangement with respect to each other, to at least one of the base units (or wave source, core), and the like. The counter unit may be aligned with (or misaligned from) the direction of propagation of the harmful waves, the direction of the electric energy (i.e., current or voltage), the longitudinal axis of at least one of the base units, the short axis of at least one of such base units, one of such axes of the wave source, one of the axes of the core, and the like. All of (or only some of, one of, none of) such counter units may be aligned with (or misaligned from) at least one of the directions and/or axes. The counter unit and at least one of such base units may be disposed at an identical (or similar) distance from the target space. At least a portion of the counter unit and/or at least one of the base units may be disposed in another of the units or, alternatively, the counter unit and at least one of the base units may be axially disposed along a single common axis of at least two of such units, and the like. Such counter units may be in an angular arrangement defined around the longitudinal axis of at least one of the base units (or wave source, core).

The counter unit may be movably or stationarily disposed closer to (or farther away from) the target space than at least one of the base units (or wave source, core). The counter unit and at least one of the base units may be disposed on the same side of the target space or, alternatively, the units may be disposed on opposite sides of the target space. The counter unit may conform to at least one of the base units or, alternatively, the counter units may conform to at least one of the base units, and the like. The counter unit may be disposed on an exterior (or interior) of and/or embedded into at least one of the base units (or wave source, core). The counter unit may also be disposed on, in or inside a case member of the system. The counter unit and at least one of the base units may also be made of and/or include at least one common material, may be made of and/or include identical materials, or may not include any common material. The counter unit may be directly coupled to the case member, at least one of the base units, and/or other parts of such a system, may be indirectly coupled thereto through at least one coupler, and the like. The counter unit may also be arranged to emit the counter waves with a least amount of material, while consuming a least amount of the current and/or voltage, and the like.

The base units may also be supplied with the energy such as a source current and/or voltage, where the source current and/or voltage may also be supplied to the counter unit as counter current and/or voltage, where only a portion of the source current and/or voltage may then be supplied to the counter unit as the counter current and/or voltage, where amplitude or direction of at least a portion of the source current and/or voltage may be altered and then supplied to the counter unit as the counter current and/or voltage, where external current and/or voltage may be formed and synchronized with the source current and/or voltage, and then supplied to the counter unit as the counter current and/or voltage, and the like. The counter units may further be supplied with identical counter currents and/or voltages, with different counter currents or voltages, and the like. The counter unit and at least one of the base units may electrically couple to each other in a series mode, in a parallel mode or in a hybrid mode or, alternatively, may not be directly coupled to each other. The counter units may be electrically coupled to each other in a series mode, in a parallel mode or in a hybrid mode or, alternatively, may not be directly coupled to each other. All (or only some) of such counter units may be electrically coupled to at least one of the base units in the same mode or, in the alternative, none of the counter units may be electrically coupled to at least one of the base units in the same mode.

The counter waves may have amplitudes which are greater than, similar to or less than those of the harmful waves depending upon the disposition thereof with respect to at least one of the base units. The counter unit and at least one of such base units may define substantially identical, similar or different resonance frequencies or, alternatively, may define identical, similar or different resonance frequencies. At least a portion of a single counter unit and/or at least one of the multiple counter units may have resonance frequencies different from those of the rest thereof. The transformer core may have a round shape to minimize an amount of the harmful waves irradiated by edges thereof. Such a core may include at least one material with a relative magnetic permeability greater than 1,000, 10,000, 100,000 or 1,000,000. The core may include multiple laminated layers at least one of which may also include the material with the relative magnetic permeability.

The transformer system may include at least one of various magnetic shields which have been described hereinabove or in the co-pending Applications. Such magnetic shields may be disposed in, on, over, around, and/or through at least one of the counter and/or base units. The magnetic shields may have shapes which may at least partially conform to the shapes of the counter and/or base units or, in the alternative, may define shapes which may be at least partially different from shapes of such counter and/or base units. The magnetic shield may have at least one path member defining a relative magnetic permeability greater than 1,000, 10,000, 100,000 or 1,000,000. The magnetic shield may also include at least one magnet member defining at least one South pole. The magnetic shield may include at least one shunt member which may be directly or indirectly coupled to such a magnet member. The shunt member may define the relative magnetic permeability which may be greater than 1,000, 10,000, 100,000 or 1,000,000. Such a magnetic shield described hereinabove or disclosed in the co-pending Applications may be incorporated into any of such devices described hereinabove. The transformer system may include at least one of the electric shields which have been described hereinabove or in the co-pending Applications. Such electric shields may be included into any of the devices described hereinabove. The magnetic and/or electric shields may also form shapes and/or sizes which may be maintained uniform along the longitudinal axis of such counter and/or base units or which may instead vary thereabong. The shapes and/or sizes of the magnetic and/or electric shields may be identical to, similar to or different from those of such counter and/or base units. The system may include multiple magnetic and/or electric shields. At least two of the magnetic and/or electric shields may also shield against the magnetic and/or electric waves of the harmful waves with same or different frequencies in same or different extents. Such magnetic and/or electric shields may be disposed over at least a portion (or entire portion) of the counter and/or base units.

In another aspect of the present invention, a method may be provided for countering harmful electromagnetic waves which are irradiated from multiple base units of at least one wave source of a transformer system by emitting counter electromagnetic waves, by adjusting shapes of such counter waves, and by suppressing the harmful waves from propagating to a target space with such counter waves and/or canceling the harmful waves with the counter waves in the target space, where such base units are arranged to include only portions of the wave source responsible for irradiating such harmful waves and/or affecting paths of the harmful waves therethrough, where the target space is defined between an user and at least one of such base units, where the counter waves propagate while forming at least one first wavefront, and where the harmful waves propagate while forming at least one second wavefront.

In one exemplary embodiment of this aspect of the invention, a method may include the steps of: providing at least one counter unit (to be referred to as the "first providing" hereinafter); extending the counter unit to be wider than the source; disposing the counter unit between the source and user while aligning its width with at least a portion of a wavefront of the harmful waves; and then emitting by the counter unit the counter waves which are similar to the harmful waves and, thus, countering the harmful waves in the target space. The above extending and disposing may be replaced by the steps of: extending the counter unit to be narrower than the wave source; and disposing the counter unit on an opposite side of the target space with respect to the wave source while aligning its width with at least a portion of a wavefront of the harmful waves.

In another exemplary embodiment of this aspect of the invention, such a method may include the steps of: providing a single counter unit; emitting by the counter unit the counter waves having a first set of multiple wavefronts; identifying a second set of multiple wavefronts of the harmful waves; assessing at least one location along the second set of the wavefronts in which the first set of such wavefronts match the second set thereof in the target space; and disposing the counter unit in such a location, thereby countering the harmful waves with the counter waves in the target space.

In another exemplary embodiment of this aspect of the invention, such a method may include the steps of: providing at least two counter units; emitting from such counter units the counter waves having similar (or identical) phase angles and forming a first set of multiple wavefronts each of which is a sum of at least two wavefronts generated by such at least two counter units; finding a relation between a distance between such counter units and an increase in a radius of curvature of each of the wavefronts of the first set; identifying a second set of multiple wavefronts of the harmful waves; selecting the distance between such counter units in which the first set of the wavefronts match the second set thereof; assessing at least two positions for such counter units in the second set of the wavefronts in which the first set of the wavefronts match the second set thereof; and disposing the counter units in the positions separated by the distance, thereby countering the harmful waves with the counter waves in the target space. The above emitting and finding may be replaced by the steps of: emitting by the counter units the counter waves having at least partially opposite phase angles and defining a first set of multiple wavefronts each representing a sum of at least two wavefronts which are generated by such at least two counter units; and finding a relation between a distance between the counter units and a decrease in a radius of curvature of each of the wavefronts of the first set.

In another aspect of the present invention, a method may be provided for countering harmful electromagnetic waves irradiated by multiple base units of at least one wave source of a transformer system by matching at least one feature of at least one of the base units and by canceling the harmful waves in a target space and/or suppressing the harmful waves from propagating to the target space, where the base units are arranged to include only portions of the wave source which are responsible for irradiating the harmful waves and/or affecting paths of such harmful waves therethrough, where the target space is formed between an user and at least one of the base units, and where the feature includes a shape, a size, and/or an arrangement.

In one exemplary embodiment of this aspect of the invention, a method may include the steps of: the first providing; configuring the counter unit to match the feature of the base unit; emitting by the counter unit counter electromagnetic waves similar to the harmful waves due to the configuring; and then disposing the counter unit in a location for matching the harmful waves in the target space by the counter waves. The configuring may be replaced by one of the steps of: configuring the counter unit to define a configuration which is simpler than that of the base unit while at least minimally maintaining the feature; configuring the counter unit to define a configuration more complex than that of the base unit while at least minimally maintaining the feature; configuring the counter unit to define a dimension which is defined by a less number of unit axes than the base unit while at least minimally maintaining the feature; and configuring the counter unit to have a dimension defined by a greater number of unit axes than that of the base unit while at least minimally maintaining the feature.

In another exemplary embodiment of this aspect of the invention, such a method may include the steps of: providing a single counter unit; configuring the counter unit to have a configuration which is simpler than that of a single base unit while maintaining the feature; emitting by such a counter unit counter electromagnetic waves similar to the harmful waves due to the configuring; and disposing the counter unit in a location for matching such harmful waves in the target space by the counter waves, thereby countering the harmful waves by the counter waves therein. The above configuring may be replaced by one of the steps of: configuring the counter unit to define a configuration which is similar (or identical) to an arrangement of multiple base units while maintaining the feature; configuring such a counter unit to have a dimension formed by less mutually orthogonal unit axes than an arrangement of multiple base units while maintaining the feature; and configuring the counter unit to have a dimension which is formed by more mutually orthogonal unit axes than a dimension of multiple base units while maintaining the feature.

In another exemplary embodiment of this aspect of the invention, such a method may include the steps of: providing multiple counter units; arranging at least two of the above counter units in a configuration which is simpler than that of a single base unit while maintaining the feature; emitting by the counter units counter electromagnetic waves similar to the harmful waves due to the configuring; and disposing the counter units in locations for matching the harmful waves in the target space by the counter waves, thereby countering the harmful waves by the counter waves therein. The arranging may be replaced by one of the steps of: arranging at least two of the counter units in a configuration which is similar or identical to an arrangement of multiple base units while maintaining such a feature; arranging such counter units in an arrangement defining a dimension which is formed by less mutually orthogonal unit axes than another dimension of a single base unit while maintaining such a feature; and arranging the counter units in an arrangement with a dimension which is formed by more mutually orthogonal unit axes than a dimension of multiple base units while maintaining the feature;

In another exemplary embodiment of this aspect of the invention, such a method may include the steps of: providing a smaller number of such counter units for a greater number of the base units; arranging the counter units while approximating an arrangement of the base units and maintaining the feature; emitting by the counter units counter electromagnetic waves which are similar to the harmful waves due to the disposing; and then disposing the counter unit in a location for matching the harmful waves in the target space by the counter waves, thereby countering such harmful waves with such counter waves therein. Such providing and arranging may be replaced by the steps of: providing a greater number of the counter units for a smaller number of the base units; and arranging the counter units while disposing at least two of the counter units around at least one of the base units and while maintaining the feature.

In another exemplary embodiment of this aspect of the invention, such a method may have the steps of: the first providing; configuring the counter unit to move with respect to the base unit; emitting by the counter unit counter electromagnetic waves; finding a relationship between a distance from the counter unit to the base unit and an extent (or degree) of matching between the counter and harmful waves; assessing a location in which the counter waves best match the harmful waves; and moving the counter unit to the location for best matching the harmful waves in the target space by the counter waves, thereby countering the harmful waves by the counter waves therein.

In another aspect of the present invention, a method may be provided for countering harmful electromagnetic waves which are irradiated by multiple base units of at least one wave source of a transformer system by matching the harmful waves and also by suppressing the harmful waves from propagating toward a target space and/or canceling the harmful waves in the space, where the base units are arranged to include only portions of the wave source which are responsible for irradiating the harmful waves and/or affecting paths thereof therethrough, where such a target space is defined between at least one of such base units and an user thereof, where the counter waves propagate while defining at least one first wavefront, and where the harmful waves define at least one second wavefront.

In one exemplary embodiment of this aspect of the invention, a method may include the steps of: identifying a first set of multiple wavefronts of the harmful waves; disposing at least one counter unit along at least one of such wavefronts; and emitting by the counter unit counter electromagnetic waves forming a second set of multiple wavefronts which are similar (or identical) to the first set of the wavefronts in the target space due to the disposing, thereby countering the harmful waves by the counter waves therein.

In another exemplary embodiment of this aspect of the invention, such a method may have the steps of: identifying multiple wavefronts of the harmful waves; providing at least one counter unit for emitting counter electromagnetic waves which define multiple wavefronts similar to a shape and/or an arrangement of the counter unit; disposing the counter unit along at least one of the wavefronts of the harmful waves; and then emitting the counter waves while aligning their wavefronts with those of the harmful waves in the target space due to the providing and disposing, thereby countering the harmful waves with the counter waves therein. The above providing and disposing may also be replaced by the steps of: providing at least one counter unit for emitting counter electromagnetic waves defining multiple wavefronts different from a shape and/or an arrangement of the counter unit; and disposing the counter unit across (or along) at least two of the wavefronts of the harmful waves based on the providing.

In another exemplary embodiment of this aspect of the invention, such a method may have the steps of: identifying multiple wavefronts of the harmful waves; disposing multiple counter units in an arrangement which is defined along at least one of such wavefronts; configuring the counter units to emit counter electromagnetic waves which define multiple wavefronts similar to the arrangement of the counter units; and emitting the counter waves while aligning their wavefronts with those of such harmful waves in the target space due to the configuring, thereby countering the harmful waves with the counter waves therein. The above disposing and configuring may also be replaced by the steps of: disposing multiple counter units in an arrangement across or along at least two of the wavefronts; and configuring the counter units to emit counter electromagnetic waves defining multiple wavefronts different from the arrangement of the counter units.

In another exemplary embodiment of this aspect of the invention, a method may have the steps of: the first providing; identifying multiple wavefronts of the harmful waves; emitting by such a counter unit counter electromagnetic waves having multiple wavefronts; locating the counter unit between the base unit and target space; comparing shorter radii of curvature of the wavefronts of such counter waves to longer radii of curvature of the harmful waves; and disposing the counter unit into a location in which the radii of curvature of such counter and harmful waves are configured to best match each other in the target space, thereby countering the harmful waves by the counter waves therein. Such locating and comparing may be replaced by the steps of: locating the counter unit on an opposite side of the target space with respect to the base unit; and then comparing longer radii of curvature of the wavefronts of the counter waves to shorter radii of curvature of the harmful waves.

In another exemplary embodiment of this aspect of the invention, such a method may have the steps of: the first providing; configuring the counter unit to move with respect to the base unit; emitting by the counter unit counter electromagnetic waves; finding a relationship between a distance from the counter unit to the base unit and an extend (or degree) of matching between radii of curvature of the counter waves and those of the harmful waves; assessing a location where the counter waves best match the harmful waves; and moving the counter unit to the location for matching the harmful waves in such a target space by the counter waves, thereby countering the harmful waves by the counter waves therein.

In another aspect of the present invention, a method may be provided for countering harmful electromagnetic waves irradiated by multiple base units of at least one wave source of a transformer system by emitting counter electromagnetic waves from at least one counter unit and by propagating the counter waves in a preset direction to the harmful waves, where the base units are arranged to include only portions of the source which are responsible for irradiating such harmful waves and/or affecting paths of the harmful waves therethrough and where the target space is formed between at least one of the base units and an user.

In one exemplary embodiment of this aspect of the invention, a method may include the steps of: configuring the counter waves to define shapes similar to those of the harmful waves and at least partially opposite phase angles (will be referred to as the "first configuring" hereinafter); enclosing at least a portion of the base unit by the counter unit; and emitting the counter waves while enclosing the harmful waves in such a target space, thereby countering the harmful waves by the counter waves therein. The above enclosing may be replaced by the step of: disposing multiple counter units around at least a portion of the base unit.

In another exemplary embodiment of this aspect of the invention, such a method may have the steps of: the first configuring; disposing at least a portion of the counter unit inside the base unit; and emitting the counter waves while being enclosed by the harmful waves in the target space, thereby countering the harmful waves by the counter waves therein. The above disposing may be replaced by the step of: enclosing at least a portion of the counter unit by multiple base unit.

In another exemplary embodiment of this aspect of the invention, such a method may have the steps of: the first configuring; disposing the counter unit lateral to the base unit; and then emitting the counter waves to the target space with the harmful waves, thereby countering the harmful waves by the counter waves therein. The above disposing may be replaced by one of the steps of: disposing the counter unit along a longitudinal axis of the base unit and away therefrom; and enclosing at least a portion of one of the counter and base units by another of the units.

In another exemplary embodiment of this aspect of the invention, such a method may have the steps of: the first configuring; aligning the counter unit with a direction of propagation of such harmful waves; and emitting the counter waves toward the target space with such harmful waves, thereby countering the harmful waves by the counter waves therein. The above aligning may be replaced by one of the steps of: aligning the counter unit with a direction of electric current and/or voltage applied to the base unit; aligning the counter unit with a longitudinal axis of the base unit; aligning the counter unit with a short axis of the base unit, and the like.

In another exemplary embodiment of this aspect of the invention, such a method may include the steps of: the first configuring; disposing the counter unit between the base unit and target space; emitting by the counter unit the counter waves with amplitudes less than those of the harmful waves; and propagating the counter waves toward the target space along with the harmful waves, thereby countering the harmful waves by the counter waves therein. The above disposing and emitting may be replaced by the steps of: disposing the counter unit on an opposite side of the target space relative to the base unit; and emitting by the counter unit the counter waves defining amplitudes greater than those of the harmful waves.

In another exemplary embodiment of this aspect of the invention, such a method may have the steps of: the first configuring; disposing the counter unit between the base unit and the target space; extending the counter unit to have a width greater than that of the base unit in a direction normal to a direction of propagation of the harmful waves; and then emitting the counter waves toward the target space with the harmful waves, thereby countering the harmful waves by the counter waves therein. The above disposing and extending may be replaced by the steps of: disposing the counter unit on an opposite side of the target space relative to the base unit; and extending the counter unit to a width less than that of the base unit in a direction normal to a direction of propagation of the harmful waves.

In another aspect of the present invention, a method may be provided for countering harmful electromagnetic waves which are irradiated by multiple base units of at least one wave source of a transformer system by emitting counter electromagnetic waves and also by suppressing the harmful waves with the counter waves from propagating toward a target space and/or canceling the harmful waves by the counter waves in the target space, where the base units are arranged to include only portions of the wave source which are responsible for irradiating the harmful waves and/or affecting paths of the harmful waves therethrough and where the target space is formed between an user and base units.

In one exemplary embodiment of this aspect of the invention, a method may include the steps of: providing a single counter unit emitting the counter waves; the first configuring; and countering the harmful waves irradiated by a single base unit by the counter waves.

In another exemplary embodiment of this aspect of the invention, such a method may have the steps of: providing a single counter unit which emits such counter waves; the first configuring; and countering a sum of the harmful waves irradiated by all of multiple base units with the counter waves. The above countering may be replaced by the step of: countering the harmful waves irradiated by at least one but not all of multiple base units by the counter waves.

In another exemplary embodiment of this aspect of the invention, such a method may have the steps of: providing multiple counter units emitting such counter waves; the first configuring; and then countering the harmful waves irradiated from a single base unit by a sum of all of the counter waves emitted by all of the counter units.

In another exemplary embodiment of this aspect of the invention, such a method may have the steps of: providing multiple counter units emitting such counter waves; the first configuring; and then countering a sum of the harmful waves irradiated by all of multiple base units with another sum of the counter waves emitted by at least two of the counter units. The above countering may be replaced by the step of: countering the harmful waves irradiated by at least one but not all of multiple base units by another sum of the counter waves emitted by at least two of the counter units.

In another exemplary embodiment of this aspect of the invention, such a method may have the steps of: providing at least two counter units each emitting a set of the counter waves; configuring at least one of the counter units to move with respect to another thereof; the first configuring; and then moving such at least one of the counter units with respect to such a base unit in the emitting, thereby countering the harmful waves irradiated from a single base unit with a different number of the sets of the counter waves.

In another aspect of the present invention, a method may be provided for countering harmful electromagnetic waves which are irradiated by at least one base unit of at least one wave source of a transformer system by emitting counter electromagnetic waves to the harmful waves, where such a base unit is arranged to be shaped into at least one curvilinear wire.

In one exemplary embodiment of this aspect of the invention, a method may include the steps of: the first providing; shaping the counter unit as one of a wire, a strip, and a sheet; disposing such a counter unit along and close to the wire; and supplying electric current in the wave source of the wire and the counter unit in opposite directions while emitting such counter waves from the counter unit for countering the harmful waves by the counter waves (which will be referred to as the "first supplying" hereinafter). The above disposing may be replaced by the step of: braiding the counter unit around and close to the wire.

In another exemplary embodiment of this aspect of the invention, such a method may have the steps of: providing multiple counter units each shaped as a wire, a strip, and/or a sheet; disposing the counter units around and close to the wire; and the first supplying. Such disposing may be replaced by the step of: braiding each of the counter units around and close to the wire in the same or different directions.

In another exemplary embodiment of this aspect of the invention, such a method may have the steps of: the first providing; shaping the counter unit as at least one coil or spiral; winding the counter unit around the wire; and the first supplying. The above shaping and winding may be replaced by the steps of: shaping the counter unit into a sheet or a mesh;

and winding such a counter unit around the wire. The above shaping and winding may also be replaced by the steps of: shaping the counter unit into an annular tube with a lumen; and disposing the wire inside the lumen of the counter unit.

In another exemplary embodiment of this aspect of the invention, such a method may have the steps of: identifying multiple wavefronts of the harmful waves formed around the wire; disposing at least one counter unit along at least one of the above wavefronts; and emitting by the counter unit the counter waves of multiple wavefronts which are similar (or identical) to the wavefronts of the wire, thereby countering the harmful waves with the counter waves.

In another aspect of the present invention, a method may be provided for countering harmful electromagnetic waves which are irradiated by at least one base unit of at least one wave source of a transformer system by emitting counter electromagnetic waves to the harmful waves, where such a base unit is configured to be shaped into at least one curvilinear strip.

In one exemplary embodiment of this aspect of the invention, a method may include the steps of: the first providing; shaping the counter unit as a wire, a strip or a sheet; disposing the counter unit along and close to the strip (or sheet); and supplying electric current in the wave source of the strip (or sheet) and the counter unit in opposite directions while emitting the counter waves by the counter unit in order to counter such harmful waves by the counter waves (to be referred to as the "second supplying" hereinafter). Such disposing may also be replaced by the step of: braiding the counter unit around and close to the strip (or sheet).

In another exemplary embodiment of this aspect of the invention, such a method may have the steps of: providing multiple counter units each shaped as a wire, a strip or a sheet; disposing such a counter units around and close to the strip (or sheet); and the second supplying. Such disposing may be replaced by the step of: braiding each of the counter units around and close to the strip (or sheet) in one of same and different directions.

In another exemplary embodiment of this aspect of the invention, such a method may have the steps of: the first providing; shaping the counter unit as one of at least one coil and at least one spiral; winding the counter unit around the strip (or sheet); and then the second supplying. The shaping and winding may be replaced by the steps of: shaping the counter unit as a sheet or a mesh; and winding the counter unit around the strip (or sheet). The above shaping and winding may also be replaced by the steps of: shaping the counter unit as a pair of strips (or sheets); and disposing the wire between the strips (or sheets).

In another exemplary embodiment of this aspect of the invention, such a method may have the steps of: identifying multiple wavefronts of the harmful waves around the strip (or sheet); disposing at least one counter unit along at least one of the wavefronts; and emitting from the counter unit such counter waves with multiple wavefronts similar (or identical) to the wavefronts of the strip (or sheet), thereby countering the harmful waves with the counter waves.

In another aspect of the present invention, a method may be provided for countering harmful electromagnetic waves which are irradiated by at least one base unit of at least one wave source of a transformer system by emitting counter electromagnetic waves to the harmful waves, where the base unit is configured to be shaped as at least one curvilinear coil.

In one exemplary embodiment of this aspect of the invention, a method may include the steps of: the first providing; shaping the counter unit into a toroid by disposing opposing ends of such a coil adjacent to each other; supplying electric current in the coil; and supplying electric current in the wave source of the coil and the counter unit in opposite directions while emitting the counter waves by the counter unit for countering the harmful waves by the counter waves (to be referred to as the "fourth supplying" hereinafter).

In another exemplary embodiment of this aspect of the invention, such a method may have the steps of: the first providing; shaping the counter unit as a wire, a strip or a spiral smaller than the coil of the base unit; winding such a coil of the base unit around the counter unit; and the fourth supplying. The above shaping and winding may be replaced by the steps of: shaping the counter unit as another coil smaller than the coil of the base unit; and winding the coil of the base unit around the counter unit.

In another exemplary embodiment of this aspect of the invention, a method may include the steps of: the first providing; shaping the counter unit as another coil; disposing the coils of the counter and base units adjacent to each other; and the fourth supplying. Such disposing may be replaced by the step of: braiding the coils of the counter and base units.

In another exemplary embodiment of this aspect of the invention, such a method may have the steps of: identifying multiple wavefronts of the harmful waves formed around such a coil; disposing at least one counter unit along at least one of the wavefronts; and then emitting by the counter unit such counter waves having multiple wavefronts similar (or identical) to the wavefronts of the tube, thereby countering the harmful waves with the counter waves.

Embodiments of such method aspects of the present invention may include one or more of the following features, and configurational and/or operational variations and/or modifications of the above methods also fall within the scope of the present invention.

Such countering may include the step of: countering the harmful waves but preserving audible sound waves. The countering may include at least one of the steps of: suppressing at least a portion of the harmful waves from propagating toward the target space by the counter waves; canceling the portion of the harmful waves by the counter waves in the target space, and the like. The countering may also include at least one of the steps of: countering the harmful waves of frequencies less than about 50 Hz to 60 Hz; countering the harmful waves defining frequencies less than about 300 Hz; and countering the harmful waves of frequencies less than about 1 kHz. The countering may also include at least one of the steps of: countering such harmful waves with frequencies less than about 10 kHz or 20 kHz; countering the harmful waves of frequencies less than about 100 kHz; countering the harmful waves with frequencies less than about 1 MHz, 10 MHz, 100 MHz, 1 GHz, 10 GHz, 100 GHz, 1 THz, and the like. The countering may include at least one of the steps of: countering the harmful waves in only a portion of a preset frequency range while preserving the rest thereof; countering magnetic waves of the harmful waves; countering an entire portion of the harmful waves, and the like.

The affecting may include at least one of the steps of: including a permanent magnet; applying the electric voltage; flowing the electric current, and the like. Such extending may include one of the steps of: lengthening the counter unit along its length; widening the counter unit along its width, and the like. The providing may include at least one of the steps of: forming the counter unit into a shape of at least one of a wire, a strip, a sheet, a tube, a coil, a spiral, and a mesh; forming the counter unit into one of a mixture of the shapes, a combination of the shapes, and an array of the shapes, and the like. The forming may include at least one of the steps of: enclosing at least a portion of such a base unit by an array (or bundle) of multiple wires of the counter unit; enclosing the portion of the base unit by an array (or bundle) of multiple strips of the counter unit; enclosing the portion of the base unit by an array (or bundle) of multiple sheets of the counter unit; enclosing the portion of the base unit by an array (or bundle) of multiple tubes of the counter unit; winding with at least one coil of the counter unit about the portion of the base unit; winding the portion of the base unit with an array (or a bundle) of multiple coils; and enclosing the portion of the base unit with at least one annular mesh of the counter unit. Such forming the counter unit may further include at least one of the steps of: extending a single wire for at least a portion of the counter unit; extending an array (or bundle) of multiple wires for the portion; extending a single strip for the portion; extending an array (or bundle) of multiple strips for the portion; extending a single sheet for the portion; extending an array (or bundle) of multiple sheets for the portion; extending a single tube therefor; extending a bundle (or array) of multiple tubes therefor; winding a single coil therefor; winding a bundle (or array) of multiple coils therefor; extending a single annular mesh therefor; and extending an array (or bundle) of multiple annular meshes therefor.

The providing may include one of the steps of: exposing the counter unit through the base unit; hiding the counter unit under (or inside) the base unit, and the like. The providing may include at least one of the steps of: fixedly disposing the counter unit; movably disposing the counter unit, and so on. The providing may include one of the steps of: forming the base and counter units of a same material; forming the base and counter units of different materials; including at least one but not all of materials in the base and counter units, and the like. The providing may include one of the steps of: arranging the base and counter units to have similar (or identical) resonance frequencies; arranging the base and counter units to define different resonance frequencies, and the like.

The disposing may include at least one of the steps of: disposing the counter unit laterally (or side by side) with the base unit; enclosing at least one of the counter and base units with another of the units; axially aligning the base and counter units, and the like. Such enclosing may include one of the steps of: disposing the counter unit indirectly over (or around) the base unit (or source); disposing the counter unit directly on (or around) the base unit (or source), and the like. The enclosing may also include at least one of the steps of: arranging at least two of the counter units concentrically; coupling the counter units electrically in one of a series mode, a parallel mode, and a hybrid mode, and the like. The aligning may include one of the steps of: aligning the counter unit with the longitudinal axis of the base unit; aligning the counter unit with the short axis of the base unit; aligning the counter unit in the direction of the current flowing in (or voltage applied across) the base unit, aligning the counter unit with the direction of propagation of the harmful waves, and the like.

The configuring the counter unit may include at least one of the steps of: controlling a shape of the counter unit; controlling a size of the counter unit; controlling an arrangement of the counter unit, and the like. The disposing may include at least one of the steps of: controlling an orientation of such a counter unit with respect to the base unit (or target space); controlling an alignment of the counter unit with respect thereto; controlling a first distance between the counter unit and base unit (or target space); controlling a second distance between the counter units, and the like.

The emitting may have one of the steps of: controlling the phase angles of the counter waves to be at least similar to those of the harmful waves when the counter and harmful waves propagate along at least partially opposite directions; controlling the phase angles of the counter waves to be at least opposite to those of the harmful waves when the counter and harmful waves propagate along at least similar directions; and controlling the phase angles of the counter waves to be transverse to those of the harmful waves when the counter and harmful waves propagate in directions transverse to each other. Such emitting may include at least one of the steps of: manipulating amplitudes of the counter waves to be greater (or less) than those of the harmful waves when measured in the target space; manipulating the amplitudes of the counter waves to be similar (or identical) to those of the harmful waves when measured at the base unit, and the like. The emitting may include at least one of the steps of: propagating the counter waves in the same direction as the harmful waves; propagating the counter waves in a direction different from that of the harmful waves irradiated by each of such base units but in the same direction as that of a sum of the harmful waves from the base units, and the like. The emitting may include the step of: manipulating phase angles of the counter waves to be at least partially (or substantially) opposite to those of the harmful waves.

The method may also include one of the steps of: flowing the current in an entire portion of the base unit; flowing the current in only a portion of the base unit; applying such voltage across an entire portion of the base unit; and applying such voltage across only a portion of the base unit. The method may include one of the steps of: flowing the current in a single direction through the base (or counter) unit; flowing such current along different directions in different portions of the base (or counter) unit; applying such voltage in a single direction through the base (or counter) unit; applying such voltage in different directions along different portions of the base (or counter) unit, and the like. The method may include the step of: providing multiple base units for the harmful waves, and the flowing may include one of the steps of: flowing the currents with the same amplitudes along a same direction in all of the base (or counter) units; flowing the currents of the same amplitudes in different directions along the base (or counter) units; flowing the currents of different amplitudes in the same direction in all of the base (or counter) units; flowing the currents of different amplitudes in different directions in the base (or counter) units, and the like. The method may include the step of: providing multiple base units for the harmful waves, and the applying may include one of the steps of: applying the voltages with the same amplitudes along a same direction in all of the base (or counter) units; applying the voltages of the same amplitudes in different directions along the base (or counter) units; applying the voltages of different amplitudes in the same direction in all of the base (or counter) units; applying the voltages of different amplitudes in different directions in the base (or counter) units, and the like.

Such flowings may include one of the steps of: flowing the currents of the same (or different) amplitudes in the counter unit; flowing in the counter unit another current which may not be derived from the current supplied to the base unit but may have a temporal pattern at least partially similar to that of the current supplied to the base unit; flowing along the counter unit another current which may be derived not from the current to the base unit and may have a temporal pattern different from that of the current to the base unit, and the like. Such flowing the currents may include one of the steps of: flowing such currents in the base unit and then in the counter unit; flowing the currents in the counter unit and then in the base unit; flowing such currents at least simultaneously in the base and counter units, and the like.

In another aspect of the present invention, a transformer system may be provided to counter harmful electromagnetic waves irradiated by multiple base units of at least one wave source thereof by emitting counter electromagnetic waves toward the harmful waves, by controlling a configuration of the counter unit, and by suppressing the harmful waves with the counter waves from propagating to a target space and/or canceling the harmful waves with the counter waves in such a target space, where the base units are arranged to include only portions of the wave source which are responsible for irradiating the harmful waves and/or affecting paths of the harmful waves therethrough, while the target space is formed between an user of the system and at least one of the base units.

In one exemplary embodiment of this aspect of the invention, such a system may be made by a process including the steps of: arranging at least one counter unit to have a width longer than that of the base unit; disposing the counter unit between the wave source and user while aligning its width with at least a portion of a wavefront of the harmful waves; configuring the counter unit to emit such counter waves defining wave characteristics similar to the harmful waves but having at least partially opposite phase angles thereto; and aligning the counter unit to propagate the counter waves toward the target space, thereby countering the harmful waves by the counter waves therein (to be referred to as the "first aligning" hereinafter). Such arranging and disposing may be replaced by the steps of: arranging at least one counter unit to define a width narrower than the base unit; and disposing the counter unit on an opposite side of the target space with respect to the wave source while aligning its width with at least a portion of a wavefront of the harmful waves.

In another exemplary embodiment of this aspect of the invention, a system may be made by a process including the steps of: identifying multiple wavefronts of the harmful waves; configuring a single counter unit to emit the counter waves defining multiple wavefronts which have phase angles at least partially opposite to those of the harmful waves and which are also capable of matching the wavefronts of the harmful waves when disposed at a preset distance from the base unit; disposing the counter unit in the distance from the base unit; and the first aligning.

In another exemplary embodiment of this aspect of the invention, a system may be made by a process including the steps of: providing at least two counter units; configuring such counter units to emit the counter waves which define similar (or identical) phase angles and have a first set of multiple wavefronts each corresponding to a sum of at least two wavefronts generated by the counter units; finding a relationship between a distance between such counter units and an increase in a radius of curvature of each of the wavefronts of the first set; identifying a second set of multiple wavefronts of the harmful waves; configuring the counter units to match the radii of curvature of the wavefronts of the first set with those of the wavefronts of the second set when disposed at preset distances from the base unit; disposing the counter units in the distances; and then the first aligning. The above configuring and finding may also be replaced by the steps of: configuring the counter units to emit the counter waves defining at least partially opposite phase angles and a first set of multiple wavefronts each corresponding to a sum of at least two wavefronts generated by the counter units; and finding a relationship between a distance between the counter units and a decrease in a radius of curvature of each of the wavefronts of the first set.

In another aspect of the present invention, a transformer system may be provided to counter harmful electromagnetic waves irradiated by multiple base units of at least one wave source thereof by emitting counter electromagnetic waves to the harmful waves, by matching at least one feature of at least one of the base units therewith, and also by suppressing the harmful waves with the counter waves from propagating toward a target space and/or canceling the harmful waves with the counter waves in the target space, where such base units are arranged to include only portions of the wave source which are responsible for irradiating the harmful waves and/or affecting paths of the harmful waves therethrough, and where such a target space is defined between an user of the system and at least one of the base units.

In one exemplary embodiment of this aspect of the invention, such a system may be made by a process including the steps of: arranging at least one counter unit to match such a feature of the base unit; configuring the counter unit to emit the counter waves similar (or identical) to the harmful waves due to the arranging but having phase angles at least partially opposite to those of the harmful waves (to be referred to as the "second countering" hereinafter); and the first aligning. The above arranging may be replaced by one of the steps of: arranging at least one counter unit to define a configuration simpler than that of the base unit while at least minimally maintaining the feature; arranging at least one counter unit to define a configuration more complex than that of the base unit while at least minimally maintaining such a feature; arranging at least one counter unit to have a dimension defined by a less number of unit axes than the base unit while at least minimally maintaining the feature; and arranging at least one counter unit to have a dimension which is defined by a greater number of unit axes than that of the base unit while at least minimally maintaining the feature.

In another exemplary embodiment of this aspect of the invention, a system may be made by a process including the steps of: arranging a single counter unit to define a configuration simpler than that of a single base unit while maintaining the feature; the second countering; and the first aligning. The above arranging may be replaced by one of the steps of: arranging a single counter unit to define a configuration similar (or identical) to an arrangement of multiple base units while maintaining such a feature; arranging a single counter unit to define a dimension formed by less mutually orthogonal unit axes than an arrangement of multiple base units while maintaining the feature; and arranging a single counter unit to define a dimension formed by more mutually orthogonal unit axes than a dimension of multiple base units while maintaining the feature.

In another exemplary embodiment of this aspect of the invention, a system may be made by a process including the steps of: providing multiple counter units; arranging at least two of the counter units in a configuration simpler than that of a single base unit while maintaining the feature; configuring the counter units to emit the counter waves similar to (or identical to) the harmful waves due to such arranging but to defining phase angles at least partially opposite to those of such harmful waves; and aligning the counter units to propagate the counter waves to the target space, thereby countering the harmful waves by the counter waves therein. The above arranging may also be replaced by one of the steps of: arranging at least two of the counter units in a configuration which is similar (or identical) to an arrangement of multiple base units while maintaining such a feature; arranging the counter units in an arrangement defining a dimension which is formed by less mutually orthogonal unit axes than a dimension of a single base unit while maintaining such a feature; and arranging the counter units in an arrangement defining a dimension formed by more mutually orthogonal unit axes than a dimension of multiple base units while maintaining the feature.

In another exemplary embodiment of this aspect of the invention, a system may be made by a process including the steps of: providing less counter units than such base units; approximating an arrangement of the base units by the counter units while maintaining such a feature; configuring such counter units to emit the counter waves which are similar to (or identical to) the harmful waves due to the approximating but define phase angles at least partially opposite to those of the harmful waves; and aligning the counter units to propagate the counter waves to the target space, thereby countering the harmful waves by the counter waves therein. The above providing and approximating may also be replaced by the steps of: providing more counter units for less base units; and approximating an arrangement of the base units by the counter units while disposing at least two of the counter units around at least one of the base units and maintaining the feature.

In another exemplary embodiment of this aspect of the invention, a system may be made by a process including the steps of: arranging at least one counter unit to move with respect to the base unit; configuring the counter unit to emit the counter waves similar (or identical) to the harmful waves but defining phase angles at least partially opposite to those of the harmful waves; finding a relation between a distance from the counter unit to the base units and an extent of matching between such counter and harmful waves; and then moving the counter unit a location where the extent attains its maximum, thereby countering the harmful waves by the counter waves in the target space.

In another aspect of the present invention, a transformer system may be provided to counter harmful electromagnetic waves irradiated by multiple base units of at least one wave source thereof by emitting counter electromagnetic waves to such harmful waves, by matching such harmful waves thereby, and by suppressing the harmful waves from propagating to a target space with the counter waves and/or canceling the harmful waves with the counter waves in the target space, where such base units are arranged to include only portions of the wave source which are mainly responsible for irradiating the harmful waves and/or affecting paths of such harmful waves therethrough, and where the target space is defined between an user of the system and at least one of the base units.

In one exemplary embodiment of this aspect of the invention, such a system may be made by a process including the steps of: identifying a first set of multiple wavefronts of such harmful waves; disposing at least one counter unit along at least one of the wavefronts; configuring the counter unit to emit the counter waves forming a second set of multiple wavefronts similar to (or identical to) the first set of the wavefronts in the target space due to the disposing; and the first aligning.

In another exemplary embodiment of this aspect of the invention, a system may be made by a process including the steps of: identifying multiple wavefronts of such harmful waves; configuring at least one counter unit to emit the counter waves defining multiple wavefronts similar to a shape and/or an arrangement of the counter unit; disposing the counter unit along at least one of the wavefronts of the harmful waves; and arranging the counter unit to emit such counter waves of which wavefronts are aligned with those of the harmful waves in the target space based upon the configuring, thereby countering the harmful waves by the counter waves therein. The above configuring and disposing may be replaced by the steps of: configuring at least one counter unit to emit the counter waves with multiple wavefronts different from at least one of a shape and an arrangement of the counter unit; and disposing such a counter unit across (or along) at least two of the wavefronts of the harmful waves based on the configuring.

In another exemplary embodiment of this aspect of the invention, such a system may be made by a process including the steps of: identifying multiple wavefronts of the harmful waves; disposing multiple counter units in an arrangement along at least one of the wavefronts; configuring the counter units to emit such counter waves with multiple wavefronts similar to the arrangement of the counter units; and arranging the counter units to emit such counter waves of which wavefronts are aligned with those of the harmful waves in the target space based on the configuring, thereby countering the harmful waves by the counter waves therein. The above disposing and configuring may be replaced by the steps of: disposing multiple counter units in an arrangement across (or along) at least two of the wavefronts; and configuring the counter units to emit the counter waves with multiple wavefronts different from the arrangement of the counter units.

In another exemplary embodiment of this aspect of the invention, a system may be made by a process including the steps of: identifying multiple wavefronts of such harmful waves; configuring at least one counter unit to emit such counter waves with multiple wavefronts each defining a radius of curvature; locating the counter unit between the base unit and target space; comparing shorter radii of curvature of the wavefronts of such counter waves with longer radii of curvature of the harmful waves; and configuring the counter unit to be disposed in a location where the radii of curvature of the wavefronts of the counter waves are configured to match those of the wavefronts of the harmful waves in the target space, thereby countering the harmful waves by the counter waves therein. The above locating and comparing may further be replaced by the steps of: locating the counter unit on an opposite side of the target space relative to the base unit; and comparing longer radii of curvature of the wavefronts of the counter waves to shorter radii of curvature of the harmful waves.

In another exemplary embodiment of this aspect of the invention, a system may be made by a process including the steps of: arranging at least one counter unit to move with respect to the base unit; configuring the counter unit to emit the counter waves similar (or identical) to the harmful waves but have phase angles at least partially opposite to those of the harmful waves; finding a relationship between a distance between the counter and base units and matching between radii of curvature of the counter waves and those of the harmful waves; assessing a location in which the wavefronts of the counter and harmful waves best match each other; and moving the counter unit to the location for best matching the harmful waves in the target space by such counter waves, thereby countering the harmful waves by the counter waves therein.

In another aspect of the present invention, a transformer system may be provided to counter harmful electromagnetic waves irradiated by multiple base units of at least one wave source thereof by suppressing the harmful waves from propagating to a target space and/or canceling such harmful waves in the target space, where the base units are arranged to include only portions responsible for irradiating the harmful waves and/or affecting paths of such harmful waves therethrough and where the target space is defined between an user of the system and at least one of the base units.

In one exemplary embodiment of this aspect of the invention, such a system may be made by a process including the steps of: arranging at least one counter unit to have a shape which is identical (or similar) to the base unit and to emit counter electromagnetic waves, and configuring such counter waves to have phase angles at least partially opposite to those of the harmful waves, to define wave characteristics at least partially similar to those of the harmful waves due to the shape and, therefore, to counter the harmful waves due to the opposite phase angles in the target space (to be referred to as the "third configuring" hereinafter).

In another exemplary embodiment of this aspect of the invention, a system may be made by a process including the steps of: arranging a single counter unit to define a shape of an 1-D (or 2-D, 3-D) analog of the base unit and to emit counter electromagnetic waves; and the third countering. Such arranging may be replaced by the step of: arranging a single counter unit to define a shape of an 1-D (or 2-D, 3-D) analog of at least two of multiple base units and to emit counter electromagnetic waves.

In another exemplary embodiment of this aspect of the invention, a system may be made by a process including the steps of: arranging multiple counter units at least two of which are configured to define shapes of 1-D (or 2-D, 3-D) analogs of such a base unit and to emit counter electromagnetic waves; and the third countering. The above arranging may also be replaced by one of the steps of: arranging multiple counter units at least two of which are configured to define shapes of 1-D (or 2-D, 3-D) analogs of at least two but not all of multiple base units and then to emit counter electromagnetic waves; and arranging multiple counter units at least two of which are configured to define shapes of 1-D (or 2-D, 3-D) analogs of each of multiple base units and to emit counter electromagnetic waves.

More product-by-process claims may be constructed by modifying the foregoing preambles of the apparatus and/or method claims and by appending thereonto such bodies of the apparatus and/or method claims. In addition, such process claims may include one or more of the above features of the apparatus and/or method claims of the present invention.

As used herein, the term "units" collectively refers to both of a "base unit" and a "counter unit" of an electromagnetically-countered transformer system of the present invention, where this system is to be abbreviated as the "EMC transformer system," as the "EMC system" or simply as the "system" hereinafter. Such a classification between the "units" is primarily based upon their intended functions. That is, the "base unit" represents various parts of the EMC transformer system which are to perform intended functions of the system such as, e.g., changing electric voltages across their primary and secondary coils. All of such "base units" irradiate the harmful waves while performing their intended functions, and these "base units" are always incorporated in prior art transformers. In contrary, the "counter unit" represents those parts of the EMC system which are to perform countering functions such as, e.g., canceling at least a portion of such harmful waves in the target space, suppressing or preventing the portion of the harmful waves from propagating to the target space, and the like. When desirable, the "counter unit" may be arranged to perform and/or to participate in the functions intended for the "base unit" and, accordingly, serve as an extra "base unit" which also performs the countering function. This unit, however, is to be classified as the "counter unit" within the scope of this invention unless otherwise specified. Within the scope of the present invention, such a "base unit" is therefore omnipresent in any prior art transformers, while the "counter unit" is neither physically not functionally present in the prior art transformers.

The "base unit" is to be distinguished from a "wave source" within the scope of this invention. More particularly, the "wave source" collectively refers to portions of the EMC system irradiating such harmful waves, whereas the "base unit" specifically refers only to the portions of the "wave source" which are directly responsible for irradiating the harmful waves and/or affecting propagation paths of such harmful waves. For example, a stand-alone transformer and/or a transformer of any electric or electronic device are the "wave source," while their "base units" include the primary coils, secondary coils, and cores. In contrary, exterior cases and various couplers are portions of the "wave source" but not portions of the "base unit," for the cases and/or couplers neither irradiate the harmful waves nor affect the propagation paths thereof. Therefore, a shape of the "wave source" may generally be different from a shape of the "base unit," where the "base unit" may have the shape simpler or more complex than that of the "wave source." However, the "base unit" may be deemed as a subset of the "wave source" and, therefore, such a "base unit" almost always defines a size which is smaller than or at most equal to that of the "wave source."

As used herein, the term "configuration" collectively refers a shape, size, and/or arrangement, while the term "disposition" collectively includes orientation, alignment, and/or distance. Accordingly, the "configuration" of the (counter or base) unit may refer to the shape of the unit, the size of the unit, and/or arrangement of the unit with respect to the other of the base and counter units. Similarly, the "disposition" of the unit may refer to the orientation and/or alignment of such a unit with respect to the other of the base and counter units, to the target space, to a direction of propagation of the harmful or counter waves, to a direction of the electric current flowing in or voltage applied across such a unit or the other of the base and counter units, and the like. The "disposition" of the unit may also refer to the distance to the other of the base and counter units therefrom, to the target space, and the like. When the system include multiple counter units, the "disposition" thereof may include the distance between at least two of such counter units.

Within the scope of the present invention, the term "wire" collectively refers to an article with a shape of a wire, a fiber, a filament, a rod, and/or a strand, and shapes of any other similarly elongated articles each of which may be straight or curved (i.e., curvilinear), and each of which may be formed into a loop, a coil, a roll, a spiral, a mesh, and the like. The term "strip" collectively refers to an article with a shape of a strip, a bar, a pad, and/or a tape, and shapes of any other planar or curved articles with large aspect ratios (i.e., ratios of lengths to widths or heights), each of which may be arranged straight or curved, each of which may be arranged in a two- or three-dimensional configuration, each of which may be arranged into a loop, a coil, a roll, a spiral, a mesh, and the like. In addition, the term "sheet" collectively refers to an article with a shape of a sheet, a slab, a foil, a film, a plate, and/or a layer, and shapes of any other articles which are wider than the "strip," each of which may be planar (i.e., two-dimensional or 2-D) or curved (i.e., three-dimensional or 3-D), each of which may be formed in a segment, a roll, and the like. The term "tube" collectively refers to an article which may define any of the shapes described hereinabove and to be described hereinafter and forming at least one lumen therethrough. Such a "tube" may be arranged straight or curved, may be arranged into a loop, a coil, a roll, a spiral, a mesh, and the like. The term "coil" collectively refers to an article defining a shape of a helix and/or a spring, and shapes of any other articles winding around an object along a longitudinal or short axis of such an object at a constant distance from the object, and the like. The "coil" may be arranged straight or curved, may also be arranged into a loop (such as a toroid), a coil, a roll, a spiral, a mesh, and the like. The term "spiral"

collectively refers to an article defining a shape of another helix and/or spring which may, however, expand or shrink along the longitudinal oe short axis of an object, and shapes of any other articles winding around such an object at varying distances, and the like. It is appreciated that a planar "spiral" may be formed on a single curvilinear plane which is normal to the longitudinal or short axis of the object. The term "mesh" collectively refers to an article with a shape a mesh, a net, a screen, a quilt, a fabric, and/or a garment, and shapes of any other articles which may be formed into a networking structure, a woven structure, an interwoven structure, and the like. The term "bundle" collectively refers to an article defining a shape of two or more of the same or different elongated shapes which are aligned side by side or laterally in such a manner that a cross-section of the "bundle" or a "bundled article" may include at least two of such shapes therein. The term "braid" collectively refers to an article with a shape of two or more of the same of different elongated shapes which are braided in such a manner that the "braid" or a "braided article" may consist of at least two of such shapes in a cross-section normal to a longitudinal and/or short axis thereof, where examples of such articles may include, but not be limited to, a thread, a yarn, any other articles made by prior art braiding techniques, and the like. It is to be understood that at least a portion of each of such articles formed according to the above terms in this paragraph may be arranged to be solid, hollow or porous such as, e.g., a foam, a sponge, and the like. It is also appreciated that each of such articles formed according to the foregoing terms of this paragraph may be arranged to include (or define) at least one hole, gap or opening.

Similarly and as used herein, the term "mixture" collectively refers to a liquid, a solution, a sol, a gel, an emulsion, a suspension, a slurry, and/or a powder, each of which may include therein multiple particles, particulates, grains, granules, filings, fragments, and/or pellets each of which may also have shapes of spheres, ellipsoids, cylinders, flakes, "wires," "strips," and the like, and each of which may be in a range of millimeters, microns or nanometers. When appropriate, such a "mixture" may include at least one solvent, at least one chemically, electrically, and/or magnetically inert filler for the purpose of providing mechanical strength and/or integrity thereto, and so on.

In addition, the term "combination" refers to a collection of different shapes examples of which may include, but not be limited to, the above wire, strip, sheet, tube, coil, spiral, mesh, their braid, and their bundle. The term "array" similarly refers to the collection of such shapes. However, the "array" refers to the "collection" which in addition forms multiple holes or openings therethrough.

As used herein, a term "transformer" collectively refers to those prior art transformers and/or prior art electric and electronic devices including such prior art transformers, where examples of the prior art transformers may include, but not be limited to, step-up or step-down transformers, isolating transformers, variable transformers, autotransformers (i.e., those having a single winding or a single coil), polyphase transformers (i.e., those for three-phase line or input voltage), current transformers (such as, e.g., instrument transformers), voltage transformers (such as, e.g., potential transformers), resonant transformers (i.e., those operating at a resonant frequency of a transformer core or coils), pulse transformers (such as, e.g., those for transmitting rectangular pulses), RF transformers (i.e., transmission line transformers), speaker transformers, audio transformers, output transformers, and AC/DC adaptors for various prior art electric or electronic devices. The term "transformer" also refers to those prior art transformers including solid transformer cores, air cores, toroidal cores, and the like. Accordingly, a term "EMC transformer" collectively refers to any of these prior art transformers each of which includes therein at least one of various counter units described hereinabove and hereinafter. In addition, the term "EMC transformer" may also refer to any of these prior art transformers each of which includes at least one of various electric and/or magnetic shields which are described herein or which have been disclosed in the co-pending Applications.

As used herein, the terms "axial," "radial," and "angular" will be used in reference to a center axis of the system. Based thereupon, the term "axial direction" refers to a direction along the center axis of the system, while the term "radial direction" means another direction which is normal to such an "axial direction" and, therefore, which represents a direction extending away and outwardly from the center of the system. It is appreciated that such a "radial direction" may be other directions which extend away and outwardly from the center of the system and may be transverse but not necessarily perpendicular to the "axial direction." The term "angular direction" refers to another direction revolving about the "axial direction" in a clockwise or counterclockwise manner.

It is appreciated that definitions related to various electric and magnetic shields of this invention are similar to those as have been provided in the aforementioned co-pending Applications. Therefore, such definitions are deleted herein for simplicity of illustration.

Unless otherwise defined in the following specification, all technical and scientific terms used herein have the same meaning as commonly understood by one of ordinary skill in the art to which the present invention belongs. Although the methods or materials equivalent or similar to those described herein can be used in the practice or in the testing of the present invention, the suitable methods and materials are described below. All publications, patent applications, patents, and/or other references mentioned herein are incorporated by reference in their entirety. In case of any conflict, the present specification, including definitions, will control. In addition, the materials, methods, and examples are illustrative only and not intended to be limiting.

Other features and/or advantages of the present invention will be apparent from the following detailed description, and from the claims.

DETAILED DESCRIPTION OF THE PREFERRED EMBODIMENTS

Figure 1A:
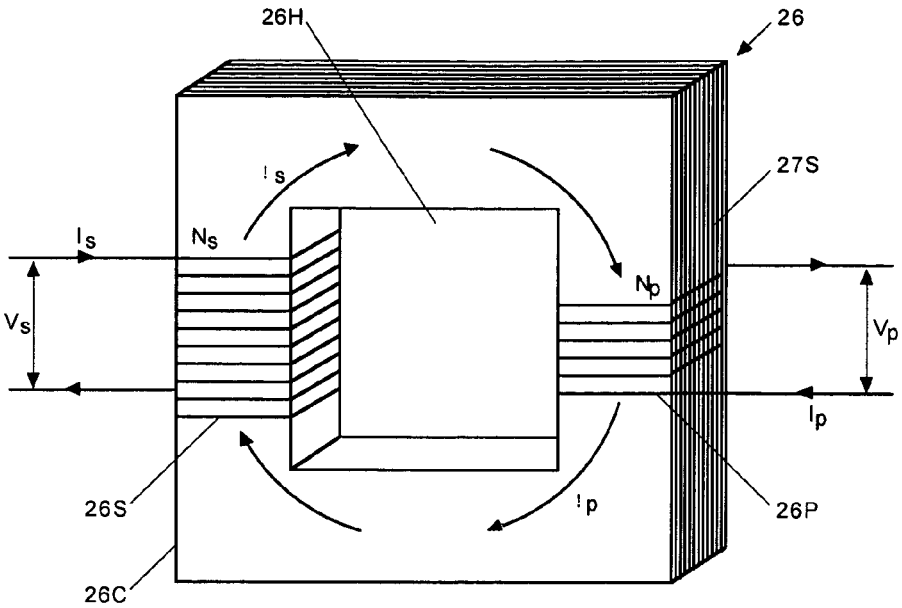
FIG. 1A (Prior Art)
FIGS. 1A and 1B are various views of a typical conventional transformer.

The present invention relates to an electromagnetically-countered system including at least one wave source irradiating harmful electromagnetic waves and at least one counter unit emitting counter electromagnetic waves for countering the harmful waves by the counter waves, e.g., by canceling at least a portion of the harmful waves by the counter waves, by suppressing the harmful waves from propagating to a target space, and the like. More particularly, the present invention relates to generic counter units for electromagnetically-countered transformer systems and to various mechanisms for countering the harmful waves which are irradiated from various base units of the wave sources with the counter waves emitted from the counter units. To this end, the counter unit may be shaped, sized, and/or arranged to match its configuration with a configuration of at least one of the base units of the wave source, thereby emitting the counter waves which automatically match characteristics of such harmful waves. In the alternative, the counter unit may instead be shaped, sized, and/or disposed in an arrangement defined along one or multiple wavefronts of such harmful waves, thereby emitting the counter waves automatically matching characteristics of such harmful waves. The present invention also relates to the counter unit which is provided as an analog of at least one of the base units of the wave source, where the analog may approximate or simplify at least one of such base units which is more complex than the counter unit, where the two- or one-dimensional analog may also approximate at least one of the three- or two-dimensional base units, and the like. The present invention relates to multiple counter units which are simpler than the base units but rather disposed in an arrangement for approximating the shape and/or arrangement of at least one of the base units. The present invention also relates to the counter unit which may be shaped and/or sized according to the configuration of at least one of the base units and disposition thereof. In addition, the present invention relates to various countering modes in which a single counter unit may counter a single base unit, may counter at least two but not all of multiple base units or may counter all of multiple base units, in which multiple counter units may counter a single base unit, may counter more base units or may counter less multiple units. The present invention relates to various electric and/or magnetic shields which may be used alone or in conjunction with the counter units to minimize irradiation of the harmful waves from the system.

The present invention also relates to various methods of countering the harmful waves by the counter waves by such source matching or wave matching, where the harmful waves are irradiated from various base units of at least one wave source of an electromagnetically-countered transformer system which also includes at least one counter unit emitting such counter waves. More particularly, the present invention relates to various methods of providing the counter unit as an analog of at least one of the base units and emitting the counter waves matching the harmful waves for the countering, various methods of approximating or simplifying at least one of such base units by the simpler counter unit for the countering, and various methods of approximating at least one of the base units by multiple simpler counter units. The present invention also relates to various methods of disposing the counter unit along at least one of the wavefronts of the harmful waves and emitting such counter waves for automatically matching such harmful wavefronts, various methods of disposing multiple counter units along at least one of the harmful wavefronts and emitting the counter waves by the counter units for automatically matching the harmful wavefronts, and the like. The present invention relates to various methods of manipulating the wavefronts of the counter waves by disposing the counter unit closer to or farther away from the target space with respect to at least one of the base units, various methods of controlling radii of curvature of such wavefronts of the counter waves by including one or multiple counter units emitting such counter waves of the same or opposite phase angles, various methods of adjusting the wavefronts of the counter waves by disposing one or multiple counter units defining the shapes similar to or different from the shapes of such base units, and the like. The present invention also relates to various methods of countering the harmful waves from one or multiple base units with the counter waves emitted by the single or multiple counter units. Accordingly, the present invention relates to various methods of emitting such counter waves from a single counter unit for the harmful waves irradiated by one or more base units, various methods of emitting such counter waves by two or more counter units for the harmful waves irradiated by a single or multiple base units, and the like. In addition, the present invention relates to various methods of minimizing irradiation of such harmful waves by incorporating such electric shields, by incorporating the magnetic shields, by incorporating one or both of such shields in conjunction with the above counter units, and the like.

The present invention further relates to various processes for providing electromagnetically-countered transformer systems each of which includes at least one wave source with various base units irradiating the harmful waves and includes at least one counter unit emitting the counter waves capable of countering such harmful waves. More particularly, the present invention relates to various processes for providing the counter units to emit the counter waves defining the wavefronts similar to (or different from) the configurations of the counter units, various processes for providing the counter units as such analogs for at least one of the base units, various processes for providing the counter units emitting the counter waves defining the similar or opposite phase angles, various processes for providing the counter units emitting the counter waves defining the wavefronts shaped similar to the harmful waves, various processes for disposing the counter units based upon a preset arrangement and emitting therefrom the counter waves defining the wavefronts similar to the arrangement, and the like. The present invention relates to various processes for assigning a single counter unit to counter the harmful waves from a single base unit for local countering or to counter such waves by multiple base units for global countering, various processes for assigning multiple counter units to counter the harmful waves from a single base unit for the global countering, and to counter such harmful waves from multiple base units for the local or global countering depending upon numbers of the counter and base units, and the like. The present invention further relates to various processes for incorporating the electric and/or magnetic shields for minimizing the irradiation of such harmful waves, and various processes for minimizing the irradiation of such harmful waves by employing such shields as well as the above counter units.

The basic principle of the counter units of the generic EMC transformer systems of the present invention is to emit the counter waves which form the wavefronts similar (or identical) to those of the harmful waves but define the phase angles at least partially opposite to those of such harmful waves. Therefore, by propagating the counter waves to the target space, the counter waves can effectively counter such harmful waves in the target space by, e.g., canceling at least a portion of such harmful waves therein and/or suppressing the harmful waves from propagating theretoward. To this end, the counter units are arranged to emit the counter waves which define the wavefronts matching those of the harmful waves by various mechanisms. In one example, such counter units are shaped similar (or identical) to at least one of such base units of the waves sources, or arranged similar (or identical) to at least one of such base units and, therefore, emit the counter waves which can counter the harmful waves in the target space. In another example, such counter units are disposed along one or more of the wavefronts of the harmful waves and emit the counter waves similar (or identical) to the harmful waves and, accordingly, counter the harmful waves in the target space. In these two examples, the counter units are to emit the counter waves with the wavefronts which are similar (or identical) to the shapes of the counter units themselves, and the counter waves define the phase angles which are at least partially opposite to the phase angles of the harmful waves. In another example, such counter units are shaped differently from at least one of the base units, but are disposed in an arrangement in which the counter waves emitted thereby match such harmful waves in the target space. In another example, the counter units are disposed across different wavefronts of the harmful waves but are to emit the counter waves which are similar (or identical) to the harmful waves and, therefore, counter the harmful waves in the target space. In the last two examples, the counter units may be arranged to emit the counter waves with the wavefronts may or may not be similar (or identical) to the shapes of the counter units themselves, while the counter waves are to define the phase angles which are at least partially opposite to those of the harmful waves.

The basic principle of the counter units of various EMC systems may also be applied to various conventional devices. For example, the counter units may be included in any base units of electrically conductive wires, coils, and/or sheets or, in the alternative, into any electrically semiconductive and/or insulative wires, coils, and/or sheets for minimizing the irradiation of the harmful waves by countering such harmful waves by the counter waves, e.g., by canceling at least a portion of the harmful waves in the target space and/or suppressing the harmful waves from propagating toward the target space, where the counter units may be made of and/or include at least one electrically conductive, insulative or semiconductive material. The counter units may be implemented into any of such base units which define the shapes which may be formed by incorporating one or multiple wires, coils, and/or sheets, by modifying the shapes of one or multiple wires, coils, and/or sheets, where a few examples of the modified shapes may include a solenoid and toroid each formed by modifying the shape of such a coil. Therefore, such counter units may be implemented into various prior art transformers which include therein at least two coils, and any prior art devices such as, e.g., step-up or step-down transformers, isolating transformers, variable transformers, autotransformers, polyphase transformers, current and voltage transformers, resonant transformers, pulse transformers, RF transformers, AC/DC adaptors for various electric or electronic devices, and the like, and such transformers and/or adaptors may be converted into the EMC transformers and/or adaptors.

It is appreciated that various counter units of the generic EMC systems of this invention may be incorporated into any electrical and/or electronic devices each of which may include at least one base unit and, accordingly, may irradiate the harmful waves including electric waves (to be abbreviated as "EWs" hereinafter) and magnetic waves (to be abbreviated as "MWs" hereinafter) having frequencies of about 50 to 60 Hz and/or other EWs and MWs of higher frequencies. It is also appreciated that the generic EMC systems of this invention may also be incorporated into any portable or stationary electric and/or electronic devices which include at least one base unit detailed examples of which have been provided heretofore and will be provided hereinafter. It is further appreciated that such counter units may be provided in a micron-scale and incorporated to semiconductor chips and circuits such as LSI and VLSI devices and that such counter units may be provided in a nano-scale and incorporated into various nano devices including at least one base unit which in this case may be a single molecule or a compound or may be a cluster of multiple molecules or compounds.

Various system, method, and process aspects of such EMC transformer systems and various embodiments thereof are now enumerated. It is to be understood, however, that following system, method, and/or process aspects of this invention may be embodied in many other different forms and, accordingly, should not be limited to such aspects and/or their embodiments which are to be set forth herein. Rather, various exemplary aspects and their embodiments described hereinafter are provided such that this disclosure will be thorough and complete, and fully convey the scope of this invention to one of ordinary skill in the relevant art.

Unless otherwise specified, it is to be understood that various members, units, elements, and parts of various systems of the present invention are not typically drawn to scales and/or proportions for ease of illustration. It is also to be understood that such members, units, elements, and/or parts of various systems of this invention designated by the same numerals may typically represent the same, similar, and/or functionally equivalent members, units, elements, and/or parts thereof, respectively.

Figure 1B:
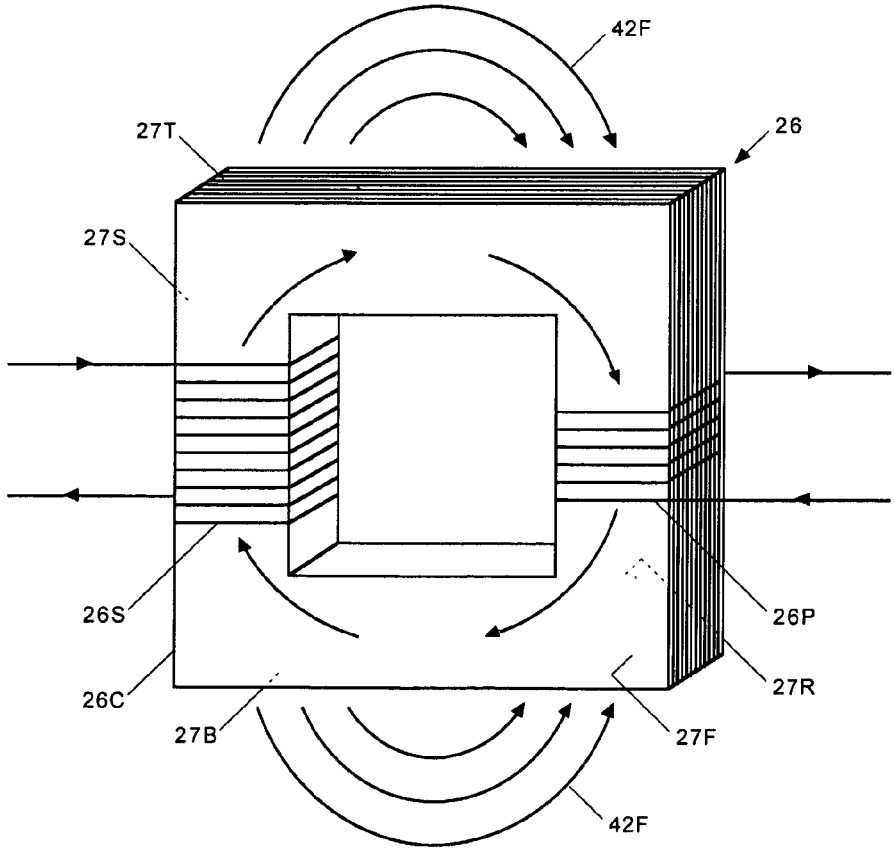
FIG. 1B (Prior Art)

FIGS. 1A and 1B are perspective views of a typical conventional transformer, where FIG. 1A shows operational variables of the prior art transformer, while FIG. 1B shows electromagnetic fields formed around the prior art transformer. As described in FIG. 1A, a transformer 26 generally includes a transformer core 26C and a pair of coils (or windings) one of which forms a primary coil 26P, while another of which forms a secondary coil 26S. Each layer or laminates of the transformer core 26C is shaped as an annular square (or rectangular) sheet of silicon steel, where the layers are aligned with each other while defining a hole 26H in the core 26C and forming four sides therealong. Because the steel layers are conductive, each layer is electrically insulated from its adjacent layers to reduce loss of electric energy due to heating of the core 26C by eddy current. The primary coil 26P is then wound around one side 27S of the core 26C along a preset direction, while the secondary coil 26S is wound around an opposite side 27S of the core 26C along another preset direction. It is appreciated that the directions of winding of the coils 26P, 26S may be identical or opposite depending upon directions of electric energy (i.e., electric voltage and/or current) supplied to or induced in such coils 26P, 26S. In the embodiment of FIGS. 1A and 1B, the primary and secondary coils 26P, 26S are wound in opposite directions and the electric currents flow therein in the same directions. Such primary and secondary coils 26P, 26S are wound around the core 26C in different number of turns, where the embodiment of FIGS. 1A and 1B show an example of a step-up transformer in which the primary coil 26P is wound in a less number of turns than the secondary coil 26S.

In operation, the rectangular transformer 26C is provided, a wire is wound about one side 26S thereof by an $N_P$ number of turns to form the primary coil 26P, while another wire is wound around an opposing side 26S thereof by an $N_S$ number of turns to provide the secondary coil 26S. When a time-varying voltage, $V_P$, is applied to the primary winding 26P, the current flows therein while producing a magnetomotive force which drives a time-varying magnetic flux, $\Phi_P$, through a magnetic circuit defined along such a transformer core 26C. In opposition thereto, the secondary coil 26S induces the electric voltage, $V_S$, and produces a back magnetomotive force which drives a time-varying magnetic flux, $\Phi_S$, through the magnetic circuit as well along the same direction. That is, the primary and secondary coils 26P, 26S couple with each other by a mutual induction, where the electric energy is coupled between a pairing of the time-varying magnetic fluxes, $\Phi_P$ and $\Phi_S$, through both coils 26P, 26S.

In accordance with the Faraday's law of induction, the electric voltage, $V_P$, induced across the primary coil 26P is proportional to a rate of change of the magnetic flux, $\Phi_P$, therealong, while another electric voltage, $V_S$, induced across the secondary coil 26S is also proportional to a rate of change of the magnetic flux, $\Phi_S$, therealong, as shown in Equations (1) and (2), respectively:

$$V_P = N_P \frac{d\phi_P}{dt} \tag{1}$$

$$V_S = N_S \frac{d\phi_S}{dt} \tag{2}$$

When the primary and secondary coils 26P, 26S are perfectly coupled with each other, the magnetic fluxes, $\Phi_P$ and $\Phi_S$, become identical to each other and, accordingly, a ratio of the current flowing in the primary coil 26P to that flowing in the secondary coil 26S is inversely proportional to a turns ratio:

$$\frac{V_P}{V_S} = \frac{N_P}{N_S} \tag{3}$$

This leads to the most common use of the prior art transformers, i.e., to convert the electric energy at one voltage into the energy at a different voltage by means of such primary and secondary coils 26P, 26S with different number of turns.

As described above, the electric currents flowing in the primary and secondary coils 26P, 26S generate such dynamic magnetic fluxes around the core 26C, and harmful electromagnetic waves (to be abbreviated as the "harmful waves" hereinafter) 42F are irradiated thereby due to the time-varying, dynamic nature of such magnetic fluxes. In the embodiment of FIGS. 1A and 1B, the primary coil 26P which is wound vertically along a right side 27S of the core 26C preferentially irradiates such harmful waves 42F downwardly through a bottom 27B of the core 26C, where such harmful waves 42F are rerouted to an adjacent end of the secondary coil 26S along the core 26C as the current flows in the direction indicated in the figures. The secondary coil 26S similarly irradiates such harmful waves 42F upwardly preferentially through a top 27T of the core 26C, where these harmful waves 42F are also rerouted to an adjacent end of the primary coil 26P when the current flows as indicated in the figures. Therefore, both of the primary and secondary coils 26P, 26C serve as the base units by irradiating the harmful waves 42F during these operations, while the transformer core 26C also serves as the base unit by rerouting the harmful waves 42F therealong. It is to be understood that both of the primary and secondary coils 26P, 26S operate as solenoids and, therefore, that an amount of such harmful waves 42F irradiated through a front 27F and rear 27R of the transmission core 26C is generally minimal or at most significantly less than that of such harmful waves 42F irradiated through the top 27T and bottom 27B of the core 26C.

In order to counter such harmful waves irradiated from various base units of the conventional transformers, various counter units are incorporated thereinto in order to emit counter electromagnetic waves (to be abbreviated as the "counter waves" hereinafter) and to also counter the harmful waves with the counter waves, e.g., by canceling at least a portion of the harmful waves with such counter waves, by suppressing the harmful waves from propagating toward a specific direction, and the like. Therefore, such conventional transformers incorporated with one or more of such counter units may then be converted into the EMC transformer systems (or EMC transformers) of this invention. Various counter units and their countering mechanisms therefor are now enumerated. It is to be understood, however, that following counter units and countering mechanisms of this invention may be embodied in many other different forms and, therefore, should not be limited only to such units and mechanisms which are to be set forth herein. Rather, various exemplary counter units and countering mechanisms described hereinafter are provided so that this disclosure is thorough and complete, and fully conveys the scope of the present invention to one of ordinary skill in the relevant art.

In a generic aspect of this invention, an EMC transformer system includes a transformer (i.e., the wave source) with multiple base units and includes at least one counter unit which is capable of emitting the counter waves and countering the harmful waves irradiated by the base units therewith. As described above, the wave source of the transformer always includes multiple base units which are the real sources of the harmful waves, i.e., irradiating the harmful waves, affecting propagation paths of the harmful waves while maintaining or altering amplitudes or phase angles of such harmful waves, and the like, where detailed examples of such base units may include, but not be limited to, a conductive and/or semiconductive article such as a wire, a strip, a plate, a ring thereof, a coil thereof, a spiral thereof, and a mesh thereof all of which irradiate such harmful waves when electric current flows therein, an insulative article such as a wire, a strip, a plate, a ring thereof, a coil thereof, a spiral thereof, and a mesh thereof all of which can not carry the electric current but irradiate such harmful waves as electric voltage is applied thereacross, a permanent magnet which can affect the direction, paths, and/or amplitudes of such harmful waves, and the like. The wave source also includes at least one optional part which mechanically supports or retains such base units but which neither irradiates the harmful waves nor affects the propagation paths of such harmful waves, where examples of the optional part may include, but not be limited to, a case (or case member) enclosing such base units, a protective cover, a coupler, any parts in which such current does not flow, any parts across which the voltage is not applied, and the like. In response thereto, such a counter unit is arranged to emit the counter waves capable of countering the counter waves by canceling the harmful waves and/or by suppressing the harmful waves from propagating along a specific direction. The counter unit may be arranged to counter the harmful waves in any direction from the base units of the wave source, e.g., above, below and around the base units. However, such an embodiment may be costly to implement, may not be feasible, and may not be necessary, particularly when the EMC transformer system is to be used in a specific orientation by an user who is to be protected from such harmful waves. In such a case, the counter unit is arranged to counter the harmful waves only around a specific target space (or area) which is generally defined between at least one (or all) of the base units and the user (or a specific body part thereof).

In order for the counter waves to counter (i.e., cancel and/or suppress) such harmful waves, there are a few prerequisite which the counter waves must satisfy. The first is the phase angles of the counter waves. In general, such counter waves preferably define the phase angles which are at least partially or substantially opposite to those of the harmful waves so that the counter waves may cancel and/or suppress the harmful waves when propagated to the target space from the same side as at least one (or all) of the base units. In the alternative, such counter waves may define the phase angles at least partially similar (or identical) to those of the harmful waves so that the counter waves cancel and/or suppress such harmful waves when propagated to the target space from an opposite side of the base unit. When the system includes multiple counter units, each counter unit may emit the counter waves having the same, similar or different phase angles. The next is the amplitudes of such counter waves. In contrary to the phase angles, such counter waves may define various amplitudes which, however, effectively counter the harmful waves in the target space. When disposed closer to such a target space than at least one (or all) of the base units, the counter unit has to emit the counter waves with the amplitudes less than those of the harmful waves. By the same token, the counter unit which is disposed farther from at least one (or all) of the base units has to emit the counter waves of the amplitudes greater than those of the harmful waves, while the counter unit disposed flush with at least one (or all) of the base units with respect to the target space only has to emit the counter waves with the similar or same amplitudes as the harmful waves. When the system includes multiple counter units, all counter units may be disposed at similar distances from at least one (or all) of the base units and/or target space or, alternatively, at least two of such counter units may be disposed at different distances from at least one (or all) of the base units and/or target space. In addition to such distances and/or dispositions of the counter unit, such counter waves may define various intensities depending upon whether the counter waves counter the harmful waves throughout the target space or only at a preset position in the target space. For example, the counter unit preferably emits the counter waves which are capable of countering the harmful waves throughout the target space as the user may be situated anywhere across the target space. When the user is to be situated only in a preset position of the target space, however, the counter unit may be shaped, sized, arranged, and then disposed to emit the counter waves which best counter the harmful waves in such a position but not in the same efficiency in other positions of the target space.

Once the counter unit is arranged to emit the counter waves defining proper phase angles and amplitudes, such a counter unit may be shaped, sized, arranged, and disposed in order to counter the harmful waves depending on detailed countering mechanisms.

In one example, the counter unit may be shaped, sized, and/or arranged similar (or identical) to at least one (or all) of the base units, where this mechanism will be referred to as a "source matching" hereinafter. The basic concept of the "source matching" is that the counter unit may emit the counter waves which define wavefronts similar to a configuration (i.e., a shape, a size, and an arrangement) of the counter unit and that the wavefronts of the counter waves automatically match wavefronts of the harmful waves, and the counter waves counter the harmful waves due to the similarity between the configurations of the counter and base units. When such a system includes multiple base units, a single counter unit may then be arranged to emit the counter waves capable of countering the harmful waves irradiated by one of such base units or countering a sum of the harmful waves irradiated by at least two or all of the base units. When such a system includes multiple counter units, they may emit the counter waves capable of countering the harmful waves emitted by only one or more of the base units. When the system includes multiple counter units and base units, the counter waves from each counter unit may counter the harmful waves which are irradiated by each of the base units, a sum of such counter waves from at least two counter units may counter the harmful waves from one of the base units, the counter waves from a single counter unit may counter a sum the harmful waves from at least two base units, a sum of the counter waves from all of such counter units may counter a sum of the harmful waves from all of such base units, and the like. It is preferred in this "source matching" that the counter unit emit the counter waves which define the wavefronts of the configuration similar to that of the counter unit. It is, however, possible that the counter unit emits the counter waves with the wavefronts of the configuration different from that of the counter unit, that such wavefronts of a sum of the counter waves emitted by multiple counter units may have the configuration different from the configuration of each counter unit or the arrangement of the counter units, and the like, as long as the counter waves may counter the harmful waves in the target space.

In another example, the counter unit may be disposed (i.e., oriented, aligned, and/or positioned) in such a manner that at least a portion of at least one wavefront of the counter waves may match at least a portion of at least one wavefront of the harmful waves, where this mechanism will be referred to as a "wave matching" hereinafter. The basic concept of the "wave matching" is that such counter waves may counter such harmful waves when the counter unit is disposed in a position for matching at least a portion of the wavefronts of the harmful waves with the wavefronts of the counter waves as far as the configuration of the counter unit may be adjusted to satisfy the "wave matching." When the system has multiple base units, a single counter unit may be arranged to emit such counter waves capable of matching and countering the harmful waves irradiated from one of the base units or, in the alternative, matching and countering a sum of the harmful waves irradiated from at least two (or all) of such base units. When such a system includes multiple counter units, the counter units may emit the counter waves capable of countering the harmful waves irradiated by only one or multiple base units. When the system includes multiple counter units and base units, such counter waves emitted by each counter unit may then counter such harmful waves irradiated by each base unit, a sum of the counter waves emitted by at least two counter units may counter the harmful waves irradiated by one of such base units, the counter waves from a single counter unit may counter a sum the harmful waves from at least two base units, a sum of the counter waves from all of such counter units may counter a sum of the harmful waves irradiated by all base units, and the like, as far as at least one of the wavefronts of the counter waves may match at least a portion of at least one wavefront of the harmful waves in the target space.

Various counter units constructed based on the source matching and/or wave matching are to be disclosed hereinafter. It is appreciated in the source matching that there does not exist any one-to-one correlations between the configuration of such a counter unit and the configuration of the counter waves emitted thereby. That is, the counter waves of certain configuration (or wave characteristics) may be obtained by a single counter unit which defines a certain shape and size and is provided in a certain arrangement, by another counter unit which defines a similar shape and size but is provided in another arrangement, by another counter unit which has a different shape and size but is provided in a similar arrangement, by at least two counter units defining preset shapes and sizes and provided in a preset arrangement, by the same number of counter units defining different shapes and/or sizes or in a different arrangement, by a different number of counter units defining similar shapes and/or sizes or in a similar arrangement. It is similarly appreciated in the above wave matching that there does not exist an one-to-one correlation between the disposition of the counter unit and the wavefronts of the counter waves emitted by the counter unit. In other words, the wavefronts with certain shapes may be obtained by a single counter unit which defines a certain configuration and is disposed in a certain position with respect to at least one (or all) of the base units and/or target space, by a single counter unit which defines a different configuration and which is disposed in another position, by at least two counter units which define preset configurations and which are disposed in preset positions, by the same number of counter units defining different configurations and disposed in different positions, by a different number of counter units which define different configurations and which are disposed in different positions, and the like. It is, accordingly, appreciated that the counter units may be embodied in many other different forms and should not be limited to the following aspects and their embodiments which are to be set forth herein. Rather, various exemplary aspects and/or embodiments described herein are provided so that this disclosure will be thorough and complete, and fully convey the scope of the present invention to one of ordinary skill in the relevant art.

In another aspect of the present invention, a single generic counter unit may be provided for a single generic base unit to counter the harmful waves from the base unit by the counter waves from the counter unit. FIGS. 2A to 2F show top schematic views of exemplary electromagnetic countering mechanisms in each of which a single counter unit emits the counter waves capable of countering the harmful waves which are irradiated from a single base unit of a single wave source according to the present invention, where the base unit is a point source in FIGS. 2A to 2C and 2F, while the base unit is an elongated source in FIGS. 2D and 2E. It is appreciated that these figures, however, may also be interpreted in different perspectives. For example, such figures may be interpreted as the top cross-sectional views, where the base units of FIGS. 2A to 2C and 2F are wires extending perpendicular to the sheet, and the base units of FIGS. 2D and 2E are strips or rectangular rods also extending normal to the sheet. In another example, the figures may be interpreted as sectional views of more complex articles, where the base units of FIGS. 2A to 2C and 2F may correspond to sections of coils, spirals, meshes, and the like, while the base units of FIGS. 2D and 2E may similarly correspond to sections of curvilinear rods or strips. It is also appreciated in these figures that such base units are enclosed in the wave sources which may be cases or other parts of such a system which do not irradiate such harmful waves. It is further appreciated in all of these figures that the EMC systems are disposed in such a way that the target space is formed to the right side of the counter and base units.

Figure 2A:
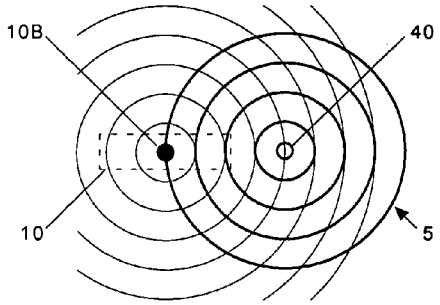
FIGS. 2A to 2F are top schematic views of exemplary electromagnetic countering mechanisms in each of which a single counter unit emits counter waves to counter harmful waves irradiated by a single base unit of a single wave source according to the present invention.
Figure 2D:
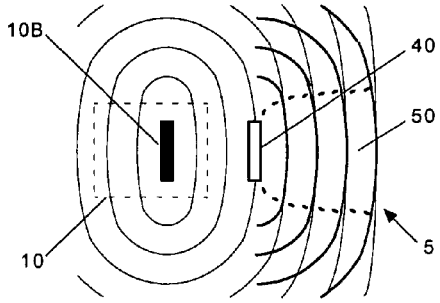

In one exemplary embodiment of such an aspect of the invention and as described in FIG. 2A, an EMC system 5 includes a single rectangular wave source 10 and a single counter unit 40, where the source 10 includes therein a single base unit 10B defining a shape of a point source. The counter unit 40 is similarly shaped as another point source and disposed to the right side of the base unit 10B. In this arrangement, the counter unit 40 emits the counter waves of which wavefronts are identical to those of the harmful waves irradiated by the base unit 10B. Because the counter unit 40 is disposed closer to a hypothetical target space on the right side of the figure, such counter wavefronts always define radii of curvature smaller than those of the harmful wavefronts. Accordingly, the counter unit 40 may counter (i.e., cancel or suppress) the harmful waves only along a line connecting the counter and base units 40, 10B or in its vicinity. It is appreciated that such an embodiment corresponds to the source matching which turns out to be ineffective due to a discrepancy in the radii of curvature of the wavefronts of the counter and harmful waves.

In another exemplary embodiment of this aspect of the invention and as depicted in FIG. 1B, an EMC system 5 includes a single counter unit 40 and a single rectangular wave source 10 with a single base unit 10B disposed therein. The base unit 10B is similar to that of FIG. 2A, however, the counter unit 40 is elongated, oriented vertically along its length, and disposed on the right side of the base unit 10B. Due to its elongated shape, the counter unit 40 emits the counter waves whose wavefronts are also elongated vertically and, therefore, define the radii of curvature which are greater than those of FIG. 2A and which match those of the harmful waves. Accordingly, such a counter unit 40 defines a target space 50 across which the counter waves counter the harmful waves to a preset extent. It is to be understood that such an embodiment corresponds to the wave matching mechanism in that the counter unit 40 is shaped similar to one of the harmful wavefronts.

Figure 2B:
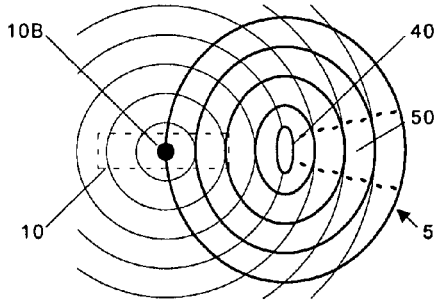
Figure 2E:
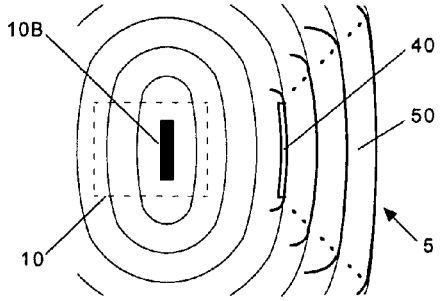
Figure 2C:
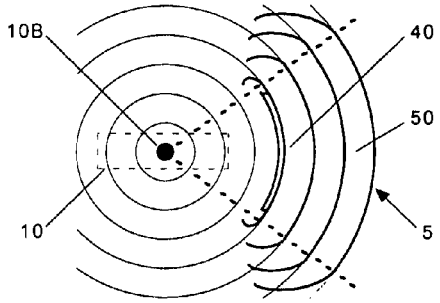

In another exemplary embodiment of this aspect of the invention and as depicted in FIG. 2C, an EMC system 5 includes a single counter unit 40 and a single rectangular wave source 10 with a single base unit 10B disposed therein. The base unit 10B is similar to that of FIG. 2A, however, the counter unit 40 is shaped and sized to conform to one wavefront of such harmful waves. That is, the counter unit 40 is shaped as an arc and disposed in an orientation concave to the right side of the figure or to the target space 50. Because of its arcuate shape, such a counter unit 40 emits the counter waves of which wavefronts are also arcuate and, therefore, define the radii of curvature which are similar or identical to those of the harmful waves. Therefore, the counter unit 40 defines a target space 50 across which the counter waves counter the harmful waves to a preset extent. It is appreciated that such an embodiment corresponds to another wave matching mechanism and that the counter waves emitted form this arcuate counter unit 40 better match such harmful wavefronts and define the target space 50 which expands over a wider angle around the base unit 10B than those of FIGS. 2A and 2B.

In another exemplary embodiment of this aspect of the invention and as depicted in FIG. 2D, an EMC system 5 includes a single counter unit 40 and a single rectangular wave source 10 with a single base unit 10B. Contrary to those of the above, this base unit 10B is rectangular and oriented vertically along its length or its long axis, and irradiates the harmful waves of which wavefronts define vertical and relatively straight portions which are attributed to the length or long axis of the base unit 10B. The counter unit 40 is shaped and sized similar or identical to the base unit 10B, and disposed in the same orientation as the base unit 10B. This orientation may be viewed to dispose the counter unit 40 along the vertical straight portions of the wavefronts of the harmful waves. The counter unit 40 also emits the counter waves whose wavefronts define vertical and relatively straight portions, similarly due to the length or long axis thereof. Because such portions of the counter wavefronts match those of the harmful wavefronts, the counter unit 40 forms the target space 40 to the right side. This embodiment corresponds to the source matching, wave matching or their combination. It is to be understood that the counter unit of FIG. 2A is shaped and sized as the base unit but ineffective due to a discrepancy in the radii of curvature between the wavefronts of the counter and source waves. The counter unit 40 of this embodiment is similarly shaped and sized as the base unit 10B but efficiently counter such harmful waves in the target space 50. The primary reason of this countering lies in the fact that both of the harmful and counter waves define along their wavefronts the vertical straight portions which generally do not depend upon the radii of curvature thereof. Otherwise, configuring the counter unit 40 similar to the base unit 10B and then disposing such a counter unit 10 between the base unit 10B and target space generally do not provide an efficient countering, where further details of this front arrangement are to be provided below. It is appreciated that such an embodiment corresponds to the source matching in which the counter unit 40 is shaped, sized, and/or arranged similar (or identical) to the base unit 10B.

In another exemplary embodiment of this aspect of the invention and as depicted in FIG. 2E, an EMC system 5 includes a single counter unit 40 and a single rectangular wave source 10 with a single base unit 10B which is similar to that shown in FIG. 2D. The counter unit 40, however, is shaped and sized to conform to one wavefront of such harmful waves. Similar to that of FIG. 2C, the counter unit 40 is shaped as an arc and disposed in an orientation concave to the right side of the figure or target space 50. Because of its arcuate shape, such a counter unit 40 emits such counter waves of which wavefronts are also arcuate and, therefore, define the radii of curvature which are similar or identical to those of the harmful waves, not only along their vertical straight portions but also along their curved portions, mainly due to the arcuate shape of the counter unit 40. Accordingly, such a counter unit 40 defines a target space 50 which also expands over a wide angle therearound and across which the counter waves effectively counter such harmful waves. It is to be understood that this embodiment corresponds to another wave matching mechanism.

Figure 2F:
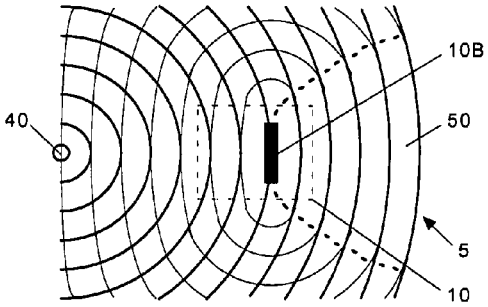

In another exemplary embodiment of this aspect of the invention and as depicted in FIG. 2F, an EMC system 5 includes a single counter unit 40 and a single rectangular wave source 10 which has a single base unit 10B therein. Both of the counter and base units 40, 10B are identical to those of FIG. 2A. However, the counter unit 40 is disposed on an opposite side of a target space 50 with respect to the base unit 10B and aligned with the base unit 10B as are the cases with the preceding figures. In this arrangement, the counter unit 40 emits the counter waves of which wavefronts are identical to those of the harmful waves irradiated by the base unit 10B. Because the counter unit 40 is disposed farther away from the target space 50, such counter wavefronts define the radii of curvature which approach and then match those of the harmful wavefronts when disposed at a proper distance from the base unit 10B. Accordingly, the counter unit 40 disposed in this rear arrangement may effectively counter the harmful waves and defines the target space 50 expanding over a wide angle around the base unit 10B. It is appreciated that the sole difference between the counter units of FIGS. 2A and 2F is their dispositions, i.e., one disposed in the "front arrangement" of FIG. 2A and another disposed in the "rear arrangement" of FIG. 2F. It is also appreciated that the rear arrangement is not necessarily superior to the front arrangement and that further details of selecting the proper arrangement are to be provided below. It is further appreciated that this embodiment corresponds to the wave matching in which the counter unit 40 is disposed at the position for matching the harmful wavefronts with the counter wavefronts.

Although not included in the figures, a single counter unit may be disposed in an arrangement flush with the base unit with respect to the target space, flush with a direction of propagation of the harmful waves, flush with another direction along which electric current flows in the base or counter unit, flush with another direction in which electric voltage is applied across the base or counter units, and so on. In this "lateral" arrangement, the radii of curvature of the counter wavefronts automatically match those of the harmful wavefronts and, therefore, the counter waves effectively match and then counter the harmful waves in the target space. For this arrangement, however, the wave source has to provide a space in which the counter unit may be incorporated. Therefore, the counter unit may be implemented inside the wave source and close to the base unit thereof when applicable. Otherwise, the counter unit may instead be disposed over, below or beside the wave source and as close to the base unit as possible. It is appreciated, however, that the counter unit disposed next to the base unit may propagate the counter waves onto the base unit and obstruct normal operation of the base unit. Accordingly, the lateral arrangement is preferably selected only when such an arrangement may not obstruct the normal operation of the base unit, wave source including such or EMC system including such. When the lateral arrangement does not affect the operation of the base unit but the counter unit may not be disposed close to the base unit due to space limitations, two or more counter units may be disposed on opposing sides (e.g., left and right, top and bottom, front and rear, and the like) of such a base unit and as close to the base unit as possible. Such counter units may also be arranged to emit the counter waves a sum of which may be symmetric or skewed toward a preset direction based on the wave characteristics of the harmful waves.

In another aspect of the present invention, multiple generic counter unit may be provided for a single generic base unit for countering the harmful waves irradiated by the base unit with the counter waves emitted by all of such counter units or emitted by at least two but not all of such counter units. FIGS. 2G to 2L are top schematic views of exemplary electromagnetic countering mechanisms in each of which multiple counter units emit counter waves to counter harmful waves irradiated from a single base unit of a single wave source according to the present invention, where the base unit is a point source in FIGS. 2G to 2K, while the base unit is an elongated source in FIG. 2L. It is appreciated that these figures, however, may also be interpreted in different perspectives. For example, such figures may be viewed as the top cross-sectional views, where the base units of FIGS. 2G to 2K are wires extending perpendicular to the sheet, and the base unit of FIG. 2L is a strip or a rectangular rod also extending normal to the sheet. In another example, the figures may be interpreted as sectional views of more complex articles, where the base units of FIGS. 2G to 2K may correspond to sections of coils, spirals, meshes, and the like, whereas the base unit of FIG. 2L may similarly correspond to sections of curvilinear rods or strips. It is also appreciated in these figures that such base units are enclosed in the wave sources which may be cases or other parts of such a system which do not irradiate such harmful waves. It is further appreciated in all of these figures that the EMC systems are disposed in such a way that the target space is formed to the right side of the counter and base units.

Figure 2G:
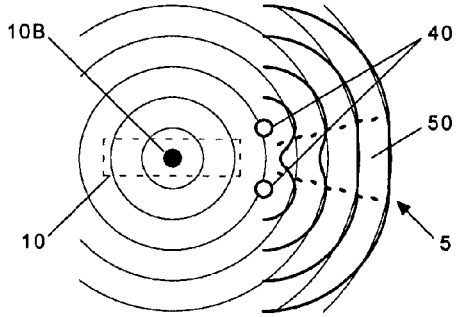
FIGS. 2G to 2L are top schematic views of exemplary electromagnetic countering mechanisms in each of which multiple counter units emit counter waves to counter harmful waves irradiated by a single base unit of a single wave source according to the present invention.
Figure 2J:
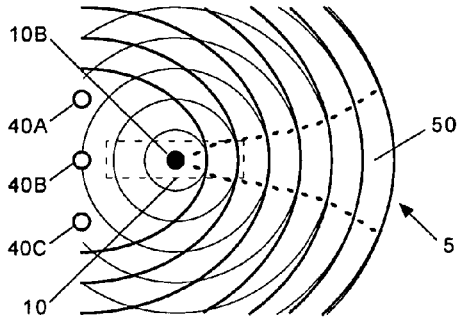

In one exemplary embodiment of such an aspect of the invention and as described in FIG. 2G, an EMC system 5 includes two counter units 40 and a single wave source 10 including a single base unit 10B. The base unit 10B is similar to those of FIGS. 2A to 2C, while a pair of counter units 40 are disposed between the base Ni 10B and a target space 50. Such counter units 40 are also disposed symmetric to the base unit 10B and flush with each other with respect thereto, i.e., the counter units 40 are disposed at an equal distance from the base unit 10B and/or target space 50. Such counter units 40 are arranged to emit the counter waves of the same phase angles so that the wavefronts of the counter waves from each counter unit 40 are superposed onto each other while increasing their amplitudes. As the counter waves propagate, their wavefronts which correspond to a sum of each set of wavefronts from each counter unit 40 increase their radii of curvature as if they are emitted by the elongated counter units of FIGS. 2B to 2E. Therefore, the counter wavefronts match the harmful wavefronts, and the pair of counter units 40 match and counter the base unit 10B while defining the target space 50 expanding over a limited angle therearound. It is to be understood that disposing two or more counter units 40 result in flattening the wavefronts of the counter waves and increasing the radii of curvature of the superposed portions of the counter wavefronts. It is further appreciated that this arrangement corresponds to the wave matching in which multiple counter units 40 are disposed along one wavefront of the harmful waves.

Figure 2H:
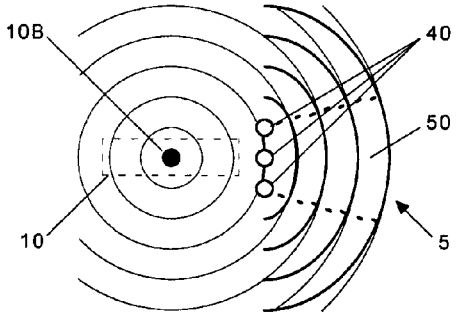
Figure 2K:
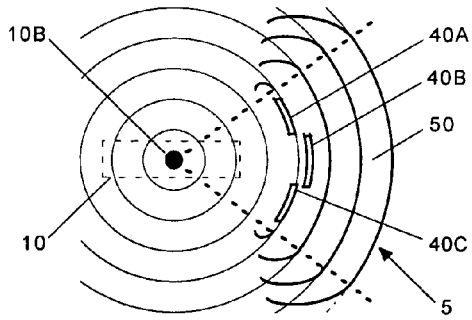

In another exemplary embodiment of this aspect of the invention and as depicted in FIG. 2H, an EMC system 5 includes three counter units 40 and a single wave source 10 enclosing therein a single base unit 10B. The base unit 10B is similar to those of FIGS. 2A to 2C, while the counter units 40 are similar to those of FIG. 2G such that all counter units 40 are disposed between the base unit 10B and target space 50 and flush with the base unit 10B. However, the system 5 includes one more counter unit 40 so that an array of three counter units 40 approximate the wavefronts of such harmful waves better than those of FIG. 2G. Accordingly, the counter units 40 emit the counter waves which better counter the base unit 10B and define the target space 50 expanding over a wider angle therearound than those of FIG. 2G. It is appreciated that disposing three counter units 40 result in further flattening the superposed wavefronts of the counter waves and also result in increasing the radii of curvature of such portions of the wavefronts of the counter waves. It is also appreciated that this arrangement is another wave matching where all three counter units 40 are disposed along one wavefront of the harmful waves.

Figure 2I:
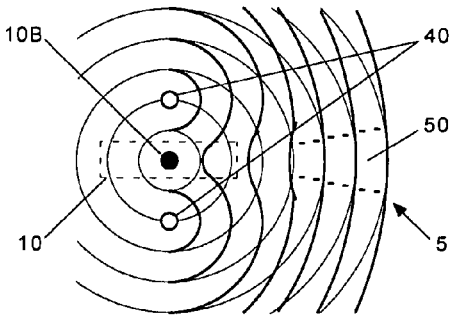
Figure 2L:
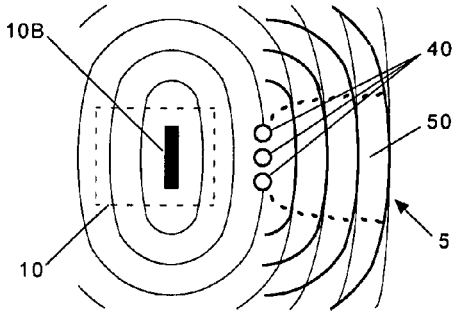

In another exemplary embodiment of this aspect of the invention and as depicted in FIG. 2I, an EMC system 5 includes two counter units 40 and a single wave source 10 including a single base unit 10B which is similar to those of FIGS. 2A to 2C. Two counter units 40 are disposed on opposite sides of the base unit 10B at an equal distance therefrom and also flush with the base unit 10B with respect to a target space 50. Similar to those of all of the preceding embodiments, such counter units 40 emit the counter waves defining the similar or identical phase angles so that the counter waves emitted by each of such counter units 40 superpose onto each other for not only increasing their amplitudes but also flattening the superposed portions of their wavefronts while increasing the radii of curvature of such wavefronts. Accordingly, the counter units 40 counter the harmful waves and define the target space 50 spanning around a rather limited angle therearound. It is appreciated that this arrangement is rather the source matching than the wave matching in that the counter units 40 are disposed in the symmetric arrangement and effect the elongated counter unit arranged flush with the base unit 10B.

In another exemplary embodiment of this aspect of the invention and as depicted in FIG. 2J, an EMC system 5 includes three counter units 40 and a single wave source 10 enclosing therein a single base unit 10B which is similar to those of FIGS. 2A to 2F. Contrary to those of FIG. 2H, three counter units 40 are disposed on an opposite side of a target space 50 with respect to the base unit 10B. The counter units 40 are arranged flush with each other relative to the base unit 10B and target space 50 and also spaced away from each other at an equal distance. Similar to those of FIGS. 2G to 2I, both of outer counter units 40A, 40C are arranged to emit the counter waves defining the phase angles at least partially opposite to those of the harmful waves so that superposed portions of the wavefronts of the counter waves are flattened while increasing their radii of curvature. Contrary to those of the preceding figures, a middle counter unit 40B is arranged to emit the counter waves defining the phase angles which are at least partially similar to those of such harmful waves and opposite to those of the counter waves emitted by the outer counter units 40A, 40C. Therefore, a net effect of incorporating the middle counter unit 40B is to sharpen the curvature of the superposed portions of the wavefronts of a sum of the counter waves and to define the target space 50 expanding around a narrower angle around the base unit 10B, as manifest in a comparison between the target spaces 50 of FIGS. 2F and 2J. That is, by incorporating multiple counter units 40A-40C emitting the counter waves of the phase angles opposite to each other, it is feasible to precisely manipulate the wavefronts of the sum of such counter waves and their radii of curvature for better matching the wavefronts of the harmful waves. It is appreciated that such an embodiment may corresponds to the source matching, wave matching or a combination thereof.

The counter units 40A-40C of this embodiment may be incorporated in different arrangements. For example, only two counter units may be included to emit the counter waves with opposite phase angles, where resulting wavefronts of the sum of the counter waves are not symmetric but skewed to one or an opposite side. In addition, the distances between the counter units may be manipulated to adjust the wavefronts of a sum of the counter waves regardless of the number of the counter units. Moreover, the counter units emitting the counter waves defining the phase angles similar to those of the harmful waves may be employed as the outer units to further sharpen the superposed portions of the counter waves.

In another exemplary embodiment of this aspect of the invention and as depicted in FIG. 2K, an EMC system 5 includes three counter units 40 and a single wave source 10 enclosing therein a single base unit 10B which is similar to those of FIGS. 2A to 2C. The counter units 40A-40C are also similar to those of FIG. 2H so that all of such counter units 40A-40C are disposed between the base unit 10B and target space 50 and similar to each other, that the counter units 40A-40C emit the counter waves of the same or similar phase angles, and so on. However, each counter unit 40A-40C is arranged to form an arcuate article shaped and sized to match a portion of a wavefront of the counter waves. In addition, both of upper and lower counter units 40A, 40C are spaced away from each other and also disposed along one wavefront of the harmful waves, whereas a middle counter unit 40B is disposed between the upper and lower counter units 40A, 40C and along an adjacent wavefront of the harmful waves in such a manner that superposed portions of the wavefronts of a sum of the counter waves are flattened while defining larger radii of curvature and match the wavefronts of the harmful waves, thereby forming a target space 50 which expands over a wide angle around the base unit 10B. It is to be understood that this arrangement is another wave matching where all three counter units 40A-40C are disposed along multiple wavefront of the harmful waves.

In another exemplary embodiment of this aspect of the invention and as depicted in FIG. 2L, an EMC system 5 includes three counter units 40 and a single wave source 10 enclosing therein a single base unit 10B. While the base unit 10B is similar to those of FIGS. 2D and 2E, the counter units 40 are similar to those of FIG. 2H and emit the counter waves which are flattened and define vertical straight portions therealong. Therefore, the counter waves match the vertical straight portions of the harmful waves and define a target space 50 similar to that of FIG. 2D. It is appreciated that this embodiment is another source matching in which three counter units 40 approximate the elongated base unit 10B.

In another aspect of the present invention, a single generic counter unit may also be provided for multiple generic base units for countering the harmful waves from such base units by the counter waves from the counter unit. In one example, such a counter unit may be arranged to counter a sum of the harmful waves irradiated by each base units, where detailed disposition of the counter unit may depend upon configurations and/or dispositions of the base units, amplitudes and/or directions of the harmful waves irradiated by such base units, and the like. Based thereupon, the counter unit may be disposed symmetrically to all or at least some of the base units, may be incorporated in the front, rear or lateral arrangement, and the like, where such arrangements are generally referred to an "global or overall countering" hereinafter. In another example, the counter unit is rather arranged to counter the harmful waves irradiated by only one of multiple base units, where such an arrangement is generally referred to as "local or individual countering" hereinafter. This local countering may only be effective when other uncountered base units irradiate negligible amounts of such harmful waves, when other uncountered base units irradiate non-negligible amounts of the harmful waves to other directions than the target space, and the like. Otherwise, it is preferred to manipulate the counter unit to counter the harmful waves of the uncountered base units, to include additional counter units for countering those harmful waves, and the like.

It is appreciated that various countering mechanisms described hereinabove for a single base unit may equally be applied to the system with multiple base units in the global countering mechanism. That is, the above countering mechanisms may be applied not to such harmful waves irradiated by the single base unit but to a sum of the harmful waves irradiated by multiple base units. When the system is to operate in the local countering mechanism, the aforementioned mechanisms may also be applied to each of multiple base units regardless of an exact number of such base units.

In another aspect of the present invention, multiple generic counter units may also be provided for multiple generic base units for countering the harmful waves from such base units by the counter waves from the counter units. In one example, multiple counter units are provided in the same number as the base units and each counter unit is arranged to counter only one of such base units in the local countering mechanism. Alternatively, at least one of such counter units may counter only one of such base units based upon the local countering mechanism, while at least one another of the counter units may counter at least two of the base units in the global countering mechanism. In another example, a less number of counter units are provided such that each counter unit is arranged to counter at least two of the base units based on the global countering mechanism, that at least one of the counter units counters one of the base units based on the local countering mechanism while at least one another of the counter units counters at least two of the base units in the global countering mechanism, and the like. In another example, a greater number of counter units are provided such that each base unit may be countered by at least two of the counter units, that at least one of the counter units counters one of the base units in the local countering mechanism and at least one another of the counter units may counter at least two of such base units in the global countering mechanism, and so on. In all of these examples, any of the above front, rear or lateral countering mechanisms may be used by the counter units, where such countering mechanisms may be same or different for each counter unit.

In another aspect of the present invention, various counter units may also be implemented into the base units of various devices and convert such devices to the EMC systems in which the harmful device EM waves irradiated by their base units may be countered (i.e., canceled and/or suppressed) by the counter waves emitted by their counter units.

In one exemplary embodiment of this aspect of the present invention, the counter units may be implemented into any base units shaped as electrically conductive wires, strips, sheets, tubes, coils, spirals, and/or meshes or, in the alternative, to any electrically semiconductive and/or insulative wires, strips, sheets, tubes, coils, spirals, and/or meshes for minimizing the irradiation of the harmful waves by countering such harmful waves by the counter waves, e.g., by canceling at least a portion of the harmful waves in the target space and/or suppressing the harmful waves from propagating to such a target space. Such counter units may be made of and/or include at least one material which may then be electrically conductive, insulative or semiconductive. The counter units may be implemented to any of the base units which have the shapes formed by one or multiple wires, strips, sheets, tubes, coils, spirals, and/or meshes, by modifying the shapes of one or multiple wires, strips, sheets, tubes, coils, spirals, and/or meshes, where a few examples of the modified shapes may be a solenoid and a toroid each formed by modifying the shape of the coil. In general, the counter units of this embodiment may be disposed in any of the foregoing arrangements and may counter the harmful waves by any of the foregoing mechanisms. Accordingly, a similarly or identically shaped and/or sized counter unit may be disposed lateral or side by side to one or more base units, may be axially, radially or angularly aligned with one or more base units, may enclose therein one or more base units, may be enclosed by one or more base units, may wind around one or more base units, may be wound by one or more base units, and the like, based on the source matching. In the alternative, a similarly or differently shaped and/or sized counter unit may be disposed along one or more wavefronts of the harmful waves irradiated by one or more base units for the wave matching. In addition, such counter units may be employed in a proper number and/or arrangement to counter the harmful waves according to the local countering or global countering.

In another exemplary embodiment of this aspect of the present invention, the counter units may also be implemented into any conventional electric and/or electronic elements such as, e.g., resistors, inductors, capacitors, diodes, transistors, amplifiers, and other signal processors and/or regulators in order to counter the harmful waves which are irradiated by the elements, where such electric and/or electronic elements function to manipulate at least one input signal supplied thereto and to produce at least one output signal at least partially different from the input signal. All of the above electric and/or electronic elements may qualify as the base units within the scope of the present invention when the unsteady current flows therein or when the unsteady voltage is applied thereacross. In addition, the above elements may also qualify as the base units within the scope of this invention when any of the elements produces the unsteady output signal (i.e., the electric current or voltage) in response to the input signal which may be steady or unsteady. Therefore, any of the above prior art elements and/or devices including such elements may be converted into the EMC elements by incorporating thereinto various counter units having any of the above configurations in any of the above dispositions and/or arrangements, thereby countering the harmful waves in any of the above mechanisms. It is noted that such counter units may be provided in any dimension so that such EMC elements may be provided in a range of microns or nanometers.

Configurational and/or operational variations of the EMC transformer systems and their counter units as well as configurational and/or operational modifications of the EMC systems and their counter units as exemplified in FIGS. 2A to 2L and as disclosed in the above aspects of this invention also fall within the scope of the present invention.

The EMC systems of the present invention are specifically intended to counter various harmful waves in a carrier frequency range or an extremely low frequency range from about 50 Hz to about 60 Hz or another frequency range of less than about 300 Hz. Therefore, in the preferred embodiment of this invention, various counter units of the EMC systems are arranged to emit the counter waves in the carrier frequency range or extremely low frequency range of from about 50 Hz to about 60 Hz or another frequency range of less than about 30 Hz, thereby effectively countering the harmful waves in the comparable frequency ranges. Considering various medical findings and/or presumptions that a main culprit of the EM waves are those in these frequency ranges, these counter units are believed to effectively eliminate those harmful frequency components from the harmful waves irradiated from the base units of various electric and electronic devices.

Although not preferred, various counter units of the EMC systems of the present invention may also be arranged to emit the counter waves in an ultra low frequency range of less than about 3 kHz, the counter waves in a very low frequency range of less than about 30 kHz, and the counter waves in a low frequency range of less than about 300 kHz for countering those harmful waves in the same or similar frequency ranges. The counter units may also be arranged emit the counter waves in other frequency ranges such as, e.g., the radio waves of frequencies which range from about $5\times10^2$ Hz to about $10^8$ Hz, microwaves of frequencies which range from about $10^8$ Hz to about $10^{12}$ Hz, and so on, in order to counter the harmful waves of similar frequency ranges. When desirable, the counter units may also be arranged to emit the counter waves defining higher frequencies such as, e.g., ultraviolet rays of frequencies ranging from about $7.5\times10^{14}$ Hz to about $10^{17}$ Hz, X-rays of frequencies ranging from about $7\times10^{18}$ Hz to about $10^{19}$ Hz, gamma rays in a frequency range beyond $5\times10^{18}$ Hz, and the like, for countering the harmful waves of similar frequency ranges.

Such counter units may further be arranged to selectively counter specific components of the harmful waves or, alternatively, to specifically preserve specific components of such harmful waves while countering (i.e., canceling and/or suppressing) the rest of the harmful waves. For example and particularly when the harmful waves include higher frequency components, the counter units may be specifically arranged to preserve beneficial waves such as, e.g., infrared rays including far infrared rays in a frequency range from about 300 gHz to about 10 tHz, medium infrared rays in a frequency range from about 10 tHz to about 100 tHz, near infrared rays in a frequency range from about 100 tHz to about 700 tHz, and the like, while countering the rest of the harmful waves including those of the carrier frequency range and extremely low frequency ranges. Conversely, the counter units may be arranged to emit the infrared rays including such far-, medium-, and/or near-infrared rays as well.

As described above, a typical EMC transformer system includes at least one wave source and at least one counter unit, where the wave source includes or encloses multiple base units therein and where the counter unit may include at least one optional electric connector such as a lead wire and at least one optional coupler for coupling the counter unit to other parts of the system. The EMC system may also include at least one optional case member which encloses at least a portion of at least one of the base units therein, at least a portion of the counter unit, and the like. In the alternative, an entire portion of the counter and/or base units may be exposed through or without the case member.

More specifically, the counter unit consists of various parts such as at least one body, at least one optional support, and at least one insert. The body of the counter unit qualitatively corresponds to the base units of the wave source in that the body is a sole component of such a counter unit which emits the counter waves when the electric current flows therein, when the electric voltage is applied thereacross, and the like. Therefore, such a body may preferably be made of and/or include at least one electric conductor when the electric current is to flow therein, may be made of and/or include any electrically conductive, semiconductive or insulative material when the electric voltage is to be applied thereacross, and the like. The support serves to mechanically support the above body and/or retain such a body therein for mechanical protection and/or electrical isolation. The insert is typically used to augment amplitudes of the counter waves, particularly when the counter unit includes at least one coil of conductive wire into which such an insert is disposed. The insert may be made of and/or include various magnetic materials such as, e.g., ferromagnetic materials, paramagnetic materials, diamagnetic materials, and ferrimagnetic materials, where the ferromagnetic materials are the preferred ones. It is appreciated that the counter unit is generally arranged to maintain its configuration while emitting such counter waves, where this fixed configuration may be embodied by forming the body of the counter unit of rigid materials, by fixedly coupling the body of the counter unit to the support, and so on. In the alternative, the counter unit may be arranged to change its shape while emitting such counter waves, where this variable configuration may be embodied by forming the body of the counter unit of elastic or deformable materials, by movably coupling the body of the counter unit to the support, and the like. It is appreciated that the counter unit emitting such counter waves is to be opposed by at least one of the base units irradiating the harmful waves of an opposite magnetic polarity. This counter unit tends to move while emitting the counter waves and, therefore, a special provision may be implemented as it is desirable to fix the counter unit during its operation.

The counter unit may be provided in various configurations which may refer to shapes, sizes, arrangements, and the like. In general, the configuration of the counter unit depends upon the above countering modes (such as the source matching and wave matching) and/or countering mechanisms (such as the front, rear or lateral arrangement, local or global matching, and the like) which generally depend on the configurational characteristics of the base units, wave characteristics of the harmful waves, and the like. In addition, the configuration of the counter unit also depends upon the shapes, sizes, orientation, and/or dispositions of the target spaces which are to be formed on one side of the counter unit.

The shape of the counter unit may be arranged to be identical to or similar to the shape of the base unit(s), where the counter unit is to be constructed to emit the counter waves which match the harmful waves automatically. The shape of the counter unit may instead be arranged to be different from the shape of the base unit(s), where the counter unit may be provided in other shapes, may be wound around the base unit(s), may enclose at least a portion of the base unit(s), may be enclosed by at least a portion of the base unit(s), and the like. The counter unit may define a shape of a wire, a strip, a sheet, a tube, a coil, a spiral, and/or a mesh, may define a combination of two or more of such shapes without defining any holes or openings therethrough, may define an array of two of more of such shapes while defining multiple holes and/or openings therethrough, and the like, where examples of the combinations and/or arrays may include, but not be limited to, a bundle including multiple identical or different shapes bundling each other, a braid of multiple identical or different shapes braided along each other, and the like. The counter unit may also be made of a mixture which includes at least two materials and which are also provided in any of the above shapes, combinations, and/or arrays. It is appreciated that the coil (including a solenoid or a toroid), the spiral, the mesh, and the arrays thereof may be particularly useful in the wave matching as will be described below. It is also appreciated that all of multiple counter units may define the same shape or that at least two but not all of such counter units may define the same shape. Alternatively, all of such counter units may define different shapes.

The counter unit may be shaped to conform to the base unit(s) and the counter waves by the counter unit better may match such harmful waves, where the counter unit may be conformed to the base unit(s) while approximating the base unit or providing details to the base unit. Alternatively, the counter unit may be shaped to not conform to the base unit(s) while manipulating the counter waves to match the harmful waves. This arrangement may be embodied when a single counter unit counters multiple base units or when multiple counter units counter a single base unit. It is appreciated in such an arrangement that the counter unit(s) may be provided with proper electrical energy (e.g., current or voltage) for emitting the counter waves capable of matching and countering the harmful waves in the target space. It is also appreciated that all of multiple counter units may conform to the base unit(s) or that at least two but not all of the counter units may conform to the base unit(s). In the alternative, all of the counter units may not conform to the base unit(s).

When one or multiple counter units are shaped similar or identical to one or multiple base units, the counter units are preferably arranged to approximate the base units. When the base unit forms a three-dimensional (or 3-D) shape, the counter unit may be constructed as a three-dimensional analog with a similar shape or simpler shape, a two-dimensional (or 2-D) analog or an one-dimensional (or 1-D) analog. When the base unit defines a 2-D shape, the counter unit may be fabricated as a 2-D of a similar or simpler shape or 1-D analog. When the base unit forms an 1-D shape, the counter unit may be provided as another 1-D analog defining a similar or simpler shape. When a single counter unit has to counter multiple base units, the counter unit may approximate only a major base unit as one of such analogs, may approximate at least two of such base units into one of the analogs, and the like. When multiple counter units counter a single base unit, each counter unit may approximate only a portion of the base unit. When multiple counter units are to counter multiple counter units, the counter units may approximate the base units into the analogs of the same dimension or into various analogs provided in different dimensions. It is appreciated that those analogs conform to the base units and, accordingly, that the analogs may define rather straight or curved shapes depending upon the shapes of the base units. It is also appreciated that the analogs preferably maintain similarity with the base units, where such similarity may be maintained in terms of lengths of such counter and base units, widths thereof, heights thereof, thicknesses thereof, diameters or radii thereof, radii of curvature thereof, numbers of revolutions or turns thereof, ratios of such lengths, ratios of such widths, ratios of such thicknesses or heights, ratios of such diameters or radii, ratios of such numbers, and the like. When a single base unit is countered by a single counter units, such configurational parameters are defined in each of the base and counter units. When a single counter unit counters multiple base units, such configurational parameters are defined in the counter unit, in an array of all of such base units, in an array of at least two but not all of such base units, and the like. When multiple counter units counter a single base unit, such configurational parameters are defined in the base unit, in an array of all of such counter units, in an array of at least two but not all of such counter units, and the like. When multiple counter units counter the same or different number of base units, such configurational parameters are also defined individually or in arrays as described above.

When the single or multiple counter units are shaped similar or identical to the single or multiple base units, the counter units are instead arranged to provide details to the base units, not in a sense of adding structures not existing in the base units but in a context of streamlining the wavefronts of the counter waves for the better purpose of matching the wavefronts of such counter waves with those of the harmful waves. For example, one or multiple small counter units may be disposed around (or inside) one or more major counter units for manipulating outer (or inner) edges of the wavefronts of a sum of the counter waves emitted by the major counter units. In another example, one or multiple small counter units may also be disposed closer to (or away from) one or more major counter units to manipulate the radii of curvature of the wavefronts of a sum of the counter waves which are emitted by the major counter units. Such small or minor counter units may be incorporated in various relations with respect to one or more major counter units for other purposes as well, as far as incorporation of such minor counter units may improve matching between the counter and harmful waves in the target space. Accordingly, when the system includes multiple counter units, all of the counter units may be arranged to approximate the base unit(s), all of such counter units may be arranged to provide details to the base unit(s), or some but not all of the counter units may approximate the base unit(s).

The counter unit may be arranged to define various cross-sections along a longitudinal or long axis thereof, its short axis which may be perpendicular or otherwise transverse to the long axis, and the like. In one example, the counter unit is arranged to define an uniform cross-section along at least one of such axes so that the counter waves emitted thereby also define the wavefronts defining the same shapes along such axes. In another example, the counter unit may be constructed to change its cross-section along at least one of such axes so that the counter waves emitted thereby also define the wavefronts varying their shapes along at least one of such axes. When the system has multiple counter units, all of such units may define the same shape or at least two of such counter units may define different shapes.

The counter unit may be arranged to have various sizes, where such a counter unit may emit the counter waves of proper amplitudes capable of effectively countering the harmful waves thereby. For example, the counter unit incorporated in the front arrangement may define a smaller size than the base unit due to its closer disposition toward the target space, whereas the counter unit incorporated in the rear arrangement may define a larger size than the base unit due to a greater distance toward the target space. However, the size of the counter unit may be determined by other factors such as, e.g., the shape of the counter unit, amplitudes of electric energy (i.e., electric current and/or voltage) supplied thereto, and the like. Therefore, the counter unit in the front arrangement may define a larger size than the base unit while emitting a less amount of the counter waves per an unit area, whereas the counter unit in the rear arrangement may define a smaller size than the base unit while emitting a greater amount of the counter waves per an unit area, and so on. That is, the size of the counter unit may be deemed as a secondary parameter which may be determined by other factors such as, e.g., the shape of the counter unit, amplitudes of the electric energy supplied thereto, distances to the base unit and/or target space, arrangement of the counter unit(s), orientation thereof, and the like.

The counter unit may be arranged to have various sizes along its longitudinal axis and/or short axis. In one example, the counter unit is arranged to define an uniform size along at least one of such axes so that the counter waves emitted thereby also define the wavefronts defining the same shapes along such axes, assuming that the same amount of the electric energy is supplied thereto. In another example, the counter unit may be constructed to change its size along at least one of the axes so that the counter waves emitted thereby also define the wavefronts varying their shapes along such axes. In addition, the counter unit may maintain the same size along at least one of such axes while varying its shapes therealong. When the system includes multiple counter units, such counter units may have the same size or at least two of such units may define different sizes.

Multiple counter units may also be incorporated in various arrangements, where such counter units are arranged to emit the counter waves capable of automatically matching such harmful waves due to the arrangement. In one example, such counter units may be incorporated into an arrangement which conform to the shape of a single base unit or conform to another arrangement of multiple base units such that the counter waves match the harmful waves in the target space. In another example, the counter units may be incorporated in an arrangement which does not conform to the shape of the single base unit or does not conform to the arrangement of multiple base units. This arrangement may be embodied when multiple counter units counter a single base unit or when multiple counter units are to counter a different number of multiple base units. It is appreciated in such an arrangement that the counter unit(s) may be provided with proper electrical energy (e.g., current or voltage) for emitting the counter waves which are capable of matching and countering the harmful waves in the target space. The counter units may be disposed in an arrangement symmetric to the base unit and/or target space so that the counter waves emitted thereby also match the symmetric harmful waves. Conversely, the counter units may also be disposed in an arrangement which is asymmetric to the base unit or target space such that the asymmetric counter waves counter the asymmetric harmful waves in the target space. The single counter unit or multiple counter units may be incorporated in an arrangement which encloses therein at least a portion of one or multiple base units. Conversely, the single counter unit or multiple counter units may be incorporated in another arrangement in which at least a portion of such a counter unit(s) may be enclosed by one or multiple base units. It is appreciated that the arrangement generally connotes a pattern of multiple counter units but that such an arrangement may also mean an orientation and/or alignment of a single counter unit.

The counter may also be provided in various dispositions which generally refer to orientations, alignments, distances, mobilities, and the like. In general, such disposition of the counter unit depends on such countering modes (such as the source matching or wave matching), countering mechanisms (such as the front, rear or lateral arrangement, local or global countering, and the like), configurations of the counter unit, and the like, each of which generally depend on the configurational characteristics of the base units, wave characteristics of the harmful waves, and so on. In addition, the dispositions of the counter unit also depend upon the shapes, sizes, orientation, and/or dispositions of the target spaces defined on one side of the counter unit. It is appreciated as rules of thumb that such counter unit(s) may be typically disposed closer to the base unit(s) in the local countering mechanism and that the counter unit(s) may be disposed away from the base unit(s) in the global countering mechanism.

The counter unit may be disposed in various orientations such that the counter waves emitted thereby may be properly oriented with and counter such harmful waves. In one example, the counter unit may be disposed in an orientation defined with respect to a direction of propagation of the harmful waves, e.g., by orienting its long axis normal to the direction of such propagation. In another example, the counter unit may be disposed in another orientation which is defined with respect to a direction of the electric current or voltage, e.g., by orienting its long axis parallel to, normal to or in a preset angle with respect to the direction of the electric energy. In another example, the counter unit may instead be disposed in another orientation which is defined with respect to the longitudinal and/or short axes of the base unit. It is appreciated that such orientations of the counter unit typically depend on other configurations of the base unit, particularly when such a base unit is arranged to irradiate the harmful waves in a direction different from at least one of its axes, different from a winding direction of its coil or other parts, and the like. When the system includes multiple counter units, all of such counter units may be disposed in the same orientation, each counter unit may be disposed in a different orientation, at least two but not all of the counter units may be disposed in the same orientation, and the like.

The counter unit may be disposed in various alignments such that the counter waves emitted thereby may be properly aligned with and counter such harmful waves. In one example, the counter unit may be aligned with one or more of the above directions and/or axes, may be wound in the same direction as the base unit, and the like. In another example, the counter unit may be misaligned with at least one of the above directions and/or axes, may be wound in a direction different from that of the base unit, and the like. When the system includes multiple counter units, all of such counter units may be aligned in the same direction and/or axis, each counter unit may be aligned in a different direction or axis, at least two but not all of such counter units may be aligned in the same direction or axis, and the like. When the system includes multiple counter units, all of such counter units may be disposed in the same alignment, each counter unit may be disposed in a different alignment, at least two but not all of the counter units may be aligned in the same orientation, and the like.

The counter unit may further be disposed in a lateral alignment, an axial alignment, a concentric alignment, and the like. In the lateral alignment, one or multiple counter units may be disposed side by side with respect to the base unit or between the base units along the long and/or short axes of such base unit(s). In the axial alignment, one or multiple counter units are disposed along a direction of one or more of such axes at a preset distance(s) from such base unit(s). In the concentric alignment, one or multiple counter units may be disposed inside the single base unit, may be surrounded with multiple base units, may enclose the single or multiple base units, and the like.

The counter unit may be disposed in various distances from the base unit and/or target space. In one example, such a counter unit may be fixedly coupled to the system at a preset distance from its base unit so as to emit the counter waves with the wavefronts matching those of the harmful waves. When desirable, the counter unit may receive variable electrical energy (i.e., current or voltage) such that the amplitudes of the counter waves may vary according thereto in order to counter the harmful waves of varying amplitudes, to define different target spaces, and the like. In another example, the counter unit may be movably coupled to the system and translate or rotate between two positions so as to emit the counter waves and dispose their wavefronts in different locations with respect to the harmful waves with or without varying the amplitudes of the counter waves. Therefore, the counter unit counters the harmful waves by the counter waves with the wavefronts of which characteristics vary according to the position of the counter unit with respect to the base unit and/or target space. In another example, the system may include therein multiple counter units and manipulate wave emitting operation of each of the counter units. By properly recruiting all or some of such counter units with or without manipulating the amplitudes of the counter waves emitted therefrom, the system may counter the harmful waves while defining the target space in various locations with respect to the base unit. When the system include multiple counter units, all of such units may be fixedly incorporated therein, all of such units may be movably incorporated therein, or at least two but not all of such units may be movable incorporated therein, and the like.

The disposition of the counter unit may be assessed in terms of the distances measured along the longitudinal axis of the base unit, along the short axis thereof, around at least one of the axes, and the like. The counter unit may be disposed closer to the target space than the base unit as in the front arrangement, farther away from the target space than the base unit as in the rear arrangement, flush with the target space as in the lateral arrangement, and the like. When the system includes multiple counter units, all of such units may be disposed in the same arrangement or at least two of such units may be disposed in different arrangements. In addition, all of the counter units may be disposed at an equal distance from the base unit or, alternatively, at least two of such counter units may be disposed at different distances therefrom. It is appreciated that the counter unit is preferably disposed on the same side of the base unit with respect to the target space. When the counter unit is disposed on an opposite side of the base unit with respect to the target space, however, the counter unit may still be able to counter the harmful waves, although such a disposition may not be the preferred embodiment.

The counter unit may be incorporated into various parts of the system and disposed in various exposures as well. When the system includes the case member, the counter unit may be disposed on or over an exterior surface of the case member, on or below an interior surface of the case member, embedded into the case member, and/or inside the case member. Such a counter unit may instead be disposed on or over an exterior surface of the wave source, on or below an interior surface of such a wave source, embedded between such surfaces of the wave source, inside the wave source, and the like. The counter unit may also be disposed on or over an exterior surface of the base unit, on or below an interior surface of the base unit, embedded between such surfaces of the base unit, inside the base unit, and the like. In addition, such a counter unit may be disposed and enclosed by at least a portion of the base unit. Similarly, at least a portion or an entire portion of the counter unit may also be exposed through the system, through the case member, through the wave source, through the base unit, and the like. Moreover, the counter unit may fixedly or movably couple with one or more existing parts of the system, wave source, and/or base unit or, in the alternative, may be coupled thereto by a coupler. Similarly, the counter unit may be spaced away from or may form an unitary article with such a system, wave source, and/or base unit.

The counter unit may be made of and./or include various materials in order to emit the counter waves having proper amplitudes in response to the electric energy supplied thereto and matching the harmful waves. In one example, the counter and base units may be made of and/or include the same materials so that such units may emit the same amount of the counter and harmful waves per an unit amount of such electric energy. In another example, the counter and base units may include at least one common material and at least one different material so that such units may emit the similar but not identical amount of the counter and harmful waves per the unit amount of the electric energy. In yet another example, the counter and base units may be made of and/or include different materials so that the counter and base units emit different amounts of waves per the unit amount of the electric energy. In general, various characteristics of the counter and base units determined by their compositions may be electric resistance or conductivity, magnetic permittivity, resonance frequency, and the like. Thus, the counter unit may be arranged to define the same, similar or different conductivity, permittivity, and resonance frequency based on its composition. An entire portion of the counter unit may be arranged to have an identical composition or, alternatively, various portions of the counter unit may be arranged to have different compositions which may vary along the long or short axis thereof. When the system includes multiple counter units, all of such counter units may have the same composition, at least two but not all of the counter units may have the same composition, or all of such counter units may have different compositions, thereby also maintaining or varying the above properties therealong.

As described hereinabove, precisely matching the phase angles (either opposite or similar) of the counter and harmful waves is a prerequisite for countering the harmful waves irradiated from the base unit by the counter waves emitted by the counter unit. This phase matching may be attained by supplying proper electric energy (i.e., electric current or voltage) to such base and counter units and optionally electrically coupling such counter and base units with each other. For illustration purposes, the electric energy supplied to the base unit is to be referred to as a "source energy" hereinafter, and the electric current and voltage of the "source energy" are to be referred to as "source current" and "source voltage" hereinafter, respectively. In one example, identical source current or voltage may be supplied to the base and counter units either sequentially or simultaneously so that such phase angles of the harmful and counter waves are properly synchronized. In another example, the counter unit is supplied with only a portion of the source current or voltage sequentially or simultaneously, where the phase angles of such harmful and counter waves are still synchronized as well. In another example, the base unit is first supplied with the source current or voltage, while the system thereafter modifies the amplitudes or directions of the source current or voltage and then supplies the modified current or voltage to the counter unit. As long as the phase angles of such source energy is maintained during modification, the counter and harmful waves are properly phase synchronized. In another example, the base unit is supplied with the source energy, and the system provides an analog of such source energy and supplies the analog energy to the counter unit with or without modifying the amplitudes and/or directions thereof, where such a system may employ various electronic components, circuits, and/or controllers to provide such an analog. As long as the phase angles of the electric energy is maintained in the analog energy, the counter and harmful waves are phase synchronized as well. In another example, the counter unit is electrically coupled to the base unit in a series mode, in a parallel mode or in a hybrid mode, where the counter unit is supplied with the source energy, modified source energy or analog energy as described above and where the counter unit may be supplied with such energy sequentially or simultaneously with the base unit. When the system includes multiple counter units, all of such counter units may be supplied with the same energy, at least two but not all of such units may be supplied with the same energy, each unit may be supplied with different energy, and the like. When the system includes multiple base units which are supplied with different source energies, the single counter unit may be supplied with only one of such energies, with a combination of at least two of such energies, and the like. When the system includes multiple counter units, such units may couple with the base unit by the same or different modes, may be supplied with the same or different energies sequentially or simultaneously, and the like. It is appreciated in all of the above examples that the phase matching also depends upon other configurations and/or dispositions of the counter unit so that a direction of winding of the counter unit, orientation of the counter unit, and/or alignment thereof may have to be considered to accomplish the proper phase matching.

Further details of such source and wave matching will be provided hereinafter. As described hereinabove, it has been understood in such a source matching that there does not exist any one-to-one correlations between the configuration of such a counter unit and the configuration of the counter waves emitted thereby. That is, the counter waves of certain configuration (or wave characteristics) may be obtained by a single counter unit which defines a certain shape and size and is provided in a certain arrangement, by another counter unit which defines a similar shape and size but is provided in another arrangement, by another counter unit which has a different shape and size but is provided in a similar arrangement, by at least two counter units defining preset shapes and sizes and provided in a preset arrangement, by the same number of counter units defining different shapes and/or sizes or in a different arrangement, by a different number of counter units defining similar shapes and/or sizes or in a similar arrangement. It has also been appreciated in such a wave matching that there does not exist an one-to-one correlation between the disposition of the counter unit and the wavefronts of the counter waves emitted by the counter unit. In other words, the wavefronts with certain shapes may be obtained by a single counter unit which defines a certain configuration and is disposed in a certain position with respect to the base unit and/or target space, by another single counter unit which forms another configuration and which is disposed in another position, by at least two counter units which have preset configurations and are disposed in preset positions, by the same number of counter units defining different configurations and disposed in different positions, by a different number of counter units which define different configurations and which are disposed in different positions, and the like. However, there are a few heuristic rules which may apply not only to the source matching but also to the wave matching. The first rule is that the counter unit disposed in the front arrangement preferably defines a characteristic dimension greater than that of the base unit when other things equal so as to increase the radii of curvature of the wavefronts of the counter waves and to attain better matching between the counter and harmful waves. The second rule is the reverse of the first rule and dictates that the counter unit disposed in the rear arrangement preferably has a characteristic dimension less than that of the base unit in order to decrease the radii of curvature of the wavefronts of the counter waves and to attain better matching between the counter and harmful waves. In order to match the amplitudes of the counter and harmful waves, however, the longer or wider counter unit in the front arrangement is arranged to emit the counter waves with the amplitudes less than those of the harmful waves. Similarly, the shorter or narrower counter unit in the rear arrangement is arranged to emit the counter waves defining the amplitudes greater than those of the harmful waves. The third rule is that disposing multiple counter units emitting the counter waves of the same or similar phase angles tends to flatten the wavefronts of a sum of the counter waves and to increase the radii of curvature of the wavefronts of the counter waves. The fourth rule is the reverse of the the third rule and dictates that disposing a less number of counter units tend to sharpen such wavefronts of the sum of the counter waves and to decrease the radii of curvature of the wavefronts of the counter waves. The fifth rule is that the wavefronts of the sum of the counter waves may be sharpened and the radii of curvature of such wavefronts may be decreased when at least one but not all of multiple counter units may be arranged to emit the counter waves with the phase angles opposite to those of other counter units. It is appreciated that these rules do not generally apply to the counter units emitting the counter waves with the wavefronts defining the shapes different from the shape of the counter unit, and that those rules do not generally apply to the counter units of the non-uniform emitting power either which will be described in greater detail below.

A main purpose of the source matching is to manipulate the configuration of the counter unit to match that of the base unit such that the counter waves emitted from the counter unit better match the harmful waves irradiated from the base unit. When a system preferentially depends upon the source matching to counter the harmful waves, its counter unit may preferably be disposed within a preset or reasonable distance from the base unit, for any advantages which may be obtainable by the similarly configured counter unit may be lost otherwise. It is to be understood that the source matching is most useful when the base unit has a simple or symmetric configuration or when it is reasonable feasible to construct a replica of a complex base unit. When the system includes a single wave source including multiple base units or includes multiple waves sources each including at least one base unit, the single counter unit may be arranged to attain the source matching with multiple base units or multiple counter units may be arranged to perform the source matching with multiple base units. The source matching may include a shape matching, a size matching, an arrangement matching, a disposition matching, an intensity matching, and other configurational matching.

Some details of the shape matching have been disclosed heretofore. For example, the counter unit may be formed as a 3-D (or bulk) analog which is a replica or an approximation of one or multiple 3-D base units, may be provided as a 2-D (or planar) analog which is an approximation of a single or multiple 3-D or 2-D base units or which is a replica of a single or multiple 2-D base units, may also be formed as an 1-D (or linear) analog which is an approximation of one or multiple 3-D, 2-D or 1-D base units or which is a replica of a single or multiple 1-D base units, and the like. Similarly, multiple counter units may be constructed as 3-D analogs which are the replica or approximation of one or multiple 3-D base units, may be formed as the 2-D analogs which are the approximation of one or multiple 3-D or 2-D base units or which are the replica of a single or multiple 2-D base units, may be provided as the 1-D analogs which are the approximation of a single or multiple 3-D, 2-D or 1-D base units or which are the replica of one or multiple 1-D base units, and the like. Such analogs may have continuous shapes or shapes with multiple holes or openings, may form solid shapes or deformable shapes, may define symmetric or asymmetric shapes, and the like. The shapes of the analogs may also be determined by the foregoing countering mechanisms or, conversely, such shapes may dictate the selection of other configurations of the analogs, proper countering mechanisms adopted thereby, and the like.

It is appreciated that the transformer includes various primary base units such as the primary coil, secondary coil, transformer core, and the like. When the counter unit is arranged to approximate only one of such base units, the counter unit may be shaped as a coil or an annular rectangular plate which approximates one of the base units and counters the harmful waves irradiated by only one of the base units. Two or more of such analogs may be disposed in various locations around the base units or, alternatively, may be mechanically and/or electrically coupled to each other, supplied with the electric energy in a preset pattern, and disposed in a preset location for countering the harmful waves irradiated by two or more of the base units. Such counter units may be provided as an unitary article which approximates two or more of such primary base units. For example, FIGS. 3A to 3L represent schematic perspective views of exemplary counter units each approximating multiple base units and also provided in various configurations in the source matching according to the present invention. It is to be understood in each of the figures that the counter unit is arranged to approximate an assembly of the primary coil, secondary coil, and core of the transformer. It is also appreciated in such figures that the base units are provided in gray but that various counter units approximating such base units are provided with the gray pattern.

Figure 3A:
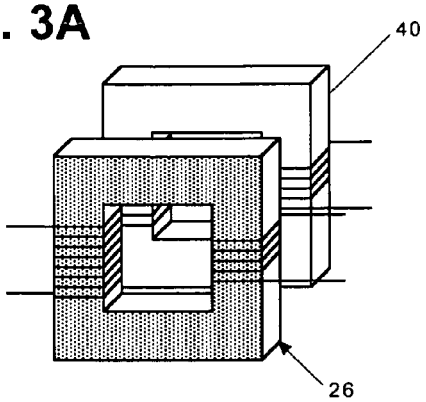
FIGS. 3A to 3L are schematic perspective views of exemplary counter units for approximating base units in various configurations in source matching according to the present invention.

In one example of FIG. 3A, a counter unit 40 is formed as a shape analog including a core and a pair of coils which are similar (or identical) to those of the transformer 26. In this embodiment, such an analog 40 may define a size which is also similar to that of the transformer 26, although the analog 40 may have a different size depending upon its disposition with respect to the target space and/or at least one of the base units as described hereinabove. The analog 40 may be made of and/or include the same material as the transformer 26 so that the analog 40 includes the core and coils made of the same materials as the transformer 26. In the alternative, the analog 40 may be made of and/or include at least one material which is not present in the transformer 26 so that the core or at least one of such coils may include such a different material. An entire portion of the analog 40 may also be made of the materials different from the transformer 26 as long as the analog 40 may emit the counter waves and counter the harmful waves irradiated by the transformer 26. It is appreciated that the arrangement of this figure corresponds to the lateral arrangement and, more specifically, a stacked arrangement. It is also appreciated that the counter unit 40 of this embodiment generally operates in the local countering mechanism in that each base unit of the transformer 26 is to be countered by a corresponding part of the analog 40.

Such an analog 40 provided in the shape matching may define a shape which is different from that of the transformer 26. For example, the analog 40 may form an annular sheet of a circle, an oval or other polygonal shapes, its center hole may define a different shape, the center hole with a similar (or different) shape may be provided not in the center of the analog 40 but in another portion thereof, and the like. The analog 40 may also define a size which is different from that of the transformer 26. For example, the core of the analog 40 may be thicker (or thinner) than that of the transformer 26, the center hole may be bigger (or smaller) than that of the transformer 26, the length and/or width of such an analog 40 may be longer (or shorter) than those of the transformer 26, and the like. In addition, the coils of the analog 40 may be wound in the same (or different) directions with respect to such coils of the transformer 26, wound at the same (or different) number of turns as such coils of the transformer 26, wound in the same (or different) pitch as the coils of the transformer 26, and the like. The coils of the analog 40 may be in the same (or different) arrangement of the coils of such a transformer 26 or, alternatively, an entire analog 40 may be in the same (or different) arrangement as the transformer 26. In addition, the analog 40 may be disposed at variable distances from the transformer 26, where the exact distance is determined by (or determines) the configurations and/or dispositions of the counter unit 40 and base units. As long as the analog 40 may emit the counter waves capable of countering the harmful waves, this analog 40 may define a suitable configuration which may be at least partially different from that of the transformer 26.

It is appreciated that such a counter unit 40 may be disposed as illustrated in the figure while forming the target space in various directions with respect thereto. For example, the counter unit 40 may emit the counter waves which preferentially match the harmful waves in its top (or bottom) and form the target space upwardly (or downwardly). The counter unit 40 may emit the counter waves which preferentially counter the harmful waves on its side, front or rear and define the target space on the side, front or rear thereof, respectively. To this end, the configuration and/or disposition of the counter unit 40 may be adjusted so as to manipulate the wave characteristics of the counter waves, the amplitudes and/or directions of the electric voltage and/or current supplied to the counter unit 40 may be controlled, at least a portion of the counter unit 40 may then be electrically coupled to at least a portion of the transformer 26, and the like.

Figure 3D:
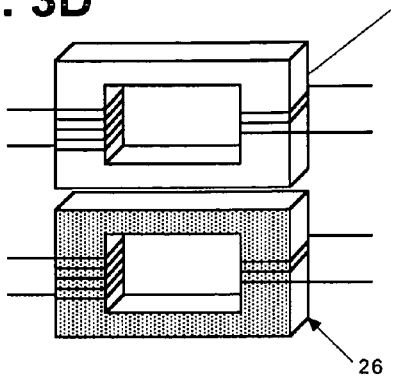
Figure 3B:
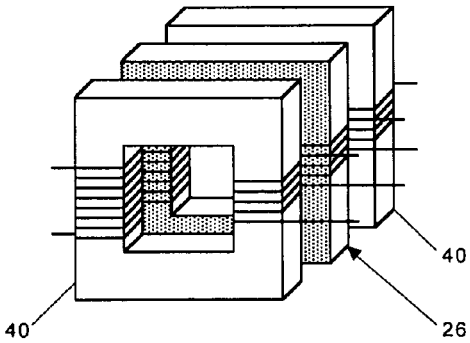

In another example of FIG. 3B, a system includes at least two counter units 40 each of which is fabricated as a shape analog similar to that of FIG. 3A, thereby including a core and a pair of coils which are similar (or identical) to those of the transformer 26. In this embodiment, each analog 40 may be identical to each other, and the analogs 40 are symmetrically disposed on the front and rear of the transformer 26 in the stacked arrangement and also aligned with each other. Therefore, the analogs 40 are provided with the same or different electric energy depending upon the desired location of the target space. When desirable, one or both of the analogs 40 may define the configurations different from the transformer 26, may be in different dispositions which are symmetric or asymmetric, may be spaced away from the transformer 26 in different distances, and the like, as far as the counter units 40 may emit the counter waves a sum of which may match and counter the harmful waves in such a target space which may also be defined along various directions with respect to the counter units 40. It is appreciated that the counter units 40 of this embodiment generally operate in the global countering mechanism, unless each of such counter units 40 is arranged to counter one or more but not all of the base units of such a transformer 26 in the local countering mechanism. Other configurational and/or operational characteristics of such counter units 40 of FIG. 3B are similar (or identical) to those of the counter unit of FIG. 3A.

Figure 3E:
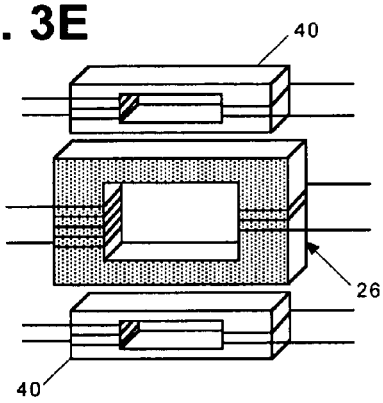
Figure 3C:
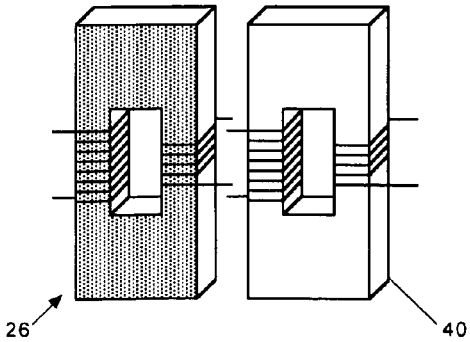

In another example of FIG. 3C, a counter unit 40 is fabricated as another shape analog similar (or identical) to that of FIG. 3A. The analog 40, however, is disposed and aligned to abut one side of the transformer 26 in another lateral arrangement and, more specifically, a side-by-side arrangement. Accordingly, the analog 40 is provided with the same or different electric energy depending upon the desired location of the target space. The analog 40 may be disposed closer to or farther away from the transformer 26, and may also be misaligned horizontally, vertically or angularly with respect to the transformer 26. In addition, such an analog 40 may also have a different configuration and/or may be in a different disposition, as long as the counter unit 40 emits the counter waves which is capable of matching and countering the harmful waves in the target space which may also be defined in various directions relative to the counter unit 40. It is appreciated that the counter unit 40 of this embodiment generally operates in the local countering mechanism in that each base unit of the transformer 26 is to be countered by a corresponding part of such an analog 40. Other configurational and/or operational characteristics of the counter unit 40 of FIG. 3C are similar (or identical) to those of such counter units shown in FIGS. 3A and 3B.

In another example of FIG. 3D, a counter unit 40 is fabricated as another shape analog similar (or identical) to that of FIG. 3A, except that the analog 40 is disposed over (or below) the transformer 26 in the vertical arrangement. In this embodiment, the analog 40 is disposed immediately over the top of the transformer 26 and aligned therewith for symmetrically countering such harmful waves. When desirable, the analog 40 may define a different configuration, may be in different disposition, may also be disposed in a different distance, as long as the counter unit 40 emits the counter waves which are capable of matching and then countering the harmful waves in the target space. It is appreciated that the counter unit 40 of this embodiment also operates in the local countering mechanism similar to those of FIGS. 3A and 3C. Other configurational and/or operational characteristics of the counter unit 40 of FIG. 3D are similar (or identical) to those of the counter units of FIGS. 3A to 3C.

Figure 3F:
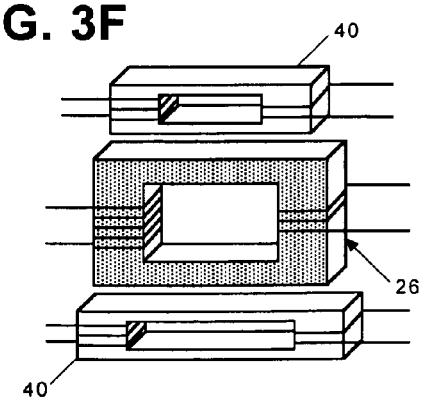

In other examples of FIGS. 3E and 3F, each system includes at least two counter unit 40 each of which is in turn provided as a shape analog similar to that of FIG. 3A, thereby also including a core and a pair of coils which are similar (or identical) to those of the transformer 26. In the embodiment of FIG. 3E, the analogs 40 are identical to each other, symmetrically disposed over the top and below the bottom of such a transformer 26 in the vertical arrangement, and also aligned with each other. In the embodiment of FIG. 3F, such analogs 40 are in the same symmetric, aligned, and vertical arrangement but different from each other such that the upper analog 40 is smaller than the transformer 26 but the lower analog 40 is larger than the transformer 26. When desirable, one or both of the analogs 40 may define the configurations different from the transformer 26, may be in different dispositions which are symmetric or asymmetric, may be spaced away from the transformer 26 in different distances, and so on, as far as the counter units 40 may emit the counter waves a sum of which matches and counters the harmful waves in the target space which may be defined along various directions with respect to the counter units 40 as well. It is appreciated that the counter units 40 of each of such embodiments generally operates in the global countering mechanism as is the case of FIG. 3B. Other configurational and/or operational characteristics of such counter units 40 of FIGS. 3E and 3F are similar (or identical) to those of the counter units of FIGS. 3A to 3D.

Figure 3G:
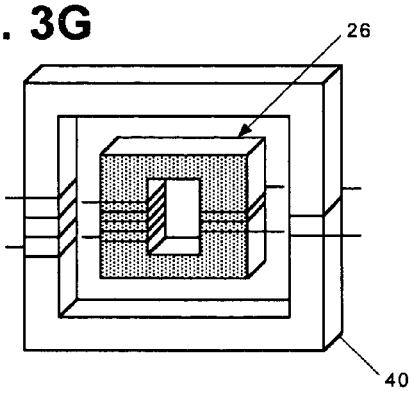
Figure 3J:
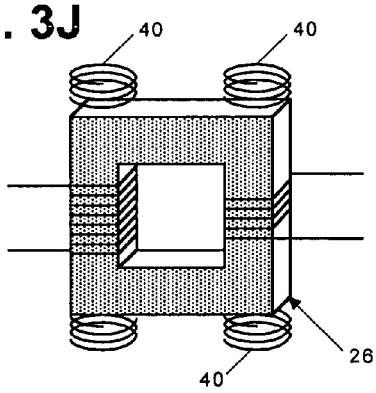
Figure 3H:
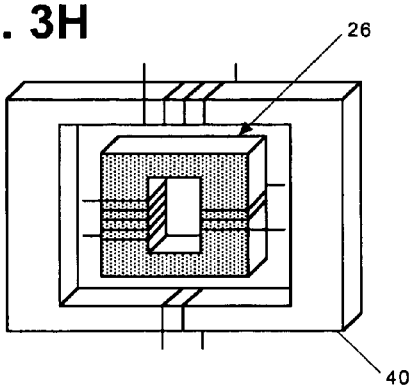

In other examples of FIGS. 3G and 3H, each counter unit 40 is formed as another shape analog similar (or identical) to that of FIG. 3A, thereby including a core and a pair of coils which are similar (or identical) to those of FIG. 3A. However, the core of each analog 40 is arranged to form a center hole which is larger than the transformer 26, where the transformer 26 is disposed inside the center hole of the analog 40 in the concentric arrangement. In the embodiment of FIG. 3G, the coils of the analog 40 are wound along the same sides as the transformer 26 so that all coils of the transformer 26 and counter unit 40 are wound vertically and counter each other in the target space typically defined over or below the analog 40. In the embodiment of FIG. 3H, however, such an analog 40 includes the coils wound around the top and bottom of its core horizontally. Therefore, the analog 40 emits the counter waves propagating in a direction different from that of the harmful waves but countering such harmful waves in the wave matching. When desirable, the analog 40 may have a configuration different from that of the core of the transformer 26, may be in a different symmetric or asymmetric disposition, may be disposed in a different distance from the transformer 26 and the like, as long as the counter unit 40 emits the counter waves which are capable of matching and countering the harmful waves in such a target space. It is appreciated that the counter unit 40 of such an embodiment typically operates in the local countering mechanism as well. Other configurational and/or operational characteristics of such counter units 40 of FIGS. 3G and 3H may be similar (or identical) to those of the counter units of FIGS. 3A to 3F.

Figure 3K:
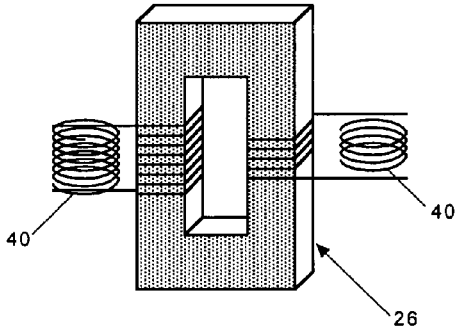
Figure 3I:
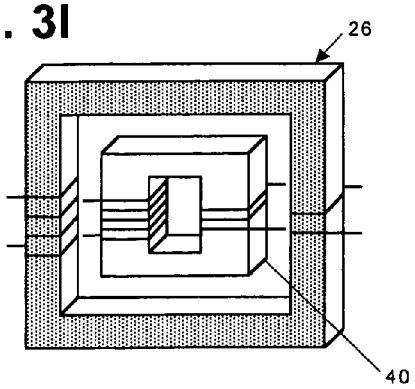

In another example of FIG. 3I, a counter unit 40 is fabricated as another shape analog which is similar to those of FIGS. 3F and 3G but forms a size smaller than the center hole of the transformer 26. Accordingly, the analog 40 is disposed symmetrically inside the center hole of the transformer 26 and aligned with the transformer 26. Similar to that of FIG. 3H, the analog 40 includes a pair of coils which are wound vertically and, therefore, counter the harmful waves from the coils of the transformer 26 in the target space defined thereover or therebelow. It is appreciated that the counter unit 40 of such an embodiment typically operates in the local countering mechanism as well. Other configurational and/or operational characteristics of the counter unit 40 of FIG. 3I may be similar (or identical) to those of the counter units of FIGS. 3A to 3H.

In another example of FIG. 3J, a system includes multiple counter units 40, where two of such counter units 40 are disposed over the top of the transformer 26, while other two counter units 40 are disposed below the bottom thereof. In this regard, each counter unit 40 is a shape analog of one half of each coil of the transformer 26 and such counter units 40 of this embodiment operate preferentially on the local countering mechanism. In addition, each counter unit 40 is disposed below or over each coil of the transformer 26 and aligned therewith. Accordingly, the counter waves emitted by each of the counter units 40 are arranged to counter the harmful waves irradiated by each end of the primary and secondary coils of the transformer 26. When desirable, the analogs 40 may have configurations different from those of such coils of the transformer 26, may be in different symmetric or asymmetric dispositions, may be disposed at different distances from such a transformer 26, and the like, as long as the counter unit 40 emits the counter waves capable of matching and then countering the harmful waves in the target space. Other configurational and/or operational characteristics of such counter units 40 of FIG. 3J may be similar (or identical) to those of the counter units of FIGS. 3A to 3I.

In another example of FIG. 3K, another system includes multiple counter units 40, where one of such units 40 is disposed lateral to the primary coil of the transformer 26, while another of the counter units 40 is disposed lateral to the secondary coil thereof. In this regard, each of the counter units 40 is a shape analog of each coil of such a transformer 26, and such counter units 40 of this embodiment operate preferentially in the local countering mechanism. Because the counter units 40 are disposed and then aligned with the coils of the transformer 26, the counter units 40 are arranged to counter the harmful waves irradiated from each coil of the transformer 26. When desirable, such analogs 40 may define configurations different from those of the coils of the transformer 26, may also be in different symmetric or asymmetric dispositions, may be placed at different distances from the transformer 26, and the like, as long as the counter units 40 emit the counter waves capable of canceling the harmful waves in such a target space. Other configurational and/or operational characteristics of the counter units of FIG. 3K are similar (or identical) to those of the counter units of FIGS. 3A to 3J.

Figure 3L:
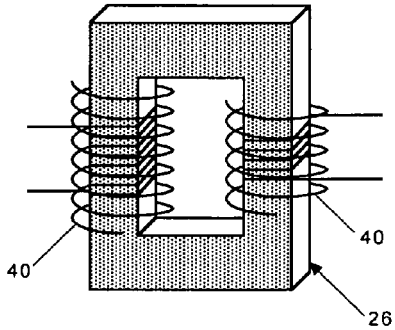

In another example of FIG. 3L, another system includes multiple counter units 40, where one of the counter units 40 is wound over the primary coil of the transformer 26, whereas another thereof is wound over the secondary coil of the transformer 26. In this context, each of the counter units 40 is a shape analog of each coil of the transformer 26 and such counter units 40 also operate on the local countering mechanism. Because these counter units 40 are axially aligned and also flush with such coils of the transformer 26, they 40 tend to emit the counter waves which are also ideally aligned with the harmful waves irradiated by the coils of the transformer 26. However, the dynamic magnetic flux generated by the counter units 40 also tend to flow along the transmitter core in the direction opposite to the flux generated by the transformer 26 and, therefore, decrease an efficiency of the transformer 26 as a whole. When desirable, the analogs 40 may define configurations different from those of the coils of the transformer 26, may be in different symmetric or asymmetric dispositions, may be placed at different distances from the transformer 26, and the like, as long as the counter units 40 emit such counter waves capable of canceling the harmful waves in such a target space. Other configurational and/or operational characteristics of the counter units of FIG. 3L may be similar (or identical) to those of the counter units of FIGS. 3A to 3K.

The size matching may be embodied by defining the counter unit to be larger than, similar to or smaller than the base unit whether or not maintaining the similarity between the configurations of such counter and base units. Whether or not the counter unit may emit the counter waves which have the wavefronts of the similar shapes as the counter unit itself, the size of the counter unit determines an extent of dispersion or flattening of the counter waves, edge characteristics of the wavefronts, and the like. As described hereinabove, the size of the counter unit is also dictated by various countering mechanisms adopted thereby, disposition thereof, amplitudes of the electrical energy supplied thereto, and the like. Conversely, the size of the counter unit may dictate the selection of other configurations thereof, proper countering mechanisms, and the like.

The disposition matching may be embodied by manipulating the orientation of the counter unit, alignment thereof, distance to the base unit and/or target space therefrom, its mobility, and the like. As described herein, the counter unit may be oriented in the preset relations with respect to various axes and/or various directions, may be disposed in the front, rear or lateral arrangement, may be aligned or misaligned with such directions and/or axes, may be aligned or misaligned with the base unit axially, radially, angularly, concentrically, laterally, and the like. The disposition of the counter unit may also be dictated by various countering mechanisms adopted thereby, shapes and sizes thereof, amplitudes of the electrical energy supplied thereto, and the like. Conversely, the disposition of the counter unit may dictate the selection of other configurations thereof, proper countering mechanisms, and the like.

The intensity matching may be embodied by manipulating the amplitudes of the counter waves emitted by the counter unit. For example, the counter waves may define the amplitudes greater than, similar to or less than those of the harmful waves when measured at a certain distance from the base unit, when measured across the target space or at a preset position in the target space, and the like. The amplitudes of the counter waves are further dictated by various countering mechanisms adopted thereby, shapes and sizes thereof, disposition thereof, amplitudes of such electrical energy supplied thereto, and the like. Conversely, the amplitudes of the counter waves may determine the selection of other configurations thereof, proper countering mechanisms, and the like.

A main purpose of the wave matching is to dispose the counter unit along at least one of such wavefronts of the harmful waves and to emit the counter waves defining the wavefronts capable of matching and countering those of the harmful waves. When a system preferentially depends on the wave matching to counter the harmful waves, its counter unit may be disposed anywhere around the base unit in any distance as long as the counter wavefronts may match the harmful wavefronts. It is appreciated that the wave matching is most powerful when the base unit defines a rather complex or asymmetric configuration or when it is impossible to construct a replica or approximation of a complex base unit. When such a system includes a single wave source having multiple base units or includes multiple waves sources each including at least one base unit, the single counter unit may be arranged to attain the wave matching with multiple base units or multiple counter units may instead be arranged to perform the wave matching with multiple base units. The only one disadvantage or complication as to the wave matching is that detailed shapes and distribution of the wavefronts of the harmful waves have to be assessed a priori.

In one type of the wave matching, the counter waves are emitted by at least one counter unit defining an uniform emitting capacity in which amplitudes per an unit configuration of the counter unit such as, e.g., its length, its width, its radius or diameter, its area, and/or its weight is maintained to be uniform thereacross. Therefore, such a counter unit emits the counter waves having the wavefronts which are similarly shaped as the counter unit itself and, when disposed along the wavefront of the harmful waves, counters the counter waves while defining the target space. In another type of the wave matching, such counter waves are emitted by another counter unit with a non-uniform emitting capacity in which amplitudes per the unit configuration of the counter unit vary thereacross. In such an arrangement, the counter unit emits the counter waves of the wavefronts which are not similar to the shape of the counter unit. Therefore, the counter unit of this non-uniform capacity are disposed not along a single wavefront of the harmful waves but across at least two of such wavefronts so as to emit the counter waves capable of matching the harmful waves and defining the target space.

It is appreciated that the counter units with the uniform emitting capacity may also be disposed along at least two wavefronts of the harmful waves as exemplified in FIG. 2K. When multiple counter units are disposed in different wavefronts of the harmful waves, such units may also be arranged to emit the counter waves of different amplitudes in order to compensate discrepancies in the distances to the base unit therefrom. Such compensation may be attained by various means, e.g., by adjusting the shapes and sizes of the counter units, by manipulating the amount of the electric energy supplied thereto, by controlling the orientations and/or alignments of such counter units, and the like. As far as a sum of the counter waves defines the wavefronts which match those of the harmful waves in the target space, such counter units may be disposed along adjacent or space-apart wavefronts of the harmful waves in various configurations and/or dispositions.

Similar to their counterparts in the case of the source matching, the counter unit for the wave matching may similarly define a shape of a wire, a strip, a sheet, a tube, a coil, a spiral, and/or a mesh, may also define a combination of two or more of such shapes without defining any holes or openings therethrough, may define an array of two of more of such shapes while defining multiple holes and/or openings therethrough, and so on, where examples of such combinations and/or arrays may include, but not be limited to, a bundle of multiple identical or different shapes bundling each other, a braid of multiple identical or different shapes braided along each other, and the like. Such a counter unit may then be disposed along the single or multiple wavefronts of the harmful waves.

When the counter unit is arranged to emit the counter waves capable of matching the harmful waves which are irradiated from such primary base units of the transformer such as its primary and secondary coils, the counter unit may have the configuration matching at least a portion of at least one wavefront of the harmful waves, may be disposed along at least a portion of at least one wavefront thereof, and the like. Multiple counter units may also be disposed in an arrangement matching at least a portion of only one wavefront of the harmful waves or at least portions of two or more wavefronts of the harmful waves, and the like. Multiple counter units may be disposed along a single or multiple wavefronts of the harmful waves while being separated from each other, while being mechanically and/or electrically coupled with each other, while being supplied with the electric energy in a preset pattern (e.g., separately, in a series mode, in a parallel mode, and the like), and the like. Such counter units may also be provided as an unitary article which approximates two or more of the primary base units. In the alternative, such a counter unit may define the configuration which is inverse to at least a portion of one or more wavefronts of such harmful waves in its location of disposition but matches at least a portion of one or multiple wavefronts thereof in the target space, may be disposed inversely to at least a portion of at least one wavefront of the harmful waves in its location of disposition but also matches at least a portion of at least one wavefront of the harmful waves in the target space, and the like. Multiple counter units may be disposed in an arrangement which is inverse to at least a portion of a single or multiple wavefronts of the harmful waves in its location of disposition but matches at least a portion of a single or multiple wavefronts of the harmful waves in the target space. FIGS. 4A to 4L represent schematic perspective views of exemplary counter units each arranged to match at least a portion of a single or multiple wavefronts of such harmful waves with at least a portion of at least one wavefront of the counter waves based on the wave matching according to the present invention.

Figure 4A:
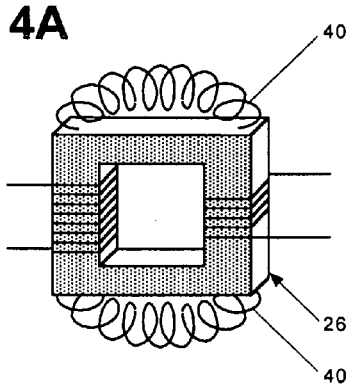
FIGS. 4A to 4L are schematic perspective views of exemplary counter units for approximating wavefronts in various configurations based on wave matching according to the present invention.

In one example of FIG. 4A, a system has a pair of counter units 40 each of which is formed as a coil wound around an arcuate center axis thereof. More specifically, an upper counter unit 40 may be disposed above the top of the core of the transformer 26 and aligned to be convex toward the top of such a core, while a lower counter unit 40 is disposed below the bottom of the core and aligned to be toward the core bottom. Therefore, the counter units 40 are in arrangements and alignment which qualitatively correspond to the wavefronts (or propagation paths) of such harmful waves toward the target space as illustrated in FIG. 1B. In addition, such counter units 40 are supplied with the electric energy in such a manner to emit the counter waves which propagate in the direction opposite to that of the harmful waves while defining the similar wave characteristics and the opposite phase angles. Accordingly, the harmful waves irradiated by the primary and secondary coils of the transformer 26 propagate into the counter units 40 and then are canceled and/or suppressed by the counter waves. A portion of such harmful waves which escapes through the counter units 40 may then be canceled or suppressed by the counter waves emitted from corresponding sides of the counter units 40.

The counter units 40 provided based on the wave matching may define the shapes which are different from those exemplified in the figure. For example, at least one of such counter units 40 may be shaped into the coil with an uniform outer diameter or into the coil with the diameter varying along its arcuate axis. In this embodiment, opposing ends of the coil 40 may have greater diameters than a center of the coil 40 or, in the alternative, the ends of the coil 40 may define smaller diameters than the center thereof. In another example, at least one of such counter units 40 may define the coil with an uniform pitch along at least a substantial portion of its arcuate axis or may be shaped into the coil with different pitches therealong. In this example, the ends of such a coil 40 may have a higher density of wire than the center of the coil 40 or, alternatively, the center of the coil 40 may have a higher density of the wire than the ends thereof. In another example, the arcuate center of at least one of the coils 40 may have a different radius of curvature such that a center of the axis may be disposed closer to (or farther from) the top (or bottom) of the transformer 26. In another example, such upper and lower coils 40 may have different configurations and/or may be in different dispositions, when such a target space is defined on only one side of such counter units 40. In another example, the upper and lower coils 40 may be wound in the same direction (or different directions) depending upon directions of the electric energy supplied thereto. In another example, such upper and lower coils 40 may be disposed from the top and from bottom of such a transformer 26, respectively, at the same distance or different distances. In the embodiment of this figure, the target space is typically defined over the upper coil 40 and/or below the lower coil 40. When it is not necessary to form such a target space in both of these regions, only a single coil 40 may be disposed over or below the transformer 26. In another example and as described above, the counter units 40 may be disposed beside the front and/or rear of such a transformer 26 when the harmful waves irradiated by the front and/or rear of the transformer 26 are not negligible, when such a target space is to be defined in the front and/or rear thereof, and the like. In another example, at least one of the counter units 40 may have multiple smaller coils which may be disposed laterally or concentrically while countering the harmful waves which are irradiated from the top or bottom of the transformer 26. In another example, the system may have more than two counter units 40 which may be incorporated in other arrangements for countering the harmful waves in other patterns or for defining the target space in other directions.

As described above, the transformer 26 operates through mutual induction by generating and flowing the magnetic flux along the transformer core. In this respect, the counter units 40 of FIG. 4A may propagate into the core and cancel such magnetic flux generated by the transformer coils due to the opposite phase angles of the counter waves, similar to those counter units of FIG. 3L. In order to prevent reduction in the magnetic flux, the opposing ends of the counter units 40 may be magnetically coupled to each other, where such counter waves may be rerouted from one end to an opposing end of the counter units 40. To this end, the opposing ends of the counter units 40 may be extended and face each other in a toroidal configuration, may be coupled to each other with materials defining a high magnetic permeability.

Figure 4D:
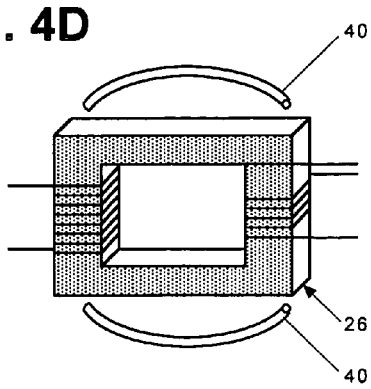
Figure 4B:
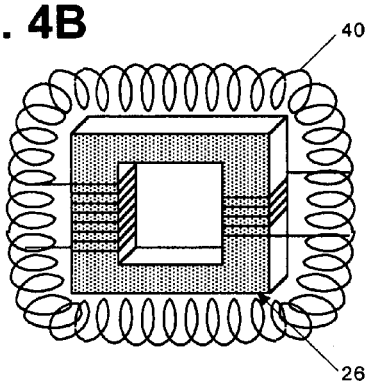

In another example of FIG. 4B, a system includes a single counter unit 40 which is formed as a coil wound around an circular center axis. More specifically, the center axis of such a counter unit 40 encloses therein the transformer 26 along its top, left side, bottom, and right side. As a result, such a counter unit 40 defines a coil which encircles such a transformer 26 therein in a toroidal configuration so that at least a substantial portion of the counter waves propagate through an interior of the counter unit 40. In this respect, the counter unit 40 is in an arrangement and alignment which also qualitatively corresponds to the wavefronts (or propagation paths) of the harmful waves toward the target space as exemplified in FIG. 1B. In addition, this counter unit 40 is supplied with the electric energy in such a manner to emit such counter waves which propagate therethrough along the direction opposite to that of the harmful waves while defining the similar wave characteristics and the opposite phase angles. Accordingly, the harmful waves irradiated by the primary and secondary coils of the transformer 26 propagate into the counter unit 40 and then are canceled and/or suppressed by such counter waves. A portion of such harmful waves which escapes through the counter units 40 may then be canceled or suppressed by the counter waves emitted from corresponding sides of the counter units 40.

The counter unit 40 operating on the wave matching may have the shape different from that of the figure. For example, the counter unit 40 may be shaped into the coil of an uniform outer diameter or into the coil of the diameter varying along its arcuate axis. In another example, the counter unit 40 may define the coil with an uniform pitch along at least a substantial portion of its arcuate axis or may be shaped into the coil with different pitches therealong. In another example, the counter unit 40 may be formed as an open coil, where opposing ends of such a coil 40 may be aligned to directions away from the target space. In another example, the arcuate center line of the coil 40 may have a different radius of curvature such that a center of the axis may be disposed closer to (or farther from) the top, bottom, and/or sides of the transformer 26. In another example, the counter unit 40 may be disposed beside the front and/or rear of such a transformer 26 when the harmful waves irradiated by the front and/or rear of the transformer 26 are not negligible, when the target space is to be defined in the front and/or rear thereof, and the like. In another example, such a counter unit 40 may have multiple smaller coils which may be disposed laterally or concentrically while countering the harmful waves which are irradiated from the top or bottom of the transformer 26. In another example, such a system may have multiple counter units 40 which may be incorporated in other arrangements for countering the harmful waves in other patterns. Further configurational and/or operational characteristics of the counter unit 40 of FIG. 4B are similar or identical to those of FIG. 4A.

Figure 4E:
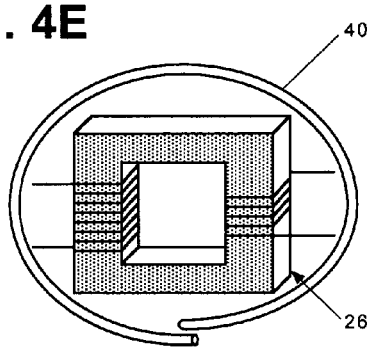
Figure 4C:
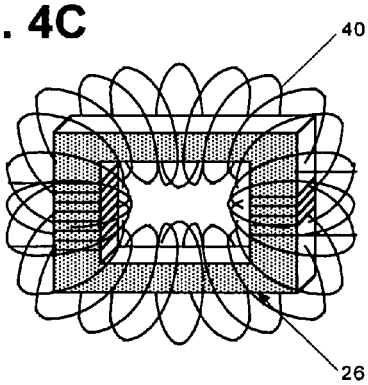

In another example of FIG. 4C, a system includes a single counter unit 40 which is formed as a coil wound around an circular center axis similar to that of FIG. 4B. However, such a counter unit 40 is arranged to enclose the transformer 26 therein such that the counter waves emitted by the counter unit 40 preferentially propagate therealong. Therefore, the counter waves counter the harmful waves irradiated out of the transmitter 26 inside the counter unit 40. It is appreciated that the counter waves also propagate into the transmitter core and propagate in a direction opposite to that of such magnetic flux generated by the primary and secondary coils of the transmitter 26, thereby partially decreasing the magnetomotive force of the transmitter 26. In order to minimize this adverse effect on the coils of the transmitter 26 by the counter waves, the counter unit 40 may be disposed in the arrangement that the transmitter 26 is not disposed along the arcuate center line of the counter unit 40 but closer to an inner surface of the counter unit 40 for minimizing the amount of such counter waves flowing through the transmitter core.

The counter unit 40 operating on the wave matching may have the shape different from that of the figure. For example, the counter unit 40 may be shaped into the coil of an uniform outer diameter or into the coil of the diameter varying along its arcuate axis. In another example, the counter unit 40 may define the coil with an uniform pitch along at least a substantial portion of its arcuate axis or may be shaped into the coil with different pitches therealong. In another example, the counter unit 40 may be formed as an open coil, where opposing ends of such a coil 40 may be aligned to directions away from the target space. In another example, the arcuate center line of the coil 40 may have a different radius of curvature such that a center of the axis may be disposed closer to (or farther from) the top, bottom, and/or sides of the transformer 26. In another example, the counter unit 40 may be disposed to extend beyond the front and/or rear of such a transformer 26 when the harmful waves irradiated by the front and/or rear of the transformer 26 are not negligible, when such a target space is defined in the front and/or rear thereof, and the like. In another example, the counter unit 40 may have multiple smaller coils which may be disposed laterally or concentrically while countering such harmful waves which are irradiated from the top or bottom of the transformer 26. In another example, such a system may include multiple counter units 40 which may be incorporated in other arrangements for countering the harmful waves in other patterns. Further configurational and/or operational characteristics of the counter unit 40 of FIG. 4C are similar or identical to those of FIGS. 4A and 4B.

In another example of FIG. 4D, a system includes a pair of counter units 40 each formed as an arcuate wire. More specifically, an upper counter unit 40 may be disposed above the top of the core of the transformer 26 and aligned to be convex toward the top of such a core, while a lower counter unit 40 is disposed below the bottom of the core and aligned to be toward the core bottom. Therefore, the counter units 40 are in arrangements and alignment qualitatively corresponding to the wavefronts (or propagation paths) of the harmful waves propagating toward the target space as illustrated in FIG. 1B. In addition, the counter units 40 are supplied with the electric energy in such a manner to emit the counter waves which propagate in the direction opposite to that of the harmful waves while defining the similar wave characteristics and also having the opposite phase angles. Accordingly, the harmful waves irradiated by the coils of the transformer 26 propagate toward such counter units 40 and then canceled and/or suppressed by the counter waves. A portion of the harmful waves which escapes through the counter units 40 may then be canceled or suppressed by the counter waves emitted from corresponding sides of the counter units 40.

The counter units 40 provided based on the wave matching may define the shapes which are different from those exemplified in the figure. For example, at least one of such counter units 40 may be shaped into the arcuate wire of an uniform outer diameter or into the wire of the diameter varying along its arcuate axis. In this embodiment, opposing ends of the wire 40 may have greater diameters than a center of the wire 40 or, in the alternative, the ends of the wire 40 may have smaller diameters than the center thereof. In another example, at least one of such counter units 40 may have the wire with an uniform pitch along at least a substantial portion of its arcuate axis or may be shaped into the wire defining different pitches therealong. In this example, the ends of the wire 40 may be thicker (or thinner) than the center of wire 40. In another example, at least one of the wires 40 may also have a different radius of curvature and may be disposed closer to (or farther from) the top (or bottom) of the transformer 26. In another example, the upper and lower wires 40 may have different configurations and/or may be in different dispositions, when such a target space is defined on only one side of such counter units 40. In another example, the upper and lower may be respectively disposed from the top and from the bottom of such a transformer 26 at the same distance or at different distances. In the embodiment of this figure, the target space is generally defined over the upper wire 40 and/or below the lower wire 40. When it is not necessary to form the target space in both of these regions, only a single wire 40 may be disposed over or below the transformer 26. In another example, such counter units 40 may be disposed beside the front and/or rear of the transformer 26 when the harmful waves irradiated by the front and/or rear of the transformer 26 are not negligible, when such a target space is to be defined in the front and/or rear thereof, and the like. In another example, at least one of such counter units 40 may have multiple smaller coils disposed laterally or concentrically while countering the harmful waves irradiated from the top or bottom of the transformer 26. In another example, such a system may have more than two counter units 40 which may be incorporated in other arrangements for countering the harmful waves in other patterns or for defining the target space in other directions. Other configurational and/or operational characteristics of the counter unit 40 of FIG. 4D are similar or identical to those of FIGS. 4A to 4C.

In another example of FIG. 4E, a system includes a single counter unit 40 which is formed as a wire enclosing therein the transformer 26 around its top, left side, bottom, and right side. As a result, the counter unit 40 is in an arrangement and alignment qualitatively corresponding to such wavefronts (or propagation paths) of such harmful waves propagating toward the target space as exemplified in FIG. 1B. In addition, the wire-shaped counter unit 40 emits the counter waves having the wavefronts which are shaped similar to itself. Accordingly, when the counter unit 40 is supplied with the electric energy, the counter unit 40 emits the counter waves having the phase angles opposite to those of the harmful waves and the wave characteristics similar to those of the harmful waves. Therefore, such harmful waves irradiated from the primary and secondary coils of the transformer 26 are canceled or suppressed by the counter waves. It is appreciated that the counter unit 40 operating on such wave matching may have the configurations which are different from that of the figure in a manner similar to those of FIGS. 4B and 4D. Other configurational and/or operational characteristics of the counter unit 40 of FIG. 4E are similar or identical to those of FIGS. 4A to 4D.

Figure 4F:
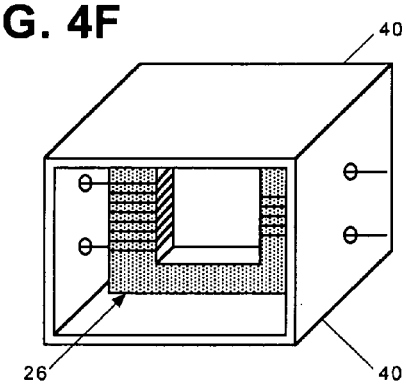

In another example of FIG. 4F, a single counter unit 40 is shaped as a cage which encloses at least a portion of the transformer 26 therein. In the embodiment of this figure, the counter unit 40 is an open cage which encloses the top, sides, and bottom of the transformer 26 but which is open through the front and rear of the transformer 26. As a result, the counter unit 40 is in an arrangement and an alignment qualitatively corresponding to the wavefronts (or propagation paths) of the harmful waves propagating toward the target space. Such a counter unit 40 is also arranged to receive the electric energy in a preset direction and pattern to emit the counter waves defining the phase angles opposite to those of the harmful waves and the wave characteristics similar to those of such harmful waves. As a result, the counter waves counter the harmful waves when both waves propagate to the target space. It is appreciated that such a counter unit 40 may be provided in different configurations and/or may be in different arrangements. For example, the counter unit 40 may define different shapes, may be open in different number of sides and/or in different sides, may be oriented in different directions, and the like. In addition, such a counter unit 40 may also be disposed symmetrically or asymmetrically with respect to the transformer 26. Other configurational and/or operational characteristics of such a counter unit 40 of FIG. 4F are similar or identical to those of FIGS. 4A to 4E.

Figure 4G:
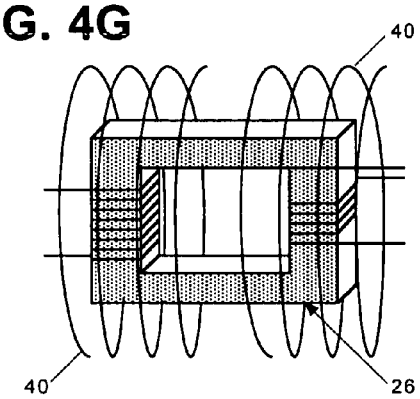
Figure 4J:
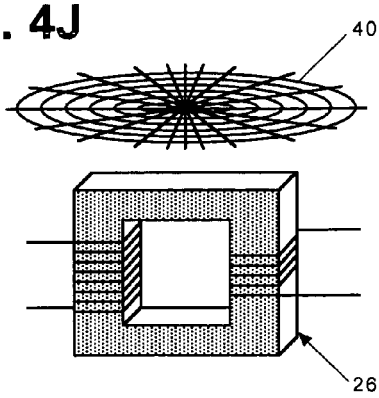

In another example of FIG. 4G, a counter unit 40 is provided as a coil which is wound around an exterior of the transformer 26. In the embodiment of this figure, the counter unit 40 is wound along an axis which connects the primary and secondary coils of the transformer 26, and emits the counter waves along one direction. Such counter waves then propagate from one to the other of the primary and secondary coils of the transformer 26 while countering the harmful waves irradiated by the coils of the transformer. It is appreciated that the counter waves also propagate into the transformer core and travel therealong through the top and bottom of the core along the same direction. As described in FIG. 1B, however, the magnetic flux generated by the primary coil travel along the top of the core in one direction and the bottom of the core along an opposite direction. It is, therefore, expected that the counter waves may reduce the magnetic flux flowing along the transformer core and also reduce the magnetomotive force of the transformer 26. It is to be understood, however, that the counter waves which cancel the magnetomotive force in one of the top and bottom of the core actually augment such force in the other of the top and bottom thereof. Therefore, the net effect of the counter waves may not hinder the magnetomotive force of the transformer 26. When it is desirable to minimize reduction of the magnetomotive force by the counter waves, the counter unit 40 may be misaligned off a center line of the top or bottom of the core of the transformer or, in the alternative, the counter unit 40 may be disposed asymmetrically with respect thereto. In order to better match the wavefronts of the harmful waves, such a counter unit 40 may have the diameter which also varies along an axis thereof. Other configurational and/or operational characteristics of such a counter unit of FIG. 4G may also be similar or identical to those of FIGS. 4A to 4F.

Figure 4H:
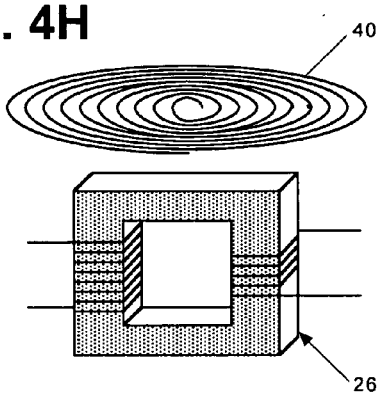
Figure 4K:
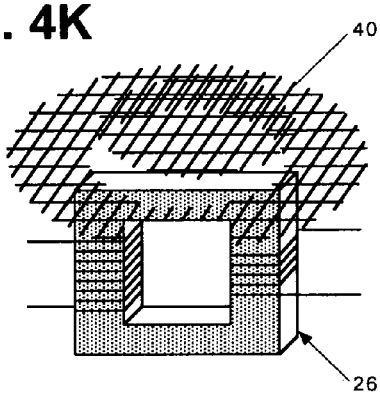
Figure 4I:
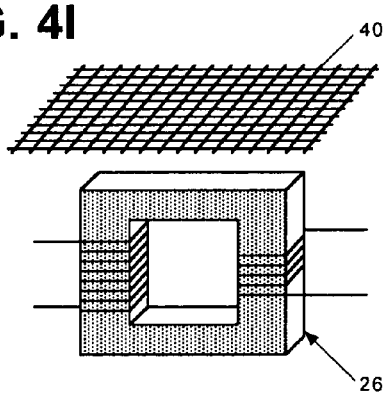
Figure 4L:
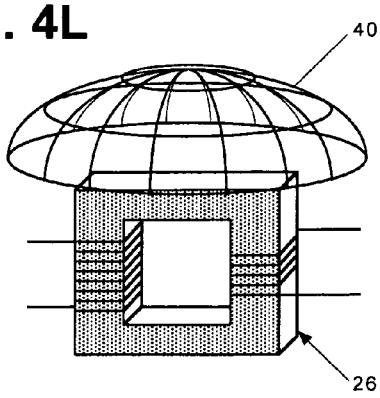

In another example of FIG. 4H, a single counter unit 40 is shaped as a spiral and disposed over a desired portion of the transformer 26 to form the target space in a preset direction therefrom. More specifically, such a counter unit 40 is formed as a flat or planar spiral and disposed over the top of the transformer core. In another examples of FIG. 4I, a counter unit 40 is provided as a mech which have multiple rows and columns of wires interwoven together. In this embodiment, the mesh 40 is disposed parallel to and over the top of the transformer core. In another example of FIG. 4J, a counter unit 40 is formed as another mesh consisting of radial backbones coupling multiple concentric rings of wires. In this embodiment, the mesh 40 is similarly disposed parallel to and over the top of the core. In another example of FIG. 4K, a system includes a pair of counter units 40 which are typically identical to that of FIG. 4H but shaped and sized to overlap each other in a center of the top of the transformer core. In this example, an inner counter unit 40 is disposed over the center of the top of such a core, while an outer counter unit 40 is disposed away from the center of the top thereof but closer to the top of the core. In another example of FIG. 4L, a counter unit 40 is generally similar to that of FIG. 4I, except that the unit 40 is arranged to have a three-dimensional contour. More specifically, such a counter unit 40 is arranged to be convex downward toward the top of the core, thereby matching the wavefronts of the harmful waves better than that of FIG. 4I assuming when the harmful wavefronts have the shape of FIG. 1B. Other configurational and/or operational characteristics of the counter units 40 of FIGS. 4H to 4L are similar or identical to those of FIGS. 4A to 4G.

Configurational and/or operational variations of the EMC transformer systems and their counter units as well as configurational and/or operational modifications of the EMC systems and their counter units as exemplified in FIGS. 3A to 3L and FIGS. 4A to 4L of this invention and as disclosed herein with reference to such figures also fall within the scope of the present invention.

Either alone or in conjunction with various counter units of this invention, the transformer core may have different shapes capable of reducing the amount of the harmful waves irradiated therefrom. For example, the core may form rounded edges to reduce singular characteristics thereat. In another example, the core may form more round shapes than its conventional counterparts, thereby reducing such singular characteristics. In another example, such a core may be made of and/or include at least one highly magnetically permeable material, where examples of such materials may include, but not be limited to, various nickel/iron based alloys, various cobalt based alloys, and the like. These alloys are commercially available in trademark names of Mumetal Alloys™, Co-Netic Alloys™, and Netic Alloys™ provided by Magnetic Shield Corporation (Bensenville, Ill.), and other alloys such as Hipernom™, HyMu-80™, Permalloy™, and the like, and exhibit the relative magnetic permeability ranging from about several thousands to a million.

It is appreciated that any of the counter units described hereinabove may not be supplied with the electric energy and, therefore, may not actively emit the counter waves in response to the energy. Rather, the counter units may define the above configurations and may be in the above disposition so that the harmful waves irradiated by various base units of the transformer may be absorbed into such counter units and converted to the electric voltage and/or current, thereby reducing the amount of the harmful waves propagating toward the target space. Accordingly, the EMC system may include one or multiple counter units all of which serve as the passive counter units (i.e., those not receiving the electric energy), may include at least one passive counter unit and at least one active counter unit (i.e., one receiving the electric energy) or may include one or multiple counter units all of which serve as the active counter units. When desirable, a specific counter unit may be arranged to serve as the active and passive counter units from time to time.

In another aspect of the present invention, any of the above EMC systems may include at least one electric shield and/or magnetic shield. In one example, the electric and/or magnetic shields (will be referred to as the "ES" and "MS" hereinafter, respectively) may be implemented into, on, over or below various portions of the EMC system. In another example, such ES and/or MS may also be implemented as above and also used in conjunction with any of the above counter units. In general, the ES may be made of and/or include at least one electrically conductive material such that the electric waves of the harmful waves may be absorbed thereinto and rerouted therealong. When desirable, the ES may also be grounded so that the absorbed and rerouted electric waves may be eliminated therefrom. The MS may be made of and/or include at least one magnetically permeable path member which may be able to absorb the magnetic waves of the harmful waves thereinto and then to reroute such magnetic waves therealong. When desirable, the MS may have a magnet member which may be magnetically coupled to the path member and terminate the absorbed and rerouted magnetic waves in at least one magnetic pole of the magnet member. The MS may include at least one optional shunt member which may also be magnetically permeable and shield its magnet member, thereby confining magnetic fields from such a magnet member closer thereto. Other details of such ES and MS have already been provided in the above co-pending Applications such as, e.g., "Shunted Magnet Systems and Methods" which bears a Ser. No. 11/213,703, "Magnet-Shunted Systems and Methods" which also bears a Ser. No. 11/213,686, and "Electromagnetic Shield Systems and Methods" which bears a Serial Number U.S. Ser. No. 60/723,274. It is appreciated that the details of these co-pending Applications may be modified so that the heating elements of such co-pending Applications may be replaced by various counter units of the present invention and that the ES and/or MS may be incorporated to the counter units of this invention as such ES and/or MS have been incorporated into various heating elements of the above co-pending Applications. It is appreciated that the ES and/or MS may also be incorporated into various portions of the EMC systems of this invention as the counter units are incorporated into such portions of the EMC systems of this invention.

The ES and/or MS may be provided to define the configuration which is identical to or similar to those of various counter units of this invention. The ES and/or MS may also be disposed in, on, over, around, and/or through the base and/or counter units. The ES and/or MS may have the configuration at least partially conforming to that of such base and/or counter units or, in the alternative, may define the configuration at least partially different from those of the ES and/or MS.

The path member of the MS may define the relative magnetic permeability greater than 1,000 or 10,000, 100,000 or 1,000,000. The shunt member may be arranged to directly or indirectly contact the magnet member and to define a relative magnetic permeability greater than 1,000, 10,000, 100,000 or 1,000,000. The ES and/or MS described hereinabove or disclosed in the co-pending Applications may further be incorporated into any of the prior art devices with or without any of the above counter units and define such EMC systems of this invention. The ES and/or MS may define the configuration which may be maintained to be uniform along the longitudinal or short axis of the base and/or counter units or which may vary therealong. Such configurations of the ES and/or MS may be identical to, similar to or different from those of the base and/or counters. The EMC system may include multiple ES and/or MS, where at least two of the MS and/or ES may shield against the magnetic waves and/or electric waves of the same or different frequencies in same or different extents. The ES and/or MS may be disposed over at least a portion (or entire portion) of the base and/or counter units. The EMC system may also include therein one or more of any of the above counter units as well as the ES and/or MS, where the base and/or counter units may operate on AC or DC.

As described above, the EMC systems of this invention may be provided with multiple defense mechanisms against the harmful waves which are irradiated by various base units of such a system. In one example, the counter unit may be incorporated into various portions of such an EMC system as described above. Accordingly, a single or multiple counter units may be provided in any of the above configurations and incorporated in any of the above dispositions. In another example, such ES and/or MS may be incorporated into various portions of the EMC system and shield against the electric and/or magnetic waves of such harmful waves, respectively, where dispositions of the ES and/or MS have been described in the above co-pending Applications. In another example, not only the counter units but also at least one of the ES and/or MS may be implemented into the EMC system so that the counter unit may counter at least a portion of such harmful waves and that the ES and/or MS may absorb and reroute the rest thereof.

It is appreciated that any of the above counter units are provided while using the least amount of such electrically conductive, semiconductive, and/or insulative materials, while minimizing a volume, a size, and/or a mass of such counter units. Accordingly, such counter units may be fabricated with less materials at lower costs and may be easily implemented into various locations of the EMC system. It is also appreciated that any of the above counter units are provided to emit the counter waves while using the least amount of electrical energy, e.g., by drawing the least amount of the electric current or voltage. Therefore, such counter units are not only energy-efficient but also least affecting operation of other parts of the EMC systems and their intended functions. In addition, these requirements of this paragraph may minimize electric resistances of the counter units and, therefore, minimize voltage drop across the counter units.

Unless otherwise specified, various features of one embodiment of one aspect of the present invention may apply interchangeably to other embodiments of the same aspect of this invention and/or embodiments of one or more of other aspects of this invention. Therefore, any of the counter units of FIGS. 2A to 2L may be implemented to various EMC transformer systems of FIGS. 3A to 3L and FIG. 4A to 4L, and other systems disclosed herein without any accompanying figures. In addition, the counter units for such EMC transformer systems may be implemented into other EMC systems of this invention, and the like. Moreover, any of the counter units operating on the source matching may be converted to operate on the wave matching or vice versa, where the source-matched counter units may then be disposed along one or more wavefronts of the harmful waves from the base unit or where the wave-matched counter units may be disposed in the preset relation to the base unit or may be incorporated in the arrangement similar to that of the base units. In addition, any of such ES and/or MS disclosed in the co-pending Applications may be incorporated to any counter units disclosed hereinabove.

Various EMC systems of the present invention may operate on the AC power while countering the harmful EM waves with their counter units. When desirable, the counter units of the EMC systems may operate on the DC power while similarly countering the harmful waves. It is appreciated that the systems may also use any conventional modalities capable of shielding and/or canceling such harmful waves. Therefore, it is preferable that any extra wires, strips, plates, sheets, and other parts of the EMC transformer systems may be braided, bundled, concentrically fabricated or otherwise treated in order to minimize irradiation of the harmful waves.

It is to be understood that, while various aspects and/or embodiments of the present invention have been described in conjunction with the detailed description thereof, the foregoing description is intended to illustrate and not to limit the scope of the invention, which is defined by the scope of the appended claims. Other embodiments, aspects, advantages, and modifications are within the scope of the following claims as well.

What is claimed is:

1. A transformer system capable of countering harmful electromagnetic waves irradiated from a plurality of base units of at least one wave source by at least one of canceling said harmful waves in a target space and suppressing said harmful waves from propagating to said target space, wherein said base units are configured to include only portions of said wave source which are responsible for at least one of irradiating said harmful waves and affecting propagation paths of said harmful waves therethrough, wherein said target space is defined between at least one body part of an user and at least one of said base units, and wherein said harmful waves define frequencies which are less than about 1 kHz comprising:

at least one transformer core which is configured to define a plurality of sides therealong;

at least one primary coil which is configured to be disposed around one of said sides of said transformer core, to be electrically insulated from said core, to receive electrical energy, and to form magnetic flux along said core in a preset direction determined by said energy while serving as one of said base units and irradiating said harmful waves;

at least one secondary coil which is configured to be disposed about another of said sides of said transformer core, to be electrically insulated from said core, and to induce electrical energy from said magnetic flux by said primary coil while serving as another of said base units and irradiating said harmful waves; and at least one counter unit which is configured to define a configuration similar to (or identical to) that of at least one of said base units, to be in a disposition based on a preset relation to at least one of said base units, and to emit counter electromagnetic waves, whereby said counter waves are configured to define phase angles at least partially opposite to those of said harmful waves, to have wave characteristics at least partially similar to those of said harmful waves due to said configuration and, therefore, to counter said harmful waves in said target space due to said phase angles.

2. The system of claim 1, wherein said configurations include at least one of shapes of said base and counter units, sizes of said base and counter units, and arrangements of said base and counter units.

3. The system of claim 1, wherein said system includes a single counter unit which is configured to define one of a first shape which is at least substantially similar to only one of said coils, a second shape which is at least substantially similar to an assembly of said coils, and a third shape which is at least substantially similar to an assembly of said coils and core.

4. The system of claim 1, wherein said system includes a single counter unit which is configured to have a shape which is at least substantially similar to one of a first assembly of at least two of said base units and a second assembly of at least three of said base units.

5. The system of claim 4, wherein said counter unit is also configured to be disposed in one of a plurality of arrangements one of which is a lateral arrangement in which said counter unit is disposed side by side with at least one of said base units, a second of which is another lateral arrangement in which said counter unit is laterally stacked beside at least one of said base units, a third of which is a vertical arrangement in which said counter unit is disposed one of over and below at least one of said base units, a fourth of which is a concentric arrangement in which said counter unit is disposed in at least one of said base units, and a fifth of which is yet another concentric arrangement in which said counter unit is enclosing at least a portion of at least one of said base units.

6. The system of claim 1, wherein said system includes at least two counter units one of which is configured to have a shape which is at least substantially similar to said primary coil and another of which is configured to have a shape which is at least substantially similar to said secondary coil.

7. The system of claim 6, wherein at least one of said counter units is configured to be disposed in one of a plurality of arrangements one of which is a lateral arrangement in which said at least one of said counter units is disposed side by side with respect to at least one of said base units, a second of which is a lateral arrangement in which said at least one of said counter units is laterally stacked beside at least one of said base units, a third of which is a vertical arrangement in which said at least one of said counter units is disposed one of over and below at least one of said base units, a fourth of which is a concentric arrangement in which said at least one of said counter units is disposed in at least one of said base units, and a fifth of which is another concentric arrangement in which said at least one of said counter units is enclosing at least a portion of at least one of said base units.

8. The system of claim 7, wherein at least two of said counter units are configured to be at least one of mechanically, magnetically, and electrically coupled to each other.

9. The system of claim 1, wherein said counter unit is configured to be incorporated between at least one of said base units and target space and to emit said counter waves of amplitudes less than amplitudes of said harmful waves for countering said harmful waves in said target space.

10. The system of claim 9, wherein said configuration of said counter unit has a dimension which is configured to be longer than a dimension of each of said base units and to match radii of curvature of said counter waves with those of said harmful waves in said target space.

11. The system of claim 1, wherein said counter unit is configured to be disposed on an opposite side of said target space with respect to at least one of said base units and then to emit said counter waves of amplitudes greater than amplitudes of said harmful waves in order to counter said harmful waves in said target space.

12. The system of claim 11, wherein said configuration of said counter unit has a dimension which is configured to be shorter than a dimension of each of said base units and to match radii of curvature of said counter waves with those of said harmful waves in said target space.

13. The system of claim 1 further comprising at least one case member which includes an exterior surface and an interior surface and which is configured to define an exterior of said system, wherein said counter unit is configured to be one of coupled to said exterior surface, coupled to said interior surface, and embedded between said interior and exterior surfaces.

14. The system of claim 1, wherein said counter waves propagate while defining a plurality of first wavefronts therealong, wherein said harmful waves propagate while defining a plurality of second wavefronts therealong, and wherein said counter unit is configured to emit said counter waves in a manner that at least a portion of at least one of said first wavefronts is configured to match at least a portion of at least one of said second wavefronts in said target space.

15. A transformer system capable of countering harmful electromagnetic waves irradiated from a plurality of base units of at least one wave source by at least one of canceling said harmful waves in a target space and suppressing said harmful waves from propagating to said target space, wherein said base units are configured to include only portions of said wave source which are responsible for at least one of irradiating said harmful waves and affecting propagation paths of said harmful waves therethrough, wherein said target space is defined between at least one body part of an user and at least one of said base units, and wherein said harmful waves define frequencies which are less than about 1 kHz comprising:

at least one transformer core which is configured to define a plurality of sides therealong;

at least one primary coil which is configured to be disposed around one of said sides of said transformer core, to be electrically insulated from said core, to receive electrical energy, and to form magnetic flux along said core in a preset direction determined by said energy while serving as one of said base units and irradiating said harmful waves;

at least one secondary coil which is configured to be disposed about another of said sides of said transformer core, to be electrically insulated from said core, and to induce electrical energy from said magnetic flux by said primary coil while serving as another of said base units and irradiating said harmful waves; and at least one counter unit which is configured to define a configuration different from that of at least one of said base units, to be in a preset disposition, and to be supplied with electric voltage in a manner for emitting counter electromagnetic waves having phase angles at least partially opposite to those of said harmful waves, at least partially matching wave characteristics of said harmful waves due to said disposition and, accordingly, countering said harmful waves due to said phase angles and wave characteristics in said target space.

16. The system of claim 15, wherein said counter waves propagate while defining a plurality of first wavefronts therealong, wherein said harmful waves also propagate while defining a plurality of second wavefronts therealong, and wherein said counter unit is also configured to emit said counter waves in such a manner that at least a portion of at least one of said first wavefronts is configured to match at least a portion of at least one of said second wavefronts in said target space.

17. A transformer system capable of countering harmful electromagnetic waves irradiated from a plurality of base units of at least one wave source by at least one of canceling said harmful waves in a target space and suppressing said harmful waves from propagating to said target space, wherein said base units are configured to include only portions of said wave source which are responsible for at least one of irradiating said harmful waves and affecting propagation paths of said harmful waves therethrough, wherein said target space is defined between at least one body part of an user and at least one of said base units, and wherein said harmful waves define frequencies which are less than about 1 kHz comprising:

at least one transformer core which is configured to define a plurality of sides therealong;

at least one primary coil which is configured to be disposed around one of said sides of said transformer core, to be electrically insulated from said core, to receive electrical energy, and to form magnetic flux along said core in a preset direction determined by said energy while serving as one of said base units and irradiating said harmful waves;

at least one secondary coil which is configured to be disposed about another of said sides of said transformer core, to be electrically insulated from said core, and to induce electrical energy from said magnetic flux by said primary coil while serving as another of said base units and irradiating said harmful waves, wherein a sum of said harmful waves irradiated by said primary and secondary coils is configured to propagate while defining a plurality of wavefronts; and at least one counter unit which is configured to be disposed in an arrangement defined along at least one of said wavefronts and to be supplied with at least one of electric current and voltage in such a manner for emitting counter electromagnetic waves which have phase angles at least partially opposite to those of said harmful waves, propagate toward said target space while defining another plurality of wavefronts, and to counter said harmful waves due to said arrangement and said phase angles in said target space by matching at least a portion of at least one of said wavefronts of said harmful waves with at least a portion of at least one of said wavefronts of said counter waves.

18. The system of claim 17, wherein said counter unit is incorporated in a preset distance from at least one of said base units and target space such that said counter unit is configured to extend along a length greater than that of said at least one of said base units when disposed closer to said target space than said at least one of said base units and that said counter unit is configured to extend along another length which is less than that of said at least one of base units when disposed farther away from said target space than said base unit.

19. The system of claim 17, wherein said system is configured to have a plurality of said counter units at least two of which are configured to be disposed in said arrangement for at least one of said canceling and suppressing.

20. The system of claim 17, wherein said system is configured to have a plurality of said counter unit, wherein each of said wavefronts is configured to define a radius of curvature, and wherein at least two of said counter units are configured to manipulate said phase angles of said counter waves in such a manner that said at least two of said counter units emit counter waves with identical phase angles for increasing said radii of said curvature of said counter waves and that said at least two of said counter units emit counter waves having at least partially opposite phase angles for decreasing said radii of said curvature of said counter waves.

* * * * *